US010071290B2

(12) United States Patent
Boyd et al.

(10) Patent No.: US 10,071,290 B2
(45) **Date of Patent: *Sep. 11, 2018**

(54) GOLF CLUB HEADS OR OTHER BALL STRIKING DEVICES HAVING DISTRIBUTED IMPACT RESPONSE

(75) Inventors: Robert Boyd, Flower Mound, TX (US); Eric Larson, Ft. Worth, TX (US); Kenneth Brown, Tolland, CT (US); Martin Brouillette, Sherbrook (CA)

(73) Assignee: NIKE, Inc., Beaverton, OR (US)

( * ) Notice: Subject to any disclaimer, the term of this patent is extended or adjusted under 35 U.S.C. 154(b) by 544 days.

This patent is subject to a terminal disclaimer.

(21) Appl. No.: 13/308,039

(22) Filed: Nov. 30, 2011

(65) Prior Publication Data

US 2012/0142447 A1 Jun. 7, 2012

Related U.S. Application Data

(60) Provisional application No. 61/541,767, filed on Sep. 30, 2011, provisional application No. 61/418,240, filed on Nov. 30, 2010.

(51) Int. Cl.
*A63B 53/04* (2015.01)
*A63B 60/54* (2015.01)
(Continued)

(52) U.S. Cl.
CPC ..... *A63B 53/0466* (2013.01); *A63B 60/54* (2015.10); *A63B 53/047* (2013.01);
(Continued)

(58) Field of Classification Search
CPC ..... A63B 53/0466; A63B 2053/0433; A63B 2053/0437; A63B 2053/0416
(Continued)

(56) References Cited

U.S. PATENT DOCUMENTS 569,438 A 10/1896 Urquhart
632,885 A 9/1899 Sweny
(Continued)

FOREIGN PATENT DOCUMENTS

CA 2139690 A1 7/1996
CN 2411030 Y 12/2000
(Continued)

OTHER PUBLICATIONS

ISR & WO dated Dec. 18, 2012 from PCT Application No. PCT/US2012/057490.
(Continued)

*Primary Examiner* — Alvin Hunter
(74) *Attorney, Agent, or Firm* — Banner & Witcoff, Ltd.

(57) ABSTRACT

A ball striking device, such as a golf club head, includes a face having a ball striking surface configured for striking a ball and a body connected to the face and extending rearwardly from the face. The body has an impact-influencing structure positioned adjacent at least one peripheral edge of the face. A majority of a force generated by impact with a ball is absorbed by the impact-influencing structure, and a majority of a response force generated by the head upon impact with the ball is generated by the impact-influencing structure. The face may have increased stiffness as compared to existing faces, and may include a stiffening structure to create the increased stiffness. In one embodiment, the face may have a stiffness proximate the geometric center that is from about 46,000 to 56,000 lb-in$^2$.

35 Claims, 28 Drawing Sheets

(51) Int. Cl.
*A63B 60/52* (2015.01)
*A63B 60/00* (2015.01)

(52) U.S. Cl.
CPC ..... *A63B 53/0487* (2013.01); *A63B 60/52* (2015.10); *A63B 2053/042* (2013.01); *A63B 2053/045* (2013.01); *A63B 2053/0416* (2013.01); *A63B 2053/0425* (2013.01); *A63B 2053/0433* (2013.01); *A63B 2053/0437* (2013.01); *A63B 2060/002* (2015.10); *A63B 2209/02* (2013.01); *A63B 2225/01* (2013.01)

(58) Field of Classification Search
USPC ..... 473/324–350
See application file for complete search history.

(56) References Cited

U.S. PATENT DOCUMENTS 648,256 A 4/1900 Hartley
777,400 A 12/1904 Clark
1,133,129 A 3/1915 Govan
1,222,770 A 4/1917 Kaye
1,705,997 A * 3/1929 Quynn ..... 473/329
1,840,924 A 1/1932 Tucker
1,854,548 A 4/1932 Hunt
1,916,792 A 7/1933 Hadden
2,004,968 A 6/1935 Young
2,041,676 A 5/1936 Gallagher
2,087,685 A 7/1937 Hackney
2,429,351 A 10/1947 Fetterolf
2,550,846 A 5/1951 Milligan
2,750,194 A 6/1956 Clark
3,061,310 A 10/1962 Giza
3,064,980 A 11/1962 Steiner
3,084,940 A 4/1963 Cissel
3,170,698 A 2/1965 Schoefller et al.
3,212,783 A 10/1965 Bradley
3,519,271 A 7/1970 Smith
3,606,327 A 9/1971 Gorman
3,788,647 A 1/1974 Evans
3,792,863 A 2/1974 Evans
3,806,131 A 4/1974 Evans
3,810,631 A 5/1974 Braly
3,814,437 A 6/1974 Winquist
3,945,646 A 3/1976 Hammond
3,966,210 A 6/1976 Rozmus
3,970,236 A 7/1976 Rogers
3,976,299 A 8/1976 Lawrence et al.
3,980,301 A 9/1976 Smith
3,997,170 A 12/1976 Goldberg
4,194,739 A 3/1980 Thompson
4,291,883 A 9/1981 Smart et al.
4,313,607 A 2/1982 Thompson
4,322,083 A 3/1982 Imai
4,398,965 A * 8/1983 Campau ..... 148/522
4,431,192 A 2/1984 Stuff, Jr.
4,438,931 A 3/1984 Motomiya
4,444,392 A 4/1984 Duclos
4,511,145 A 4/1985 Schmidt
4,523,759 A 6/1985 Igarashi
4,534,558 A 8/1985 Yoneyama
4,535,990 A 8/1985 Yamada
4,582,321 A 4/1986 Yoneyama
4,630,827 A 12/1986 Yoneyama
4,635,941 A 1/1987 Yoneyama
4,664,383 A 5/1987 Aizawa
4,667,963 A 5/1987 Yoneyama
4,681,321 A 7/1987 Chen et al.
4,697,814 A 10/1987 Yamada
4,708,347 A 11/1987 Kobayashi
4,728,105 A 3/1988 Kobayashi
4,732,389 A 3/1988 Kobayashi
4,811,949 A 3/1989 Kobayashi
4,811,950 A 3/1989 Kobayashi
4,842,280 A 6/1989 Hilton
4,867,458 A 9/1989 Sumikawa et al.
4,871,174 A 10/1989 Kobayashi
4,895,371 A 1/1990 Bushner
4,898,387 A 2/1990 Finney
4,927,144 A 5/1990 Stormon
4,928,972 A 5/1990 Nakanishi et al.
4,930,781 A * 6/1990 Allen ..... 473/346
4,991,850 A 2/1991 Wilhlem
5,004,242 A 4/1991 Iwanaga et al.
5,009,425 A 4/1991 Okumoto et al.
D318,703 S 7/1991 Shearer
5,028,049 A 7/1991 McKeighen
5,060,951 A * 10/1991 Allen ..... 473/346
5,067,715 A 11/1991 Schmidt et al.
5,076,585 A * 12/1991 Bouquet ..... 473/343
5,078,397 A 1/1992 Aizawa
5,080,366 A 1/1992 Okumoto et al.
D326,130 S 5/1992 Chorne
5,149,091 A 9/1992 Okumoto et al.
5,186,465 A 2/1993 Chorne
5,205,560 A 4/1993 Hoshi et al.
5,211,401 A 5/1993 Hainey
5,213,328 A 5/1993 Long et al.
5,221,088 A 6/1993 McTeigue et al.
5,228,694 A 7/1993 Okumoto et al.
5,253,869 A 10/1993 Dingle et al.
5,269,517 A 12/1993 Petruccelli et al.
5,282,625 A * 2/1994 Schmidt et al. ..... 473/350
5,290,036 A 3/1994 Fenton et al.
5,295,689 A 3/1994 Lundberg
5,301,941 A 4/1994 Allen
5,301,946 A * 4/1994 Schmidt et al. ..... 473/290
5,316,305 A 5/1994 McCabe
5,326,106 A 7/1994 Meyer
5,330,187 A * 7/1994 Schmidt et al. ..... 473/291
5,332,225 A 7/1994 Ura
D350,176 S 8/1994 Antonious
5,333,871 A 8/1994 Wishon
5,340,104 A 8/1994 Griffin
5,372,365 A 12/1994 McTeigue et al.
D354,103 S 1/1995 Allen
5,377,985 A 1/1995 Ohnishi
5,380,010 A 1/1995 Werner et al.
5,407,196 A 4/1995 Busnardo
5,411,263 A 5/1995 Schmidt et al.
5,413,337 A 5/1995 Goodman et al.
5,419,556 A 5/1995 Take
5,419,560 A 5/1995 Bamber
5,429,366 A 7/1995 McCabe
5,435,551 A 7/1995 Chen
5,437,456 A * 8/1995 Schmidt et al. ..... 473/291
5,447,307 A 9/1995 Antonious
5,451,056 A 9/1995 Manning
5,451,058 A 9/1995 Price et al.
D363,749 S 10/1995 Kenmi
5,464,211 A 11/1995 Atkins, Sr.
5,464,217 A 11/1995 Shenoha et al.
5,467,988 A 11/1995 Henwood
5,472,201 A * 12/1995 Aizawa et al. ..... 473/329
5,472,203 A * 12/1995 Schmidt et al. ..... 473/350
5,480,152 A 1/1996 Schmidt et al.
5,489,097 A 2/1996 Simmons
5,492,327 A * 2/1996 Biafore, Jr. ..... 473/332
5,497,995 A 3/1996 Swisshelm
5,505,453 A * 4/1996 Mack ..... 473/329
5,516,106 A 5/1996 Henwood
5,518,243 A 5/1996 Redman
D371,817 S 7/1996 Olsavsky et al.
D372,063 S 7/1996 Hueber
5,531,439 A 7/1996 Azzarella
5,533,725 A 7/1996 Reynolds, Jr.
5,533,728 A 7/1996 Pehoski et al.
5,547,427 A 8/1996 Rigal et al.
5,564,705 A 10/1996 Kobayashi et al.
D375,987 S 11/1996 Lin
5,570,886 A 11/1996 Rigal et al.
5,580,058 A 12/1996 Coughlin
5,586,947 A 12/1996 Hutin
5,586,948 A 12/1996 Mick

(56) References Cited

U.S. PATENT DOCUMENTS 5,595,552 A 1/1997 Wright et al.
5,601,498 A 2/1997 Antonious
5,603,668 A 2/1997 Antonious
5,607,365 A 3/1997 Wolf
5,616,088 A 4/1997 Aizawa et al.
5,616,832 A 4/1997 Nauck
5,626,528 A 5/1997 Toulon
5,626,530 A 5/1997 Schmidt et al.
D381,382 S 7/1997 Fenton, Jr.
5,669,829 A 9/1997 Lin
5,681,993 A 10/1997 Heitman
D386,550 S 11/1997 Wright et al.
D386,551 S 11/1997 Solheim et al.
D387,113 S 12/1997 Burrows
D387,405 S 12/1997 Solheim et al.
5,692,968 A 12/1997 Shine
5,692,972 A 12/1997 Langslet
5,695,409 A 12/1997 Jackson
5,709,613 A 1/1998 Sheraw
5,709,615 A 1/1998 Liang
5,711,722 A 1/1998 Miyajima et al.
5,718,641 A 2/1998 Lin
D392,007 S 3/1998 Fox
5,724,265 A 3/1998 Hutchings
5,728,006 A 3/1998 Teitell et al.
5,735,754 A 4/1998 Antonious
5,746,664 A 5/1998 Reynolds, Jr.
5,749,795 A * 5/1998 Schmidt et al. ..... 473/350
5,766,094 A * 6/1998 Mahaffey et al. ..... 473/342
5,772,525 A 6/1998 Klein
5,779,555 A 7/1998 Nomura et al.
5,785,609 A 7/1998 Sheets et al.
D397,387 S 8/1998 Allen
5,788,584 A 8/1998 Parente et al.
5,792,000 A 8/1998 Weber et al.
D398,687 S 9/1998 Miyajima et al.
D398,946 S 9/1998 Kenmi
5,803,830 A 9/1998 Austin et al.
D399,274 S 10/1998 Bradford
5,820,481 A 10/1998 Raudman
5,826,874 A 10/1998 Teitell et al.
D400,945 S 11/1998 Gilbert et al.
5,839,975 A 11/1998 Lundberg
5,863,261 A * 1/1999 Eggiman ..... 473/329
5,873,791 A 2/1999 Allen
5,888,148 A 3/1999 Allen
5,908,356 A 6/1999 Nagamoto
5,908,357 A 6/1999 Hsieh
5,941,782 A 8/1999 Cook
D414,234 S 9/1999 Darrah
5,947,841 A 9/1999 Silvestro
5,951,410 A 9/1999 Butler et al.
5,955,667 A 9/1999 Fyfe
5,971,868 A 10/1999 Kosmatka
5,997,415 A 12/1999 Wood
6,001,030 A 12/1999 Delaney
6,007,432 A 12/1999 Kosmatka
6,012,988 A 1/2000 Burke
6,015,354 A 1/2000 Ahn et al.
6,018,705 A 1/2000 Gaudet et al.
D422,041 S 3/2000 Bradford
6,042,486 A * 3/2000 Gallagher ..... 473/329
6,045,364 A 4/2000 Dugan et al.
6,048,278 A 4/2000 Meyer et al.
6,052,654 A 4/2000 Gaudet et al.
6,074,309 A * 6/2000 Mahaffey ..... 473/342
6,080,068 A 6/2000 Takeda
6,086,485 A 7/2000 Hamada et al.
6,095,931 A 8/2000 Hettinger et al.
6,117,022 A 9/2000 Crawford et al.
6,149,533 A 11/2000 Finn
6,149,534 A 11/2000 Peters et al.
6,159,109 A 12/2000 Langslet
6,176,791 B1 1/2001 Wright
6,193,614 B1 2/2001 Sasamoto et al.
6,196,932 B1 3/2001 Marsh et al.
6,203,449 B1 3/2001 Kenmi
6,217,461 B1 4/2001 Galy
6,224,493 B1 5/2001 Lee et al.
6,261,102 B1 7/2001 Dugan et al.
6,270,422 B1 8/2001 Fisher
6,270,423 B1 8/2001 Webb
6,299,546 B1 10/2001 Wang
6,299,553 B1 10/2001 Petuchowski et al.
6,302,807 B1 10/2001 Rohrer
6,319,149 B1 11/2001 Lee
6,319,150 B1 11/2001 Werner et al.
6,332,848 B1 12/2001 Long et al.
6,338,683 B1 * 1/2002 Kosmatka ..... 473/329
6,342,018 B1 * 1/2002 Mason ..... 473/252
6,344,000 B1 2/2002 Hamada et al.
6,344,001 B1 2/2002 Hamada et al.
6,348,013 B1 * 2/2002 Kosmatka ..... 473/329
6,354,956 B1 * 3/2002 Doong ..... 473/219
6,354,961 B1 3/2002 Allen
RE37,647 E 4/2002 Wolf
6,368,234 B1 4/2002 Galloway
6,386,987 B1 5/2002 Lejeune, Jr.
6,390,933 B1 5/2002 Galloway et al.
6,394,910 B1 5/2002 McCarthy
6,398,666 B1 6/2002 Evans et al.
6,402,634 B2 6/2002 Lee et al.
6,402,637 B1 6/2002 Sasamoto et al.
6,402,638 B1 6/2002 Kelley
6,413,167 B1 7/2002 Burke
6,422,951 B1 7/2002 Burrows
6,428,423 B1 8/2002 Merko
6,430,843 B1 8/2002 Potter et al.
6,431,990 B1 8/2002 Manwaring
6,435,982 B1 8/2002 Galloway et al.
6,441,745 B1 8/2002 Gates
6,443,857 B1 9/2002 Chuang
6,447,405 B1 9/2002 Chen
6,454,665 B2 9/2002 Antonious
6,471,603 B1 10/2002 Kosmatka
D465,251 S 11/2002 Wood et al.
6,475,100 B1 11/2002 Helmstetter et al.
6,478,690 B2 11/2002 Helmstetter et al.
6,482,107 B1 11/2002 Urbanski et al.
6,506,129 B2 1/2003 Chen
6,524,197 B2 2/2003 Boone
6,524,198 B2 2/2003 Takeda
6,533,679 B1 3/2003 McCabe et al.
6,551,199 B2 4/2003 Viera
6,558,271 B1 5/2003 Beach et al.
6,561,917 B2 5/2003 Manwaring
6,602,149 B1 8/2003 Jacobson
6,605,007 B1 * 8/2003 Bissonnette et al. ..... 473/329
6,607,450 B1 8/2003 Hackman
6,607,451 B2 * 8/2003 Kosmatka et al. ..... 473/329
6,616,547 B2 9/2003 Vincent et al.
6,634,956 B1 10/2003 Pegg
6,638,175 B2 10/2003 Lee et al.
D482,089 S 11/2003 Burrows
D482,090 S 11/2003 Burrows
D482,420 S 11/2003 Burrows
6,641,490 B2 11/2003 Ellemor
6,648,769 B2 11/2003 Lee et al.
6,652,390 B2 11/2003 Bradford
6,652,391 B1 11/2003 Kubica et al.
D484,208 S 12/2003 Burrows
6,663,503 B1 12/2003 Kenmi
6,669,577 B1 12/2003 Hocknell et al.
6,676,533 B1 1/2004 Hsien
6,688,989 B2 2/2004 Best
6,695,715 B1 2/2004 Chikaraishi
6,719,641 B2 4/2004 Dabbs et al.
6,719,645 B2 * 4/2004 Kouno ..... 473/345
6,739,983 B2 5/2004 Helmstetter et al.
6,743,112 B2 6/2004 Nelson
6,767,292 B1 7/2004 Skalla, Sr.
6,773,360 B2 8/2004 Willett et al.
6,780,123 B2 8/2004 Hasebe
6,800,037 B2 * 10/2004 Kosmatka ..... 473/329

(56) References Cited

U.S. PATENT DOCUMENTS 6,800,038 B2 10/2004 Willett et al.
6,800,039 B1 10/2004 Tseng
D498,508 S 11/2004 Antonious
6,811,496 B2 11/2004 Wahl et al.
6,821,209 B2 11/2004 Manwaring et al.
D501,036 S 1/2005 Burrows
6,840,872 B2 1/2005 Yoneyama
D502,232 S 2/2005 Antonious
6,863,620 B2 * 3/2005 Tucker, Sr. ..... 473/288
6,876,947 B1 4/2005 Darley et al.
6,878,071 B1 4/2005 Schwieger et al.
6,880,222 B2 * 4/2005 Matsunaga ..... A63B 53/0466 148/405
6,882,955 B1 4/2005 Ohlenbusch et al.
6,887,165 B2 5/2005 Tsurumaki
6,899,638 B2 5/2005 Iwata et al.
6,923,733 B2 8/2005 Chen
6,926,618 B2 8/2005 Sanchez et al.
6,929,558 B2 8/2005 Manwaring et al.
6,960,142 B2 11/2005 Bissonnette et al.
6,991,552 B2 1/2006 Burke
6,991,555 B2 1/2006 Reese
6,991,560 B2 1/2006 Tseng
D515,642 S 2/2006 Antonious
6,994,635 B2 2/2006 Poynor
7,018,303 B2 3/2006 Yamamoto
7,018,304 B2 3/2006 Bradford
7,025,692 B2 4/2006 Erickson et al.
7,041,003 B2 5/2006 Bissonnette et al.
7,041,014 B2 5/2006 Wright et al.
7,048,646 B2 5/2006 Yamanaka et al.
D523,498 S 6/2006 Chen et al.
7,056,229 B2 6/2006 Chen
7,066,835 B2 6/2006 Evans et al.
D524,392 S 7/2006 Madore et al.
7,070,513 B2 * 7/2006 Takeda et al. ..... 473/329
7,070,515 B1 7/2006 Liu
7,077,762 B2 7/2006 Kouno et al.
7,083,530 B2 8/2006 Wahl et al.
7,086,964 B2 8/2006 Chen et al.
7,090,590 B2 8/2006 Chen
7,121,956 B2 10/2006 Lo
7,125,340 B1 10/2006 Priester et al.
7,128,660 B2 10/2006 Gillig
7,128,663 B2 10/2006 Bamber
7,134,971 B2 11/2006 Franklin et al.
7,137,907 B2 11/2006 Gibbs et al.
7,140,975 B2 11/2006 Bissonnette et al.
7,140,977 B2 11/2006 Atkins, Sr.
7,147,569 B2 12/2006 Tang et al.
7,156,750 B2 1/2007 Nishitani et al.
7,160,200 B2 1/2007 Grober
7,163,468 B2 1/2007 Gibbs et al.
7,163,470 B2 1/2007 Galloway et al.
7,169,059 B2 1/2007 Rice et al.
7,175,541 B2 2/2007 Lo
7,186,185 B2 3/2007 Nagy
7,186,188 B2 3/2007 Gilbert et al.
7,192,364 B2 3/2007 Long
7,201,668 B1 4/2007 Pamias
7,207,898 B2 4/2007 Rice et al.
7,211,006 B2 * 5/2007 Chang ..... 473/329
7,226,366 B2 * 6/2007 Galloway ..... 473/342
7,241,230 B2 * 7/2007 Tsunoda ..... 473/324
7,244,189 B1 7/2007 Stobbe
7,247,104 B2 7/2007 Poynor
7,255,653 B2 8/2007 Saso
7,258,631 B2 8/2007 Galloway et al.
7,261,643 B2 8/2007 Rice et al.
D551,310 S 9/2007 Kuan et al.
7,264,554 B2 9/2007 Bentley
7,264,555 B2 9/2007 Lee et al.
D552,701 S 10/2007 Ruggiero et al.
7,278,926 B2 10/2007 Frame
7,294,064 B2 * 11/2007 Tsurumaki et al. ..... 473/329
7,297,071 B2 11/2007 Hyman
7,297,073 B2 11/2007 Jung
7,326,121 B2 2/2008 Roake
7,335,112 B1 2/2008 Bitondo
D566,214 S 4/2008 Evans et al.
7,351,157 B2 4/2008 Priester et al.
7,351,161 B2 4/2008 Beach
7,367,898 B2 * 5/2008 Hawkins et al. ..... 473/329
7,387,579 B2 * 6/2008 Lin et al. ..... 473/332
7,396,289 B2 7/2008 Soracco et al.
7,396,293 B2 7/2008 Soracco
7,396,296 B2 7/2008 Evans
7,407,443 B2 8/2008 Franklin et al.
7,431,660 B2 10/2008 Hasegawa
7,431,663 B2 10/2008 Pamias
7,435,189 B2 10/2008 Hirano
7,442,132 B2 10/2008 Nishio
7,445,563 B1 * 11/2008 Werner ..... 473/332
7,448,961 B2 * 11/2008 Lin ..... A63B 53/04 473/332
7,470,201 B2 12/2008 Nakahara et al.
7,473,186 B2 1/2009 Best et al.
7,476,161 B2 1/2009 Williams et al.
7,494,426 B2 2/2009 Nishio et al.
D588,223 S 3/2009 Kuan
7,500,924 B2 3/2009 Yokota
7,509,842 B2 3/2009 Kostuj
7,520,820 B2 4/2009 Dimarco
7,530,901 B2 5/2009 Imamoto et al.
7,540,810 B2 6/2009 Hettinger et al.
7,559,850 B2 7/2009 Gilbert et al.
7,563,176 B2 7/2009 Roberts et al.
7,572,193 B2 8/2009 Yokota
7,575,523 B2 8/2009 Yokota
7,575,524 B2 8/2009 Willett et al.
7,582,024 B2 * 9/2009 Shear ..... 473/329
7,602,301 B1 10/2009 Stirling et al.
7,618,331 B2 11/2009 Hirano
7,621,820 B2 11/2009 Clausen et al.
7,632,193 B2 12/2009 Thielen
7,641,568 B2 1/2010 Hoffman et al.
7,641,569 B2 1/2010 Best et al.
7,647,071 B2 1/2010 Rofougaran et al.
7,651,409 B1 1/2010 Mier
7,691,004 B1 4/2010 Lueders
7,713,138 B2 5/2010 Sato et al.
7,717,803 B2 5/2010 DiMarco
7,717,807 B2 5/2010 Evans et al.
7,722,478 B2 5/2010 Ebner
7,736,242 B2 6/2010 Stites et al.
D619,666 S 7/2010 DePaul
7,749,101 B2 7/2010 Imamoto et al.
7,753,809 B2 7/2010 Cackett et al.
7,758,452 B2 7/2010 Soracco
7,766,760 B2 8/2010 Priester et al.
7,771,263 B2 8/2010 Telford
7,771,285 B2 8/2010 Porter
7,771,290 B2 8/2010 Bezilla et al.
7,780,535 B2 8/2010 Hagood et al.
7,789,742 B1 9/2010 Murdock et al.
7,800,480 B1 9/2010 Joseph et al.
7,801,575 B1 9/2010 Balardeta et al.
7,803,066 B2 9/2010 Solheim et al.
7,804,404 B1 9/2010 Balardeta et al.
7,811,182 B2 10/2010 Ligotti, III et al.
7,821,407 B2 10/2010 Shears et al.
7,824,277 B2 11/2010 Bennett et al.
7,825,815 B2 11/2010 Shears et al.
7,831,212 B1 11/2010 Balardeta et al.
7,837,574 B2 11/2010 Brunner
7,837,575 B2 11/2010 Lee et al.
7,837,577 B2 11/2010 Evans
7,846,036 B2 12/2010 Tanaka
7,853,211 B1 12/2010 Balardeta et al.
7,857,705 B1 12/2010 Galloway
7,857,711 B2 * 12/2010 Shear ..... 473/329
7,867,105 B2 1/2011 Moon
7,871,336 B2 1/2011 Breier et al.
7,878,924 B2 2/2011 Clausen et al.

(56) References Cited

U.S. PATENT DOCUMENTS 7,883,428 B1 2/2011 Balardeta et al.
7,887,440 B2 2/2011 Wright et al.
7,892,102 B1 2/2011 Galloway
7,896,753 B2 3/2011 Boyd et al.
7,918,745 B2 4/2011 Morris et al.
7,922,596 B2 4/2011 Vanderbilt et al.
7,922,603 B2 4/2011 Boyd et al.
7,927,231 B2 4/2011 Sato et al.
7,931,545 B2 4/2011 Soracco et al.
7,934,998 B2 5/2011 Yokota
7,935,003 B2 5/2011 Matsunaga et al.
7,938,739 B2 5/2011 Cole et al.
7,941,097 B1 5/2011 Balardeta et al.
7,946,926 B1 5/2011 Balardeta et al.
7,957,767 B2 6/2011 Rofougaran
7,959,519 B2 6/2011 Zielke et al.
7,959,523 B2 6/2011 Rae et al.
7,967,699 B2 6/2011 Soracco
7,978,081 B2 7/2011 Shears et al.
7,988,565 B2 8/2011 Abe
7,993,211 B2 8/2011 Bardha
7,993,213 B1 8/2011 D'Eath
7,997,999 B2 8/2011 Roach et al.
8,007,371 B2 8/2011 Breier et al.
8,012,041 B2 9/2011 Gibbs et al.
8,016,694 B2 9/2011 Llewellyn et al.
8,025,586 B2 9/2011 Teramoto
8,043,166 B2 10/2011 Cackett et al.
8,052,539 B2 11/2011 Kimber
8,070,622 B2 12/2011 Schmidt
8,074,495 B2 12/2011 Kostuj
8,092,316 B2 1/2012 Breier et al.
8,100,779 B2 1/2012 Solheim et al.
8,105,175 B2 1/2012 Breier et al.
8,117,903 B2 2/2012 Golden et al.
D659,781 S 5/2012 Oldknow
8,172,697 B2 * 5/2012 Cackett et al. ..... 473/329
8,177,661 B2 5/2012 Beach et al.
8,177,664 B2 5/2012 Horii et al.
8,182,364 B2 5/2012 Cole et al.
8,187,116 B2 * 5/2012 Boyd et al. ..... 473/329
8,206,241 B2 6/2012 Boyd et al.
D665,472 S 8/2012 McDonnell et al.
8,235,841 B2 * 8/2012 Stites et al. ..... 473/328
8,235,844 B2 * 8/2012 Albertsen et al. ..... 473/345
8,241,143 B2 * 8/2012 Albertsen et al. ..... 473/345
8,241,144 B2 * 8/2012 Albertsen et al. ..... 473/345
8,251,834 B2 * 8/2012 Curtis et al. ..... 473/329
8,251,836 B2 8/2012 Brandt
8,257,195 B1 * 9/2012 Erickson ..... 473/329
8,257,196 B1 9/2012 Abbott et al.
8,272,974 B2 9/2012 Mickelson et al.
8,277,337 B2 10/2012 Shimazaki
8,282,506 B1 10/2012 Holt
8,303,434 B1 11/2012 DePaul
8,308,583 B2 11/2012 Morris et al.
8,328,659 B2 * 12/2012 Shear ..... 473/329
8,337,319 B2 12/2012 Sargent et al.
8,337,325 B2 12/2012 Boyd et al.
8,353,782 B1 1/2013 Beach et al.
8,353,786 B2 * 1/2013 Beach et al. ..... 473/345
8,360,900 B2 1/2013 Snyder
D675,691 S 2/2013 Oldknow et al.
D675,692 S 2/2013 Oldknow et al.
D676,512 S 2/2013 Oldknow et al.
D676,909 S 2/2013 Oldknow et al.
D676,913 S 2/2013 Oldknow et al.
D676,914 S 2/2013 Oldknow et al.
D676,915 S 2/2013 Oldknow et al.
8,382,604 B2 2/2013 Billings
D677,353 S 3/2013 Oldknow et al.
D678,913 S 3/2013 Chu
D678,964 S 3/2013 Oldknow et al.
D678,965 S 3/2013 Oldknow et al.
D678,968 S 3/2013 Oldknow et al.
D678,969 S 3/2013 Oldknow et al.
D678,970 S 3/2013 Oldknow et al.
D678,971 S 3/2013 Oldknow et al.
D678,972 S 3/2013 Oldknow et al.
D678,973 S 3/2013 Oldknow et al.
8,403,771 B1 * 3/2013 Rice et al. ..... 473/328
D679,354 S 4/2013 Oldknow et al.
8,430,763 B2 4/2013 Beach et al.
8,430,764 B2 4/2013 Bennett et al.
8,435,134 B2 * 5/2013 Tang et al. ..... 473/329
8,435,135 B2 5/2013 Stites et al.
D684,230 S 6/2013 Roberts et al.
8,491,416 B1 7/2013 Demille et al.
8,517,855 B2 8/2013 Beach et al.
8,517,860 B2 * 8/2013 Albertsen et al. ..... 473/329
8,562,453 B2 10/2013 Sato
8,579,728 B2 * 11/2013 Morales et al. ..... 473/349
8,591,351 B2 * 11/2013 Albertsen et al. ..... 473/329
8,591,352 B2 11/2013 Hirano
8,591,353 B1 * 11/2013 Honea et al. ..... 473/345
8,608,587 B2 12/2013 Henrikson et al.
D697,152 S * 1/2014 Harbert et al. ..... D21/752
8,628,433 B2 1/2014 Stites et al.
8,632,419 B2 * 1/2014 Tang et al. ..... 473/329
8,641,555 B2 * 2/2014 Stites et al. ..... 473/328
8,663,027 B2 * 3/2014 Morales et al. ..... 473/329
8,690,704 B2 4/2014 Thomas
8,696,491 B1 4/2014 Myers
8,702,531 B2 4/2014 Boyd et al.
8,734,265 B2 5/2014 Soracco
D707,768 S 6/2014 Oldknow et al.
D707,769 S 6/2014 Oldknow et al.
D707,773 S 6/2014 Oldknow et al.
8,758,153 B2 6/2014 Sargent et al.
D708,281 S 7/2014 Oldknow et al.
D709,575 S 7/2014 Oldknow et al.
8,821,312 B2 9/2014 Burnett et al.
8,827,831 B2 9/2014 Burnett et al.
8,827,836 B2 9/2014 Thomas
8,834,289 B2 9/2014 de la Cruz et al.
8,834,290 B2 9/2014 Bezilla et al.
8,845,454 B2 9/2014 Boyd et al.
D714,893 S 10/2014 Atwell
8,858,360 B2 10/2014 Rice et al.
8,870,679 B2 10/2014 Oldknow
8,888,607 B2 11/2014 Harbert et al.
D722,122 S 2/2015 Greensmith
D725,729 S 3/2015 Song
8,986,133 B2 3/2015 Bennett et al.
D726,847 S 4/2015 Song
9,694,255 B2 7/2017 Oldknow et al.
2001/0005695 A1 6/2001 Lee et al.
2001/0053720 A1 12/2001 Lee et al.
2002/0019265 A1 * 2/2002 Allen ..... 473/329
2002/0052246 A1 5/2002 Burke
2002/0077189 A1 6/2002 Tuer et al.
2002/0107085 A1 8/2002 Lee et al.
2002/0123386 A1 9/2002 Perlmutter
2002/0137576 A1 9/2002 Dammen
2002/0160848 A1 10/2002 Burke
2002/0173364 A1 11/2002 Boscha
2002/0173365 A1 11/2002 Boscha
2002/0183134 A1 * 12/2002 Allen et al. ..... 473/329
2002/0189356 A1 12/2002 Bissonnette et al.
2003/0009913 A1 1/2003 Potter et al.
2003/0013545 A1 1/2003 Vincent et al.
2003/0040380 A1 2/2003 Wright et al.
2003/0045371 A1 3/2003 Wood et al.
2003/0054900 A1 3/2003 Tindale
2003/0087710 A1 5/2003 Sheets et al.
2003/0190975 A1 10/2003 Fagot
2003/0207718 A1 11/2003 Perlmutter
2003/0220154 A1 * 11/2003 Anelli ..... 473/327
2004/0009829 A1 1/2004 Kapilow
2004/0018890 A1 1/2004 Stites et al.
2004/0023729 A1 2/2004 Nagai et al.
2004/0106460 A1 6/2004 Lee et al.
2004/0121852 A1 * 6/2004 Tsurumaki ..... 473/344
2004/0177531 A1 9/2004 DiBenedetto et al.

(56) References Cited

U.S. PATENT DOCUMENTS

2004/0180730 A1 9/2004 Franklin et al.
2004/0192463 A1 9/2004 Tsurumaki et al.
2004/0204257 A1 10/2004 Boscha et al.
2004/0219991 A1 11/2004 Suprock et al.
2004/0259651 A1 12/2004 Storek
2005/0009630 A1* 1/2005 Chao et al. ..... 473/342
2005/0032582 A1 2/2005 Mahajan et al.
2005/0032586 A1 2/2005 Willett et al.
2005/0037862 A1 2/2005 Hagood et al.
2005/0049075 A1 3/2005 Chen et al.
2005/0054457 A1 3/2005 Eyestone et al.
2005/0070371 A1 3/2005 Chen et al.
2005/0079922 A1 4/2005 Priester et al.
2005/0096151 A1 5/2005 Hou et al.
2005/0101407 A1 5/2005 Hirano
2000/0124435 6/2005 Gambetta et al.
2005/0119068 A1 6/2005 Onoda et al.
2005/0119070 A1 6/2005 Kumamoto
2005/0124435 A1 6/2005 Gambetta et al.
2005/0137024 A1 6/2005 Stites et al.
2005/0192118 A1 9/2005 Rice et al.
2005/0215340 A1 9/2005 Stites et al.
2005/0215350 A1 9/2005 Reyes et al.
2005/0227775 A1 10/2005 Cassady et al.
2005/0227780 A1 10/2005 Cover et al.
2005/0227781 A1 10/2005 Huang et al.
2005/0261073 A1 11/2005 Farrington et al.
2005/0266933 A1 12/2005 Galloway
2005/0288119 A1 12/2005 Wang et al.
2006/0000528 A1 1/2006 Galloway
2006/0019770 A1 1/2006 Meyer et al.
2006/0025229 A1 2/2006 Mahajan et al.
2006/0029916 A1 2/2006 Boscha
2006/0035718 A1 2/2006 Soracco et al.
2006/0040765 A1 2/2006 Sano
2006/0046868 A1 3/2006 Murphy
2006/0052173 A1 3/2006 Telford
2006/0063600 A1 3/2006 Grober
2006/0068932 A1 3/2006 Rice et al.
2006/0073908 A1 4/2006 Tavares et al.
2006/0073910 A1 4/2006 Imamoto et al.
2006/0079349 A1 4/2006 Rae et al.
2006/0084516 A1 4/2006 Eyestone et al.
2006/0084525 A1 4/2006 Imamoto et al.
2006/0090549 A1 5/2006 Kostuj
2006/0094520 A1 5/2006 Kostuj
2006/0094524 A1 5/2006 Kostuj
2006/0094531 A1 5/2006 Bissonnette et al.
2006/0105849 A1 5/2006 Brunner
2006/0105857 A1 5/2006 Stark
2006/0111201 A1 5/2006 Nishio et al.
2006/0122004 A1 6/2006 Chen et al.
2006/0166737 A1 7/2006 Bentley
2006/0166738 A1 7/2006 Eyestone et al.
2006/0184336 A1 8/2006 Kolen
2006/0194644 A1 8/2006 Nishio
2006/0276256 A1 12/2006 Storek
2006/0281582 A1 12/2006 Sugimoto
2006/0287118 A1 12/2006 Wright et al.
2007/0010341 A1 1/2007 Miettinen et al.
2007/0015601 A1 1/2007 Tsunoda et al.
2007/0021234 A1 1/2007 Tsurumaki et al.
2007/0026961 A1 2/2007 Hou
2007/0049400 A1 3/2007 Imamoto et al.
2007/0049407 A1 3/2007 Tateno et al.
2007/0049417 A1 3/2007 Shear
2007/0111811 A1 5/2007 Grober
2007/0117648 A1 5/2007 Yokota
2007/0149309 A1 6/2007 Ford
2007/0155538 A1 7/2007 Rice et al.
2007/0225085 A1 9/2007 Koide et al.
2007/0238538 A1 10/2007 Priester
2007/0238551 A1 10/2007 Yokota
2007/0270214 A1 11/2007 Bentley
2008/0015047 A1 1/2008 Rice et al.
2008/0032817 A1 2/2008 Lo
2008/0039228 A1 2/2008 Breier et al.
2008/0051208 A1 2/2008 Lee et al.
2008/0064523 A1 3/2008 Chen
2008/0076580 A1 3/2008 Murdock et al.
2008/0076595 A1 3/2008 Lai et al.
2008/0085778 A1 4/2008 Dugan
2008/0125239 A1 5/2008 Clausen et al.
2008/0125244 A1 5/2008 Meyer et al.
2008/0125246 A1 5/2008 Matsunaga
2008/0139339 A1 6/2008 Cheng
2008/0146370 A1 6/2008 Beach et al.
2008/0171610 A1 7/2008 Shin
2008/0182682 A1 7/2008 Rice et al.
2008/0188310 A1 8/2008 Murdock
2008/0200275 A1 8/2008 Wagen et al.
2008/0242354 A1 10/2008 Rofougaran
2008/0248896 A1 10/2008 Hirano
2008/0287205 A1 11/2008 Katayama
2009/0018795 A1 1/2009 Priester et al.
2009/0062032 A1 3/2009 Boyd et al.
2009/0075751 A1 3/2009 Gilbert et al.
2009/0098949 A1 4/2009 Chen
2009/0111602 A1 4/2009 Savarese et al.
2009/0120197 A1 5/2009 Golden et al.
2009/0124410 A1 5/2009 Rife
2009/0131190 A1 5/2009 Kimber
2009/0131191 A1 5/2009 Priester et al.
2009/0163285 A1 6/2009 Kwon et al.
2009/0163294 A1 6/2009 Cackett et al.
2009/0165530 A1 7/2009 Golden et al.
2009/0165531 A1 7/2009 Golden et al.
2009/0186717 A1 7/2009 Stites et al.
2009/0203460 A1 8/2009 Clark
2009/0209358 A1 8/2009 Niegowski
2009/0221380 A1 9/2009 Breier et al.
2009/0221381 A1 9/2009 Breier et al.
2009/0247312 A1 10/2009 Sato et al.
2009/0254204 A1 10/2009 Kostuj
2009/0264214 A1 10/2009 De La Cruz et al.
2009/0286611 A1 11/2009 Beach et al.
2009/0318245 A1 12/2009 Yim et al.
2009/9318245 12/2009 Yim et al.
2010/0016095 A1 1/2010 Burnett et al.
2010/0029402 A1 2/2010 Noble et al.
2010/0035701 A1 2/2010 Kusumoto
2010/0048314 A1 2/2010 Hsu et al.
2010/0048324 A1 2/2010 Wada et al.
2010/0049468 A1 2/2010 Papadourakis
2010/0056298 A1 3/2010 Jertson et al.
2010/0067566 A1 3/2010 Rofougaran et al.
2010/0069171 A1 3/2010 Clausen et al.
2010/0093457 A1 4/2010 Ahern et al.
2010/0093458 A1 4/2010 Davenport et al.
2010/0093463 A1 4/2010 Davenport et al.
2010/0099509 A1 4/2010 Ahem et al.
2010/0113174 A1 5/2010 Ahern
2010/0113176 A1 5/2010 Boyd et al.
2010/0113183 A1 5/2010 Soracco
2010/0113184 A1 5/2010 Kuan et al.
2010/0117837 A1 5/2010 Stirling et al.
2010/0121227 A1 5/2010 Stirling et al.
2010/0121228 A1 5/2010 Stirling et al.
2010/0130298 A1 5/2010 Dugan et al.
2010/0144455 A1 6/2010 Ahern
2010/0144456 A1 6/2010 Ahern
2010/0190573 A1 7/2010 Boyd
2010/0197423 A1 8/2010 Thomas et al.
2010/0197426 A1 8/2010 De La Cruz et al.
2010/0201512 A1 8/2010 Stirling et al.
2010/0210371 A1 8/2010 Sato et al.
2010/0216563 A1 8/2010 Stites et al.
2010/0216564 A1 8/2010 Stites et al.
2010/0216565 A1 8/2010 Stites et al.
2010/0222152 A1 9/2010 Jaekel et al.
2010/0234127 A1 9/2010 Snyder et al.
2010/0255922 A1 10/2010 Lueders
2010/0261546 A1 10/2010 Nicodem
2010/0273569 A1 10/2010 Soracco

(56) References Cited

U.S. PATENT DOCUMENTS

| | | | | |
|---|---|---|---|---|
| 2010/0292024 | A1 | 11/2010 | Hagood et al. | |
| 2010/0304877 | A1 | 12/2010 | Iwahashi et al. | |
| 2010/0304887 | A1 | 12/2010 | Bennett et al. | |
| 2011/0021284 | A1* | 1/2011 | Stites et al. | 473/329 |
| 2011/0028230 | A1 | 2/2011 | Balardeta et al. | |
| 2011/0081978 | A1 | 4/2011 | Murdock et al. | |
| 2011/0082571 | A1 | 4/2011 | Murdock et al. | |
| 2011/0087344 | A1 | 4/2011 | Murdock et al. | |
| 2011/0092260 | A1 | 4/2011 | Murdock et al. | |
| 2011/0092310 | A1 | 4/2011 | Breier et al. | |
| 2011/0098127 | A1 | 4/2011 | Yamamoto | |
| 2011/0098128 | A1 | 4/2011 | Clausen et al. | |
| 2011/0118051 | A1 | 5/2011 | Thomas | |
| 2011/0130223 | A1 | 6/2011 | Murdock et al. | |
| 2011/0151977 | A1 | 6/2011 | Murdock et al. | |
| 2011/0152001 | A1 | 6/2011 | Hirano | |
| 2011/0195798 | A1 | 8/2011 | Sander et al. | |
| 2011/0212757 | A1 | 9/2011 | Murdock et al. | |
| 2011/0218053 | A1* | 9/2011 | Tang et al. | 473/349 |
| 2011/0224011 | A1 | 9/2011 | Denton et al. | |
| 2011/0224025 | A1 | 9/2011 | Balardeta et al. | |
| 2011/0256951 | A1 | 10/2011 | Soracco et al. | |
| 2011/0256954 | A1 | 10/2011 | Soracco | |
| 2011/0281621 | A1 | 11/2011 | Murdock et al. | |
| 2011/0294599 | A1* | 12/2011 | Albertsen et al. | 473/349 |
| 2011/0312437 | A1 | 12/2011 | Sargent et al. | |
| 2012/0077615 | A1 | 3/2012 | Schmidt | |
| 2012/0083362 | A1* | 4/2012 | Albertsen et al. | 473/345 |
| 2012/0083363 | A1* | 4/2012 | Albertsen et al. | 473/346 |
| 2012/0122601 | A1 | 5/2012 | Beach et al. | |
| 2012/0135821 | A1 | 5/2012 | Boyd et al. | |
| 2012/0142447 | A1* | 6/2012 | Boyd et al. | 473/329 |
| 2012/0142452 | A1* | 6/2012 | Burnett et al. | 473/345 |
| 2012/0184393 | A1 | 7/2012 | Franklin | |
| 2012/0196701 | A1* | 8/2012 | Stites et al. | 473/345 |
| 2012/0196703 | A1 | 8/2012 | Sander | |
| 2012/0202615 | A1 | 8/2012 | Beach et al. | |
| 2012/0225731 | A1 | 9/2012 | Suwa et al. | |
| 2012/0302366 | A1 | 11/2012 | Murphy | |
| 2013/0017901 | A1 | 1/2013 | Sargent et al. | |
| 2013/0065705 | A1 | 3/2013 | Morales et al. | |
| 2013/0102410 | A1 | 4/2013 | Stites et al. | |
| 2014/0018184 | A1 | 1/2014 | Bezilla et al. | |
| 2014/0080629 | A1 | 3/2014 | Sargent et al. | |
| 2014/0256461 | A1 | 9/2014 | Beach et al. | |
| 2015/0038261 | A1 | 2/2015 | Stites et al. | |
| 2015/0231453 | A1 | 8/2015 | Harbert et al. | |
| 2015/0258395 | A1 | 9/2015 | Oldknow et al. | |
| 2016/0151685 | A1 | 6/2016 | Larson et al. | |
| 2016/0151686 | A1 | 6/2016 | Larson et al. | |
| 2016/0151687 | A1 | 6/2016 | Larson et al. | |

FOREIGN PATENT DOCUMENTS

| | | | | | |
|---|---|---|---|---|---|
| CN | 2431912 | Y | | 5/2001 | |
| CN | 1602981 | A | | 4/2005 | |
| CN | 1984698 | A | | 6/2007 | |
| EP | 2377586 | A2 | | 10/2011 | |
| FR | 2672226 | A1 | | 8/1992 | |
| FR | 2717701 | A1 | | 9/1995 | |
| FR | 2717702 | A1 | | 9/1995 | |
| GB | 2280380 | A | | 2/1995 | |
| GB | 2388792 | A | | 11/2003 | |
| GB | 2422554 | A | | 8/2006 | |
| JP | S5163452 | U | | 5/1976 | |
| JP | H05317465 | A | | 12/1993 | |
| JP | H06237 | | | 1/1994 | |
| JP | 06114127 | A | * | 4/1994 | A63B 53/04 |
| JP | H06114127 | A | | 4/1994 | |
| JP | H0639036 | U | | 5/1994 | |
| JP | H06190088 | A | | 7/1994 | |
| JP | H07255886 | A | | 10/1995 | |
| JP | H07275407 | A | | 10/1995 | |
| JP | H07284546 | A | | 10/1995 | |
| JP | H08000785 | | | 1/1996 | |
| JP | H08131599 | A | | 5/1996 | |
| JP | 08141117 | A | * | 6/1996 | A63B 53/04 |
| JP | H08141117 | A | | 6/1996 | |
| JP | H0947528 | A | | 2/1997 | |
| JP | H9-135932 | | | 5/1997 | |
| JP | H8-243195 | | | 7/1997 | |
| JP | H09-173510 | A | | 7/1997 | |
| JP | H9-239074 | | | 9/1997 | |
| JP | H9-239075 | | | 9/1997 | |
| JP | H09276455 | A | | 10/1997 | |
| JP | H9-299521 | | | 11/1997 | |
| JP | H10277180 | A | | 10/1998 | |
| JP | H10305119 | A | | 11/1998 | |
| JP | H1157082 | A | | 3/1999 | |
| JP | H11169493 | A | | 6/1999 | |
| JP | H11244431 | A | | 9/1999 | |
| JP | 2980002 | B2 | | 11/1999 | |
| JP | 11299938 | | | 11/1999 | |
| JP | 11299938 | A | * | 11/1999 | A63B 53/04 |
| JP | 2000-126340 | A | | 5/2000 | |
| JP | 2000126340 | A | | 5/2000 | |
| JP | 11114102 | | | 6/2000 | |
| JP | 200176056 | | | 6/2000 | |
| JP | 2000176056 | A | | 6/2000 | |
| JP | 2000197718 | | | 7/2000 | |
| JP | 2000197718 | A | * | 7/2000 | A63B 53/04 |
| JP | 2000271253 | A | | 10/2000 | |
| JP | 2001009069 | | | 1/2001 | |
| JP | 2001054596 | A | | 2/2001 | |
| JP | 2001058015 | | | 3/2001 | |
| JP | 2001058015 | A | * | 3/2001 | A63B 53/04 |
| JP | 2001062004 | | | 3/2001 | |
| JP | 2001062004 | A | * | 3/2001 | A63B 53/04 |
| JP | 2001137396 | | | 5/2001 | |
| JP | 2001137396 | A | * | 5/2001 | A63B 53/04 |
| JP | 2001145712 | | | 5/2001 | |
| JP | 2001145712 | A | * | 5/2001 | A63B 53/04 |
| JP | 2001-293113 | A | | 10/2001 | |
| JP | 3216041 | B2 | | 10/2001 | |
| JP | 2001293113 | A | | 10/2001 | |
| JP | 2001309999 | A | | 11/2001 | |
| JP | 2002017908 | A | | 1/2002 | |
| JP | 2002017912 | A | | 1/2002 | |
| JP | 2002052099 | A | * | 2/2002 | A63B 53/04 |
| JP | 2002-165905 | A | | 6/2002 | |
| JP | 2002-177416 | A | | 6/2002 | |
| JP | 2002165905 | A | | 6/2002 | |
| JP | 2002177416 | A | | 6/2002 | |
| JP | 2002239040 | A | * | 8/2002 | A63B 53/04 |
| JP | 2002248183 | A | | 9/2002 | |
| JP | 2002306646 | | | 10/2002 | |
| JP | 2002306646 | A | * | 10/2002 | A63B 53/04 |
| JP | 2002306647 | A | | 10/2002 | |
| JP | 2002320692 | | | 11/2002 | |
| JP | 2002320692 | A | | 11/2002 | |
| JP | 2002360748 | A | | 12/2002 | |
| JP | 2003000774 | | | 1/2003 | |
| JP | 2003000774 | A | * | 1/2003 | A63B 53/04 |
| JP | 2003079769 | | | 3/2003 | |
| JP | 2003079769 | A | * | 3/2003 | A63B 53/04 |
| JP | 2003093554 | | | 4/2003 | |
| JP | 2003093554 | A | * | 4/2003 | A63B 53/04 |
| JP | 2003180887 | A | | 7/2003 | |
| JP | 2003210627 | | | 7/2003 | |
| JP | 2003210627 | A | * | 7/2003 | A63B 53/04 |
| JP | 2004174224 | A | * | 6/2004 | A63B 53/04 |
| JP | 2004216131 | A | | 8/2004 | |
| JP | 2004313762 | | | 11/2004 | |
| JP | 2004313762 | A | * | 11/2004 | A63B 53/04 |
| JP | 2004329544 | | | 11/2004 | |
| JP | 2004329544 | A | * | 11/2004 | A63B 53/04 |
| JP | 2004351054 | A | | 12/2004 | |
| JP | 2004351173 | A | * | 12/2004 | A63B 53/04 |
| JP | 2005013529 | A | | 1/2005 | |
| JP | 2005073736 | A | | 3/2005 | |
| JP | 2005131280 | A | | 5/2005 | |
| JP | 2005137940 | A | | 6/2005 | |
| JP | 2005193069 | | | 7/2005 | |
| JP | 2005193069 | A | * | 7/2005 | A63B 53/04 |

(56) References Cited

FOREIGN PATENT DOCUMENTS

| | | | | |
|---|---|---|---|---|
| JP | 2005-253973 | A | | 9/2005 |
| JP | 2005253973 | A | | 9/2005 |
| JP | 2005305178 | A | | 11/2005 |
| JP | 2006000435 | A | | 1/2006 |
| JP | 2006020817 | A | | 1/2006 |
| JP | 2006094965 | A | | 4/2006 |
| JP | 2006-175135 | A | | 7/2006 |
| JP | 2006198251 | A | | 8/2006 |
| JP | 2006223701 | A | | 8/2006 |
| JP | 2007209722 | A | | 8/2007 |
| JP | 2007244480 | A | | 9/2007 |
| JP | 2007530151 | A | | 11/2007 |
| JP | 2007534438 | A | | 11/2007 |
| JP | 2008-036050 | A | | 2/2008 |
| JP | 2008036315 | A | | 2/2008 |
| JP | 2008-515560 | A | | 5/2008 |
| JP | 2008515560 | A | | 5/2008 |
| JP | 2008173293 | A | | 7/2008 |
| JP | 2008-237689 | A | | 10/2008 |
| JP | 2008237689 | A | | 10/2008 |
| JP | 2008289866 | A | | 12/2008 |
| JP | 2009201744 | A | | 9/2009 |
| JP | 2009534546 | A | | 9/2009 |
| JP | 2010035915 | A | | 2/2010 |
| JP | 2010148652 | A | | 7/2010 |
| JP | 2010148653 | A | | 7/2010 |
| JP | 2010154875 | | | 7/2010 |
| JP | 2010154875 | A | * | 7/2010 |
| JP | 2010154887 | A | | 7/2010 |
| JP | 2010279847 | A | | 12/2010 |
| JP | 2011024999 | A | | 2/2011 |
| JP | 2011206535 | A | | 10/2011 |
| WO | 99/20358 | | | 4/1999 |
| WO | 9920358 | A1 | | 4/1999 |
| WO | 01/49376 | | | 7/2001 |
| WO | 0149376 | A1 | | 7/2001 |
| WO | 0215993 | A1 | | 2/2002 |
| WO | 2004056425 | A2 | | 7/2004 |
| WO | 200505842 | A1 | | 1/2005 |
| WO | 2005035073 | A1 | | 4/2005 |
| WO | 2005058427 | A2 | | 6/2005 |
| WO | 2005079933 | A1 | | 9/2005 |
| WO | 2005094953 | A2 | | 10/2005 |
| WO | 2005118086 | A1 | | 12/2005 |
| WO | 2006073930 | A2 | | 7/2006 |
| WO | 2007123970 | A2 | | 11/2007 |
| WO | 2008093710 | A1 | | 8/2008 |
| WO | 2008157691 | A2 | | 12/2008 |
| WO | 2009035345 | A1 | | 3/2009 |
| WO | 2009091636 | A1 | | 7/2009 |
| WO | 2010090814 | A1 | | 8/2010 |
| WO | 2011153067 | A1 | | 12/2011 |
| WO | 2012027726 | A2 | | 3/2012 |
| WO | 2012149385 | A1 | | 11/2012 |

OTHER PUBLICATIONS

International Search Report and Written Opinion recevied in corresponding PCT Application No. PCT/US2010/021355 dated Jul. 7, 2010.

Invitation to Pay Additional Fees and Partial Search Report received in corresponding PCT Application No. PCT/US2010/021355 dated Apr. 12, 2010.

International Search Report and Written Opinion dated Sep. 9, 2011 in corresponding PCT Application No. PCT/US2011/023678.

International Search Report in related International Application No. PCT/US12/35476; dated Aug. 24, 2012.

IPRP dated Aug. 8, 2013 from PCT Application No. PCT/US2012/022027.

ISR and Written Opinion from PCT Application PCT/US2012/022027 dated May 30, 2012.

International Search Report and Written Opinion from PCT Application No. PCT/US2010/043073, dated Nov. 26, 2010.

"Photographs 1, 2 and 3", presented in parent U.S. Appl. No. 12/842,650, of unknown source, taken after the filing date of the parent application, depicting a golf club product; presented to the Patent Office for consideration on Oct. 7, 2011.

International Search Report & Written Opinion from PCT Application No. PCT/US2009/064164 dated Nov. 5, 2010.

ISR & WO for PCT Application No. PCT/US2013/043641 dated Mar. 20, 2014.

Invitation to Pay Additional Fees and Annex to Partial Search Report for PCT Application No. PCT/US2013/043641 dated Nov. 6, 2013.

Aug. 24, 2012—(WO) International Search Report and Written Opinion—App. PCT/US12/35476.

Dec. 18, 2012—(WO) International Search Report and Written Opinion App. No. PCT/US2012/057490.

Aug. 8, 2013—(WO) International Preliminary Report on Patentability App. No. PCT/US2012/022027.

May 30, 2012—(WO) International Search Report and Written Opinion App. No. PCT/US2012/022027.

Nov. 26, 2010—(WO) International Search Report and Written Opinion App. No. PCT/US2010/043073.

"Photographs 1, 2 and 3", presented in U.S. Appl. No. 12/842,650, of unknown source, taken after the filing date of the U.S. Appl. No. 12/842,650, depicting a golf club product; presented to the Patent Office for consideration on Oct. 7, 2011.

Nov. 5, 2010—(WO) International Search Report & Written Opinion, App. No. PCT/US2009/064164.

Mar. 20, 2014—(WO) International Search Report and Written Opinion App. No. PCT/US2013/043641.

Nov. 6, 2013—(WO) Partial Search Report, App.No. PCT/US2013/043641.

United States Golf Association; Procedure for Measuring the Flexibility of a Golf Clubhead, USGA-TPX3004; Revision 1.0.0; May 1, 2008; p. 1-11.

Apr. 12, 2010—(WO) Partial Search Report App. No. PCT/US2010/021355.

Sep. 9, 2011—(WO) International Search Report and Written Opinion, App. No. PCT/US2011/023678.

Jul. 7, 2010—(WO) International Search Report and Written Opinion, App. PCT/US2010/021355.

* cited by examiner

GOLF CLUB HEADS OR OTHER BALL STRIKING DEVICES HAVING DISTRIBUTED IMPACT RESPONSE

CROSS-REFERENCE TO RELATED APPLICATIONS

This application claims priority to and the benefit of U.S. Provisional Application No. 61/418,240, filed Nov. 30, 2010, and U.S. Provisional Application No. 61/541,767, filed Sep. 30, 2011, both of which prior applications are incorporated herein in their entireties and made part hereof.

TECHNICAL FIELD

The invention relates generally to ball striking devices, such as golf clubs and heads. Certain aspects of this invention relate to golf clubs and golf club heads having a face that has an impact response that is distributed between the face and the body of the head.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. The distance and direction of ball flight can also be significantly affected by the spin imparted to the ball by the impact with the club head. Various golf club heads have been designed to improve a golfer's accuracy by assisting the golfer in squaring the club head face at impact with a golf ball.

The flexing behavior of the ball striking face and/or other portions of the head during impact can influence the energy and velocity transferred to the ball, the direction of ball flight after impact, and the spin imparted to the ball, among other factors. The flexing or deformation behavior of the ball itself during impact can also influence some or all of these factors. The energy or velocity transferred to the ball by a golf club also may be related, at least in part, to the flexibility of the club face at the point of contact, and can be expressed using a measurement called "coefficient of restitution" (or "COR"). The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at the center of the face. In one example, the area of highest response may have a COR that is equal to the prevailing limit (e.g., currently 0.83) set by the United States Golf Association (USGA), which may change over time. However, because golf clubs are typically designed to contact the ball at or around the center of the face, off-center hits may result in less energy being transferred to the ball, decreasing the distance of the shot. In existing club head designs, the face is somewhat flexible and typically acts in a trampoline-like manner during impact with the ball, deforming inward upon impact and transferring energy to the ball as the face returns to its original shape. In this configuration, the face typically has the area of highest response (as described above) at or near the center of the face, which produces the greatest energy transfer and highest COR of the face. Typically, the "trampoline" action is maximized at the area of highest response, or in other words, the amplitude of the face deformation is typically highest there. Accordingly, club head features that can increase the energy transferred to a ball during impact, without exceeding applicable COR limit, can be advantageous.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face having a ball striking surface configured for striking a ball and a body connected to the face and extending rearwardly from the face. The body has an impact-influencing structure positioned adjacent at least one peripheral edge of the face, wherein at least a portion of a force generated by impact with a ball is absorbed by the impact-influencing structure, and at least a portion of a response force generated by the head upon impact with the ball is generated by the impact-influencing structure. The face has a stiffness proximate a geometric center of the face that is from about 46,000 to 56,000 lb-in$^2$, which may be determined using the equation S=E×I, as described below.

According to one aspect, the impact-influencing structure includes at least one elongated, recessed channel extending around a periphery of the body adjacent the at least one peripheral edge of the face. The channel may be located on an outer surface of the body, or the channel may be located on an interior surface of the body.

According to another aspect, the impact-influencing structure may include a region of the body formed of a flexible material having a modulus that is lower than a material of the face.

According to a further aspect, the face has a stiffening structure increasing the stiffness of the face.

According to yet another aspect, the face includes a face plate forming the ball striking surface and a porous stiffening structure connected to an inner side of the face plate. The porous stiffening structure may include a plurality of interior walls forming a honeycomb structure having hexagonal chambers. The face may further include a rear plate, such that the porous stiffening structure is sandwiched between the face plate and the rear plate.

According to a still further aspect, a majority of the force generated by impact with the ball is absorbed by the impact-influencing structure, and a majority of the response force generated by the head upon impact with the ball is generated by the impact-influencing structure.

Additional aspects of the invention relate to a ball striking device that includes a face having a ball striking surface and being defined by a plurality of face edges and a body connected to the face and extending rearward from the face edges to define an enclosed volume, where the body has a heel side, a toe side, a crown, and a sole. A channel is defined by first and second boundary edges extending continuously around an entire circumference of the body and generally equidistant from the face edges. The channel is recessed from outer surfaces of the body between the first and second annular boundary edges, and the channel includes a crown channel portion extending at least partially across the crown, a sole channel portion extending at least partially across the sole, and additional channel portions extending around the heel and the toe sides to interconnect the crown channel portion and the sole channel portion to form the channel in a continuous shape. The channel is spaced rearwardly from the face edges by a spacing portion, and the channel is configured such that at least some energy from an impact on the ball striking surface is transferred through the spacing portion and absorbed by the channel, causing the channel to deform and to exert a response force on the face.

According to one aspect, the channel is configured such that a majority of the energy of the impact is absorbed by the channel, and a majority of a face response of the face during the impact is derived directly from the response force exerted by the channel on the face.

According to another aspect, the face has a stiffness proximate a geometric center of the face that is from about 46,000 to 56,000 lb in$^2$.

According to a further aspect, the face also includes a face plate having the ball striking surface thereon and a cellular stiffening structure engaged with an inner surface of the face plate.

Further aspects of the invention relate to a ball striking device including a face having a ball striking surface and being defined by a plurality of face edges, and a body connected to the face and extending rearward from the face edges to define an enclosed volume, where the body has a heel side, a toe side, a crown, and a sole. A first channel is defined on the body by first and second boundary edges extending between a first end proximate the heel side and a second end proximate the toe side, such that the first channel extends at least partially across the crown of the body. A second channel is also defined on the body by third and fourth boundary edges extending between a third end proximate the heel side and a fourth end proximate the toe side, such that the second channel extends at least partially across the sole of the body. The first and second channels are each recessed inwardly from outer surfaces of the body between the respective boundary edges. The first end of the first channel is spaced from the third end of the second channel, and the second end of the first channel is spaced from the fourth end of the second channel, such that the first channel and the second channel are completely separate. The first and second channels are spaced rearwardly from the face edges by spacing portions, and the first and second channels are configured such that at least some energy from an impact on the ball striking surface is transferred through the spacing portion and absorbed by at least one of the first and second channels, causing the at least one of the first and second channels to deform and to exert a response force on the face.

According to one aspect, at least a portion of the body including the first and second channels has a stiffness that is lower than a stiffness of the face.

According to another aspect, the first end and the second end are both located on one side of an outermost periphery of the head, and the third end and the fourth end are both located on an opposite side of the outermost periphery.

According to a further aspect, a portion of the body, including at least the first and second channels, is formed of a flexible material having a modulus that is lower than a material of a second portion of the body. The second portion of the body may include the spacing portions in this configuration.

According to yet another aspect, the face has a stiffening structure increasing the stiffness of the face.

According to a still further aspect, the face includes a face plate forming the ball striking surface and a porous stiffening structure connected to an inner side of the face plate. The porous stiffening structure may include a plurality of interior walls forming a honeycomb structure having hexagonal chambers. Additionally, the face may also include a rear plate in this configuration, where the porous stiffening structure is sandwiched between the face plate and the rear plate.

According to an additional aspect, a majority of the force generated by impact with the ball is absorbed by the impact-influencing structure, and a majority of the response force generated by the head upon impact with the ball is generated by the impact-influencing structure.

According to another aspect, the first channel is recessed deeper proximate a center of the first channel than at the first and second ends and a depth of the first channel tapers deeper from the first and second ends to the center. The second channel is also recessed deeper proximate a center of the second channel than at the third and fourth ends and a depth of the second channel tapers deeper from the third and fourth ends to the center.

According to yet another aspect, the face is formed as part of a face member and the head further includes a body member connected to the face member and forming at least a portion of the body. The face member may be a plate member in one configuration, and may include the face and a wall extending rearwardly from the face in another configuration, such that the wall combines with the body member to define the body. In this configuration, the first channel and the second channel may be located entirely within the wall.

Still further aspects of the invention relate to a ball striking device that includes a face having a ball striking surface and being defined by a plurality of face edges, and a body connected to the face and extending rearward from the face edges to define an enclosed volume, where the body has a heel side, a toe side, a crown, and a sole. A band of flexible material extends around at least a portion of a circumference of the body and is generally equidistant from the face edges. The flexible material has a stiffness that is lower than a stiffness of the face and a modulus that is lower than a modulus of another portion of the body. The band is configured such that at least some energy from an impact on the ball striking surface is transferred through the spacing portion and absorbed by the band, causing the band to deform and to exert a response force on the face.

According to one aspect, the band may be spaced rearwardly from the face edges by spacing portions.

According to another aspect, the head may include a first channel defined on the body by first and second boundary edges extending between a first end proximate the heel side and a second end proximate the toe side. The first channel is recessed inwardly from outer surfaces of the body between the first and second edges, and the first channel is spaced rearwardly from the face edges by a spacing portion. The first channel may be positioned within the band, such that the flexible material forms the first channel. In this configuration, the channel may be a 360° channel, such that the first and second boundary edges may extend continuously around an entire circumference of the body and are generally equidistant from the face edges, and the first channel includes a crown channel portion extending at least partially across the crown, a sole channel portion extending at least partially across the sole, and additional channel portions extending around the heel and the toe to interconnect the crown channel portion and the sole channel portion to form the first channel in a continuous circumferential shape. Alternately, the first channel may extend at least partially across the crown of the body, and the head may also include a second channel defined on the body by third and fourth boundary edges extending between a third end proximate the heel side and a fourth end proximate the toe side, such that the second channel extends at least partially across the sole of the body. The second channel is recessed inwardly from the outer surfaces of the body between the third and fourth edges. The second channel may also be positioned within the band, such that the flexible material forms the second channel, and the second channel may be spaced rearwardly from the face edges by an additional spacing portion. The first end of the first channel is spaced from the third end of the second channel, and the second end of the first channel is spaced from the fourth end of the second channel, such that the first channel and the second channel are completely separate.

According to a further aspect, the face includes a face plate forming the ball striking surface and a porous stiffening structure connected to an inner side of the face plate.

According to yet another aspect, the face is formed as part of a face member and the head further includes a body member forming a portion of the body, such that the band connects the face member to the body member. The band may be joined to at least one of the face member and the body member by a lap joint.

Other aspects of the invention relate to a golf club or other ball striking device including a head or other ball striking device as described above and a shaft connected to the head and configured for gripping by a user. Aspects of the invention relate to a set of golf clubs including at least one golf club as described above. Yet additional aspects of the invention relate to a method for manufacturing a ball striking device as described above, including forming a ball striking device as described above.

BRIEF DESCRIPTION OF THE DRAWINGS

To allow for a more full understanding of the present invention, it will now be described by way of example, with reference to the accompanying drawings in which.

Figure 1:
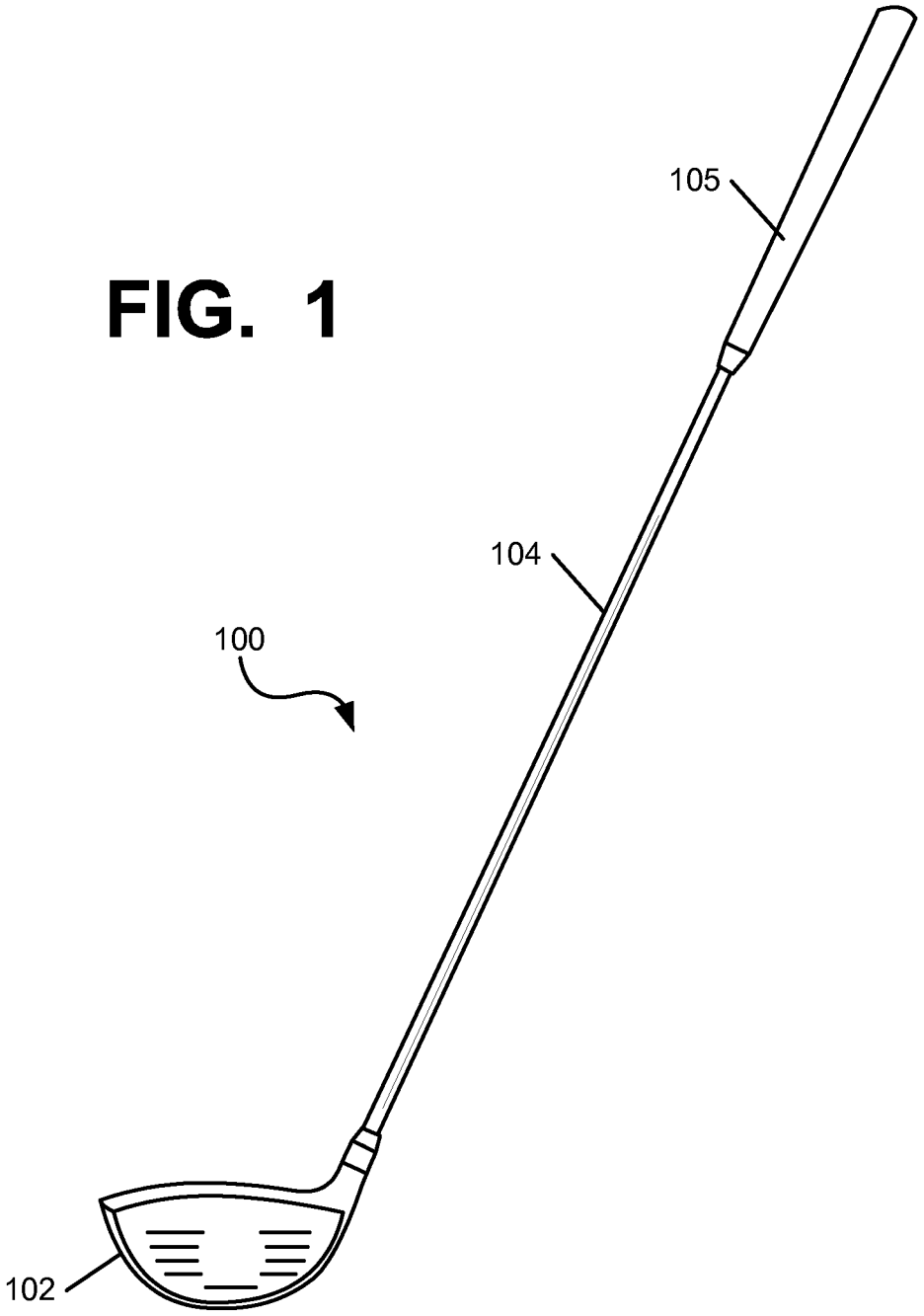
FIG. 1 is a front view of an illustrative embodiment of a wood-type ball striking device according to aspects of the present invention.

It is understood that the relative sizes of the components in these Figures and the degrees of deformation of the components shown in FIGS. 5-11 may be exaggerated in order to show relevant detail.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, and welding (including brazing, soldering, or the like), where separation of the joined pieces cannot be accomplished without structural damage thereto.

"Approximately" or "about" means within a range of +/−10% of the nominal value modified by such term.

In general, aspects of this invention relate to ball striking devices, such as golf club heads, golf clubs, and the like. Such ball striking devices, according to at least some examples of the invention, may include a ball striking head and a ball striking surface. In the case of a golf club, the ball striking surface is a substantially flat surface on one face of the ball striking head. It is understood that some golf clubs or other ball striking devices may have more than one ball striking surface. Some more specific aspects of this invention relate to wood-type golf clubs and golf club heads. Alternately, some aspects of this invention may be practiced with iron-type golf clubs and golf club heads, hybrid clubs, chippers, putters, etc.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other composites. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to the invention relate to golf club head structures, including heads for wood-type golf clubs, such as drivers, fairway woods, etc. Other examples of ball striking devices according to the invention may relate to iron-type golf clubs, such as long iron clubs (e.g., driving irons, zero irons through five irons), short iron clubs (e.g., six irons through pitching wedges, as well as sand wedges, lob wedges, gap wedges, and/or other wedges), as well as hybrid clubs, putters, chippers, and other types of clubs. Such devices may include a one-piece construction or a multiple-piece construction. Example structures of ball striking devices according to this invention will be described in detail below in conjunction with FIG. 1, which illustrates an example of a ball striking device 100 in the form of a golf driver, in accordance with at least some examples of this invention.

Figure 2:
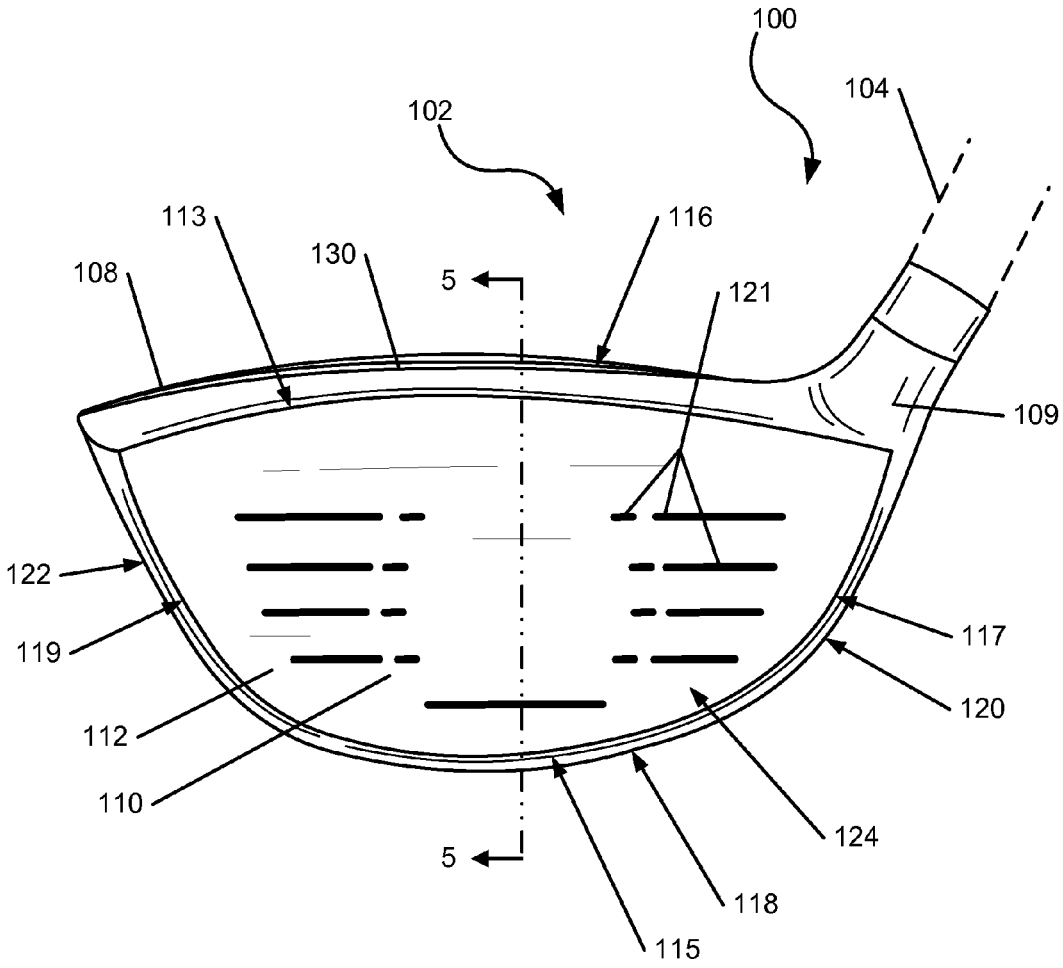
FIG. 2 is a perspective view of a head of the ball striking device of FIG. 1.

FIGS. 1-6 illustrate a ball striking device 100 in the form of a golf driver, in accordance with at least some examples of the invention, and FIGS. 7-21 illustrate various additional embodiments of a golf driver in accordance with aspects of the invention. As shown in FIG. 1, the ball striking device 100 includes a ball striking head 102 and a shaft 104 connected to the ball striking head 102 and extending therefrom. As shown in FIG. 2, the ball striking head 102 of the ball striking device 100 of FIG. 1 has a face 112 connected to a body 108, with a hosel 109 extending therefrom. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. In the club 100 shown in FIG. 1, the head 102 has a relatively large volume, as the club 100 is designed for use as a driver, intended to hit the ball 106 (shown in FIGS. 5 and 6) accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. If instead configured as a fairway wood, the head may have a volume of 120 cc to 230 cc, and if configured as a hybrid club, the head may have a volume of 85 cc to 140 cc. Other appropriate sizes for other club heads may be readily determined by those skilled in the art.

Figure 12:
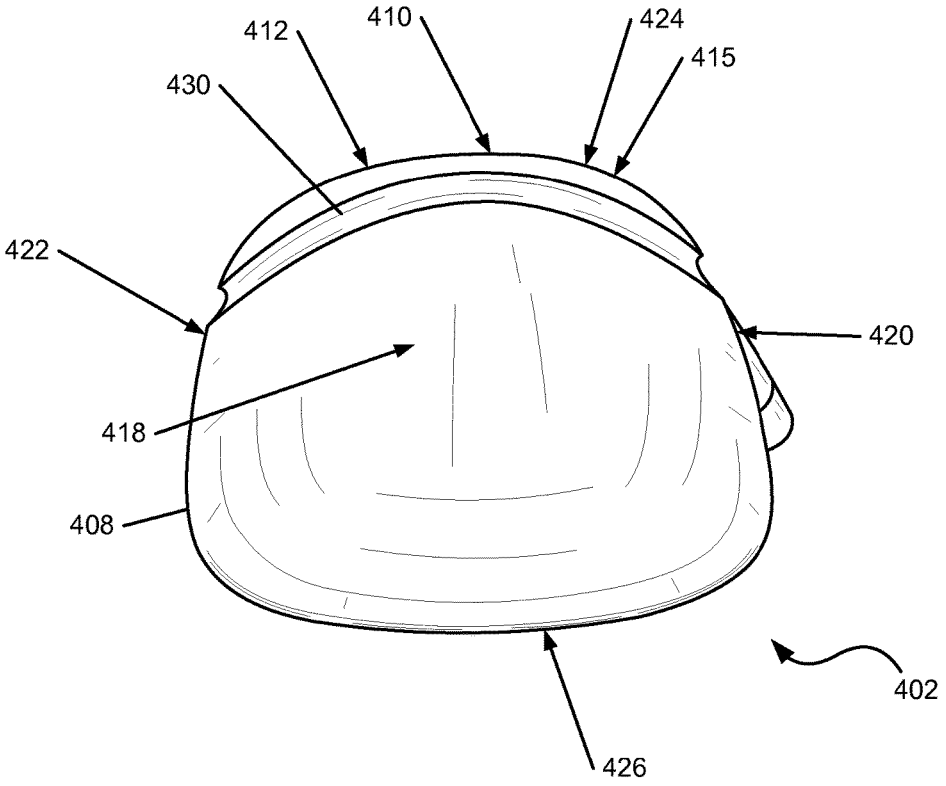
FIG. 12 is a bottom view of another illustrative embodiment of a wood-type ball striking device according to aspects of the present invention.

In the embodiment illustrated in FIGS. 1-6, the head 102 has a hollow structure defining an inner cavity 107 (e.g., defined by the face 112 and the body 108). Thus, the head 102 has a plurality of inner surfaces defined therein. In one embodiment, the hollow inner cavity 107 may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity 107 may not be completely enclosed in some embodiments. In the embodiment illustrated in FIGS. 1-4, the body 108 of the head 102 has a rounded rear profile. In other embodiments, the body 108 of the head 102 can have another shape or profile, including a squared or rectangular rear profile as shown in FIG. 12, or any of a variety of other shapes. It is understood that such shapes may be configured to distribute weight away from the face 112 and/or the geometric/volumetric center of the head 102, in order to create a lower center of gravity and/or a higher moment of inertia. The body 108 may be connected to the hosel 109 for connection to a shaft 104, as described below.

The face 112 is located at the front 124 of the head 102, and has a ball striking surface 110 located thereon and an inner surface 111 (FIGS. 5-6) opposite the ball striking surface 110. The ball striking surface 110 is typically an outer surface of the face 112 configured to face a ball 106 in use, and is adapted to strike the ball 106 when the device 100 is set in motion, such as by swinging. The face 112 is defined by peripheral edges, including a top edge 113, a bottom edge 115, a heel edge 117, and a toe edge 119. Additionally, in this embodiment, the face 112 has a plurality of face grooves 121 on the ball striking surface 110, which do not extend across the center of the face 112. In another embodiment, such as a fairway wood head or a hybrid wood-type head, the face 112 may have grooves 121 that extend across at least a portion of the center of the face 112.

As shown, the ball striking surface 110 is relatively flat, occupying most of the face 112. For reference purposes, the portion of the face 112 nearest the top face edge 113 and the heel 120 of the head 102 is referred to as the "high-heel area" the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIG. 1, the ball striking surface 110 is inclined slightly (i.e., at a loft angle), to give the ball 106 slight lift and spin when struck. In other illustrative embodiments, the ball striking surface 110 may have a different incline or loft angle, to affect the trajectory of the ball 106. Additionally, the face 112 may have a variable thickness and/or may have one or more internal or external inserts in some embodiments.

It is understood that the face 112, the body 108, and/or the hosel 109 can be formed as a single piece or as separate pieces that are joined together. For example, in one embodiment, face 112 may be wholly or partially formed by a face member with the body 108 being partially or wholly formed by a body member including one or more separate pieces connected to the face member, for example, as in the embodiment shown in FIGS. 19-20. These pieces may be connected by an integral joining technique, such as welding, cementing, or adhesively joining Other known techniques for joining these parts can be used as well, including many mechanical joining techniques, including fasteners and other releasable mechanical engagement techniques. If desired, the hosel 109 may be integrally formed as part of the body member or the face member. Further, a gasket (not shown) may be included between the face member and the body member in some embodiments. FIG. 5A illustrates one embodiment of the head 102 of FIGS. 1-5, where the head 102 includes a face member 128 connected to a body member 129 using lap joint connections 160. It is understood that other techniques may be used to secure the lap joints 160, such as welding, brazing, bonding, press-fitting, etc. If the face member 128 is welded to the body member 129, a butt joint may be used instead of a lap joint in one embodiment. As seen in FIG. 5A, the lap joints 160 are located rearwardly of the channels 130, so as to not affect the stiffness of the channels 130 and to not result in the channels 130 being spaced too far rearwardly from the face 112. However, in another embodiment, lap joints 160, butt joints, or other joint connections may be formed forwardly of the channels 130, such as in the portions of the body 108 spacing the channels 130 from the face 112. Additionally, it may be advantageous to weld in a location where the heat affected zone (HAZ) of the weld does not penetrate the channel 130 and/or affect the flexibility of the channel 130. In one embodiment, the weld is no closer than about 4 mm from the channel 130. The face member 128 shown in FIG. 5A is in the form of a cup-face structure, however other configurations of face members 128 may be used.

The ball striking device 100 may include a shaft 104 connected to or otherwise engaged with the ball striking head 102, as shown in FIG. 1. The shaft 104 is adapted to be gripped by a user to swing the ball striking device 100 to strike the ball 106. The shaft 104 can be formed as a separate piece connected to the head 102, such as by connecting to the hosel 109, as shown in FIG. 1. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention.

The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 105 may be positioned on the shaft 104 to provide a golfer with a slip resistant surface with which to grasp golf club shaft 104, as shown in FIG. 1. The grip element 105 may be attached to the shaft 104 in any desired manner, including in conventional manners known and used in the art (e.g., via adhesives or cements, threads or other mechanical connectors, swedging/swaging, etc.).

In general, the head 102 has a face 112 with increased stiffness relative to existing faces and a body 108 that has impact-influencing structural features that can affect the physics of the impact of the ball 106 with the face 112, such as the COR measured according to USGA testing procedures. The impact influencing features may take the form of one or more flexible portions that extends around at least a portion of the periphery of the body 108, adjacent to the peripheral edges 113, 115, 117, 119 of the face 112. The flexible portion(s) may be formed in many ways, including by channels or other structural features and/or by the use of flexible materials. In one embodiment, a majority of the force generated by impact with a ball 106 is absorbed by the impact-influencing features, and a majority of a response force generated by the head 102 upon impact with the ball 106 is generated by the impact-influencing structure. In existing golf club heads, the face 112 absorbs a significant majority of the impact force and generates a significant majority of the response force.

Figure 3:
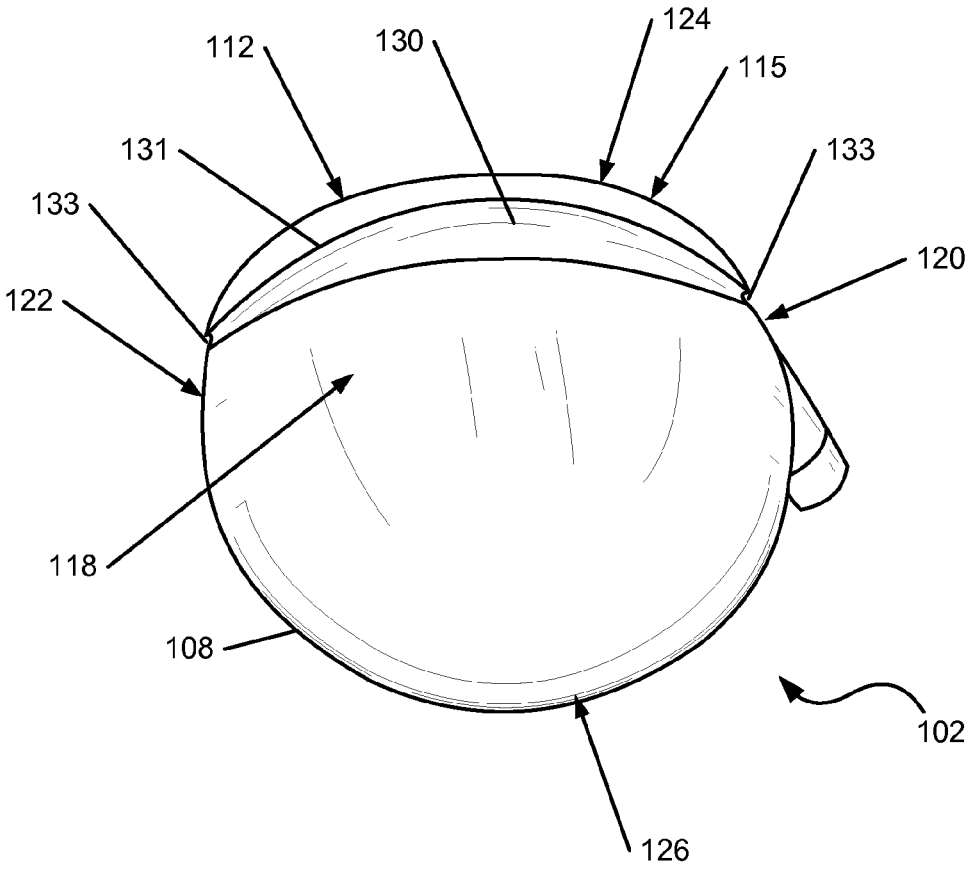
FIG. 3 is a bottom view of the head of FIG. 2.
Figure 4:
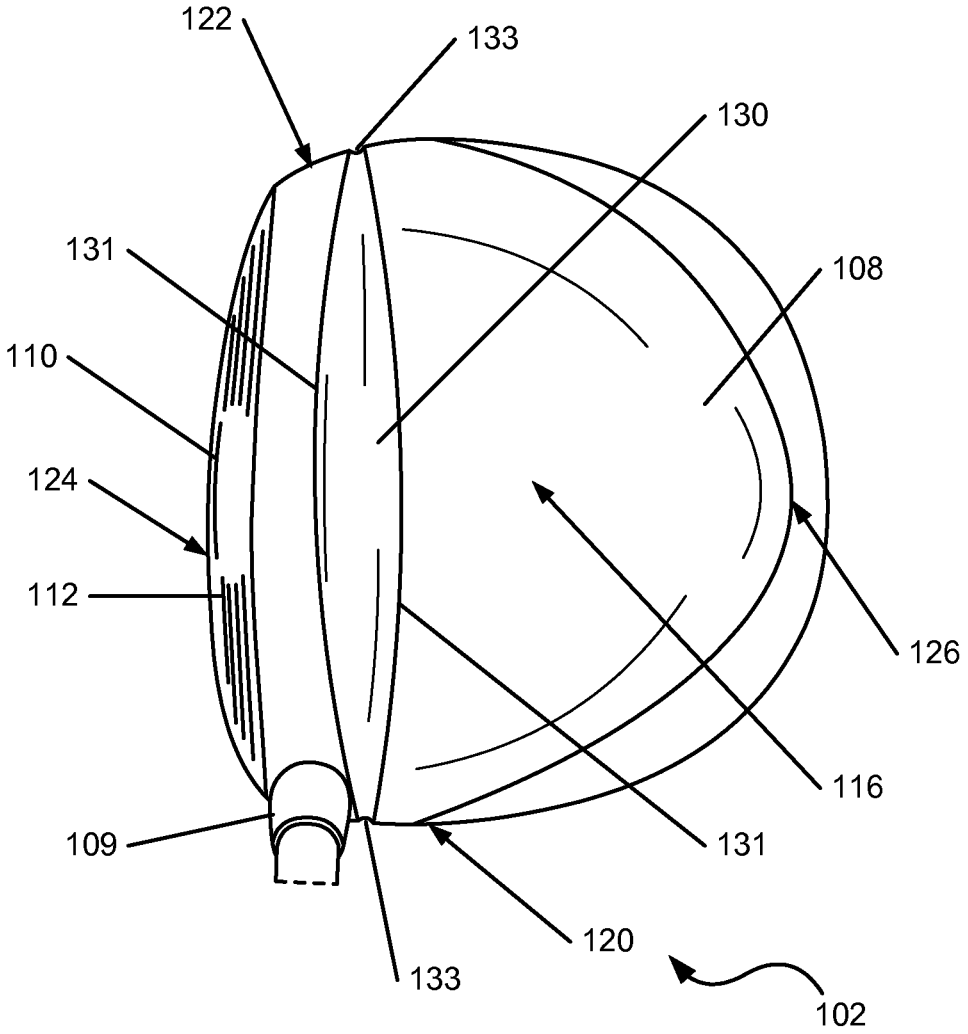
FIG. 4 is a top view of the head of FIG. 2.
Figure 4A:
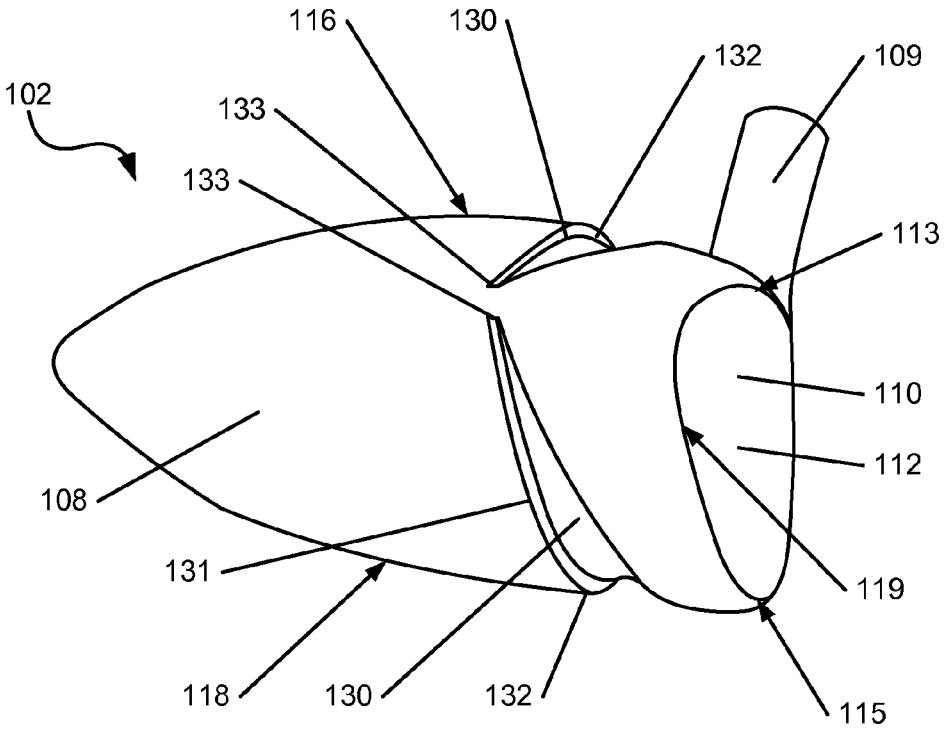
FIG. 4A is a side view of the head of FIG. 2.
Figure 4B:
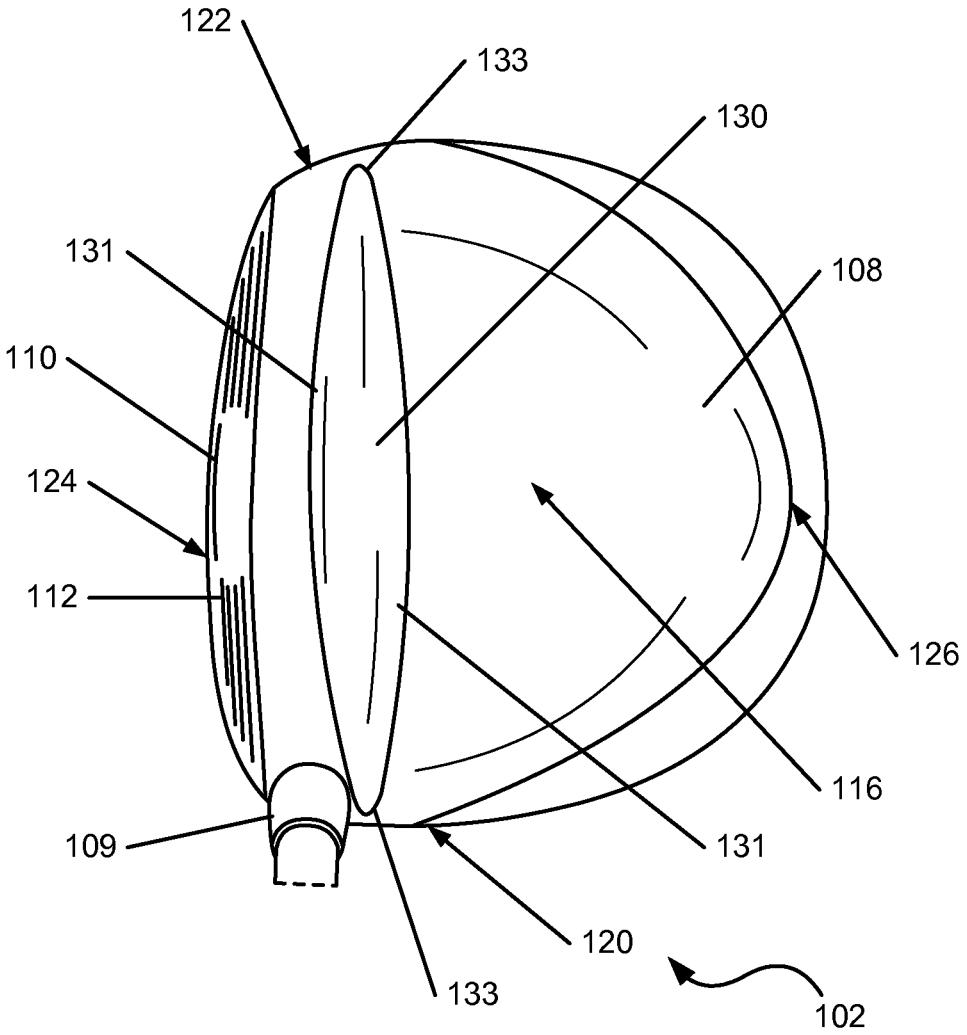
FIG. 4B is a top view of an alternative embodiment of the head of FIG. 4.

In the embodiment shown in FIGS. 1-6, the head 102 has a channel or channels 130 extending around the body 108 adjacent and generally parallel to the peripheral edges 113, 115, 117, 119 of the face 112. The channels 130 illustrated in FIGS. 2-6 allow at least a portion of the body 108 to flex, produce a reactive force, and/or change the behavior or motion of the face 112, during impact of a ball on the face 112. In this embodiment, the channels 130 permit compression and flexing of the body 108 during an impact on the face 112, and also produce a reactive force that can be transferred to the ball 106, as well as changing the motion and behavior of the face 112 during impact. As shown in FIGS. 3-4A, in this embodiment, the body 108 has two elongated channels 130, one extending across the top 116 of the head 102 from an end 133 at the heel 120 to an end 133 at the toe 122, and the other extending across the bottom 118 of the head 102 from an end 133 at the heel 120 to an end 133 at the toe 122. As seen in FIGS. 3-4A, these channels 130 are spaced rearwardly approximately the same distance from the face 112, and are generally in alignment and symmetrically positioned on the head 102. In another embodiment, the head 102 may have a single channel 130 extending around all or part of the periphery of the head 102. For example, in one embodiment, the ends of the channels shown in FIGS. 3-4A may be joined to form a single channel 130. In another embodiment, as shown in FIG. 4B, the top and/or bottom channels 130 may not extend to the outermost periphery (i.e. the periphery defining the largest outer dimension) of the head 102 and may converge to a point short of the outer periphery. In this embodiment, the channel 130 has distal ends 133 that stop short of the outer periphery and are spaced toward the center of the head 102 from the outer periphery, with surfaces of the body 108 extending between the ends 133 of the channel 130 and the outer periphery. In other words, the ends 133 of the channel are both on the same (top) side of the outermost periphery of the head 102, and are both on the same (top) side of a plane defined by the outermost periphery. The head 102 may contain a single channel 130 on the crown 116, a single channel on the sole 118, or channels 130 on both the crown 116 and the sole 118 in various configurations. It is understood that if the head 102 contains a channel 130 on the sole 118, this channel 130 may be similarly configured such that the ends 133 do not extend to the outer periphery of the head 102, and the ends 133 are both on the same (bottom) side of the outermost periphery.

Figure 5:
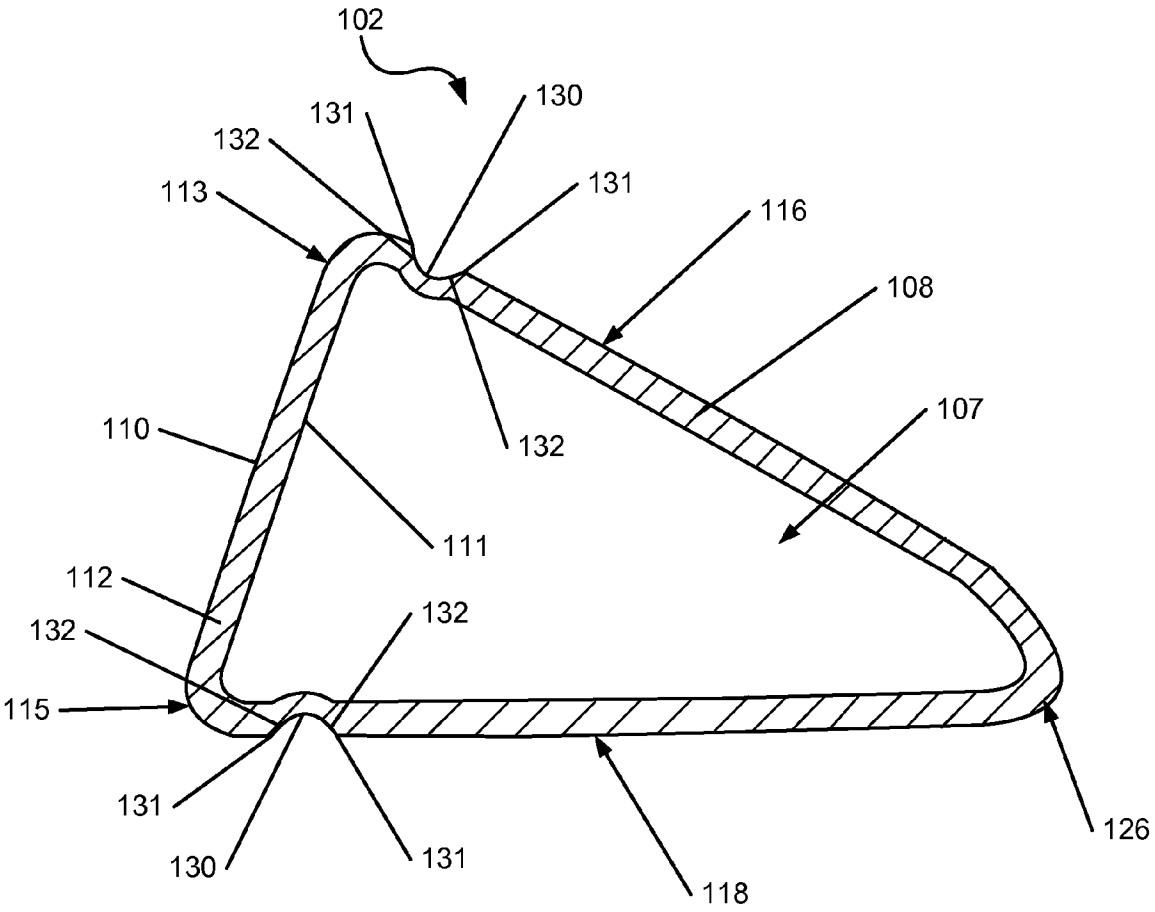
FIG. 5 is a cross-sectional view of the head of FIG. 2, taken along lines 5-5 of FIG. 2.
Figure 5A:
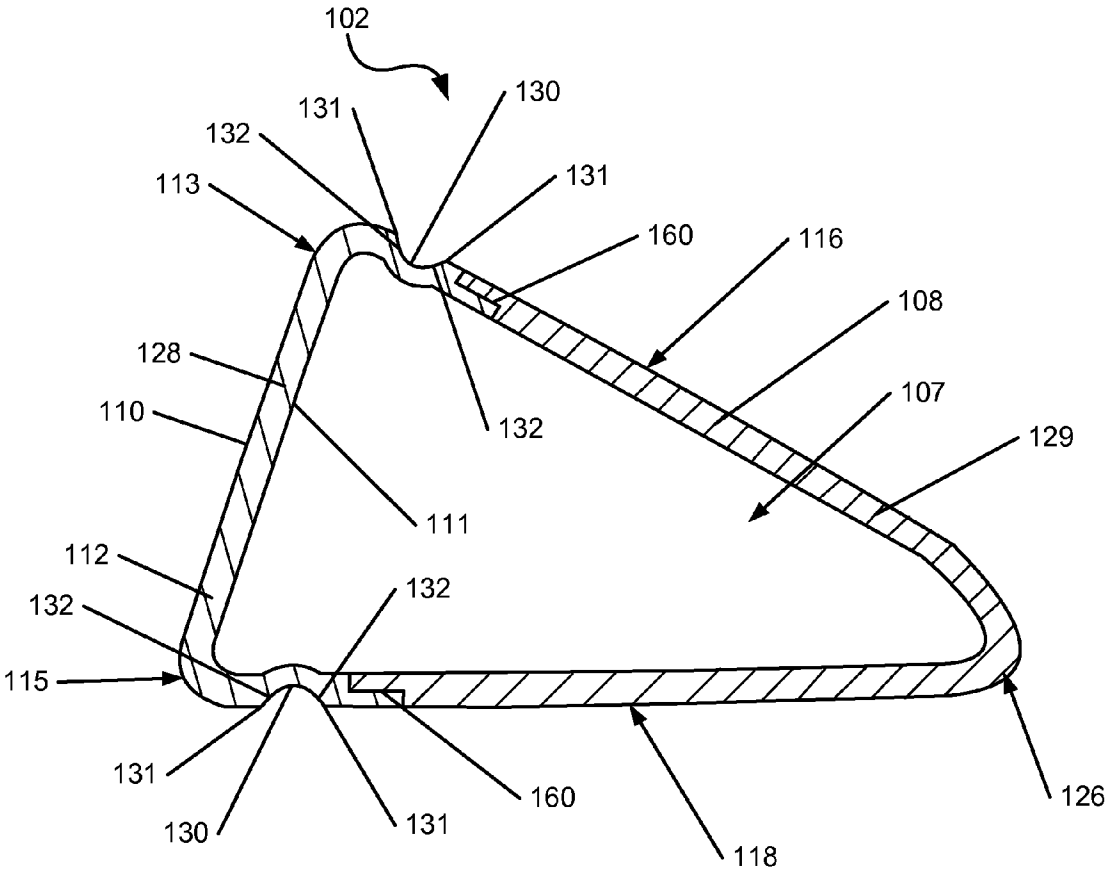
FIG. 5A is a cross-sectional view of an alternative embodiment of the head of FIG. 5.
Figure 6:
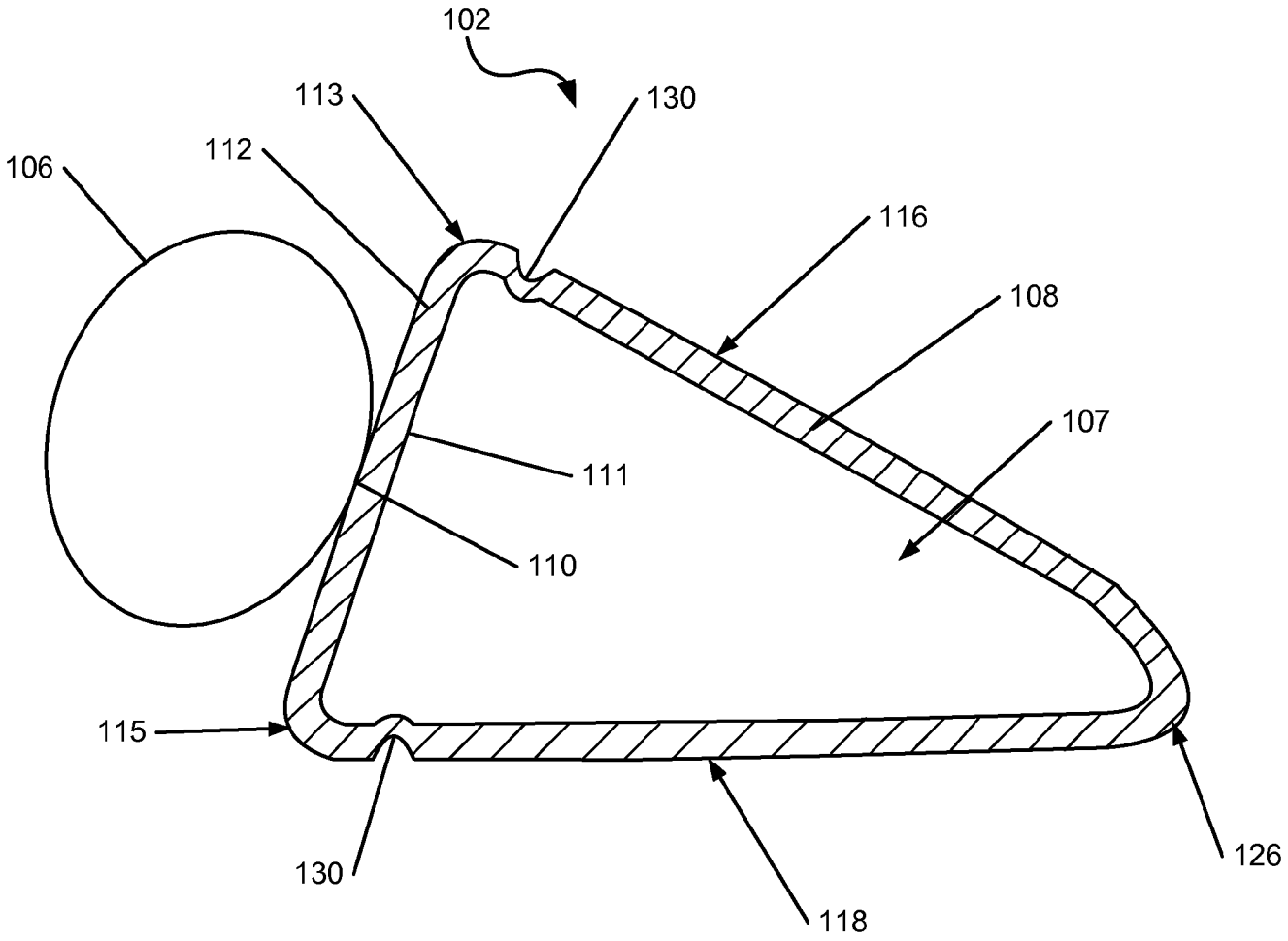
FIG. 6 is a cross-sectional view of the head as shown in FIG. 5, illustrated during impact with a ball.

The channels 130 illustrated in FIGS. 2-6 are recessed inwardly with respect to surfaces of the head 102 that are in contact with the boundary 131 defining the channel 130, as shown in FIGS. 4A-6. The channels 130 in this embodiment have a trough-like shape, with sloping sides 132 that are smoothly curved, as seen in FIGS. 5-6. Additionally, the channels 130 have a tapering width in this embodiment, such that the channels 130 are narrower (measured between the boundaries 131 transverse to the direction of elongation of the channel 130) at the ends 133 than at the center. The channels 130 further have a tapering depth in this embodiment, such that the channels 130 are shallower (measured by the degree of recess of the channel 130) at the ends 133 than at the center. The geometry of each channel 130 can affect the flexibility of the channel 130 and the corresponding response transferred through the face 112 to the ball 106. Accordingly, in one embodiment, different heads 102 can be produced having faces 112 with different responses, by using channels 130 with different geometries.

In other embodiments, the head may contain one or more channels 130 that are different in number, size, shape, depth, location, etc. For example, the channel(s) 430 of the head 402 in FIG. 12, have a more constant width than the channels 130 of FIGS. 2-6. As another example, the channel(s) 130 may have a sharper and/or more polygonal cross-sectional shape and/or a different depth in some embodiments. As a further example, the channel(s) 130 may be located only on the top 116, the bottom 118, the heel 120, and/or the toe 122 of the head 102. As yet another example, the wall thickness of the body 108 may be increased or decreased at the channels 130, as compared to the thickness at other locations of the body 108, to control the flexibility of the channels 130. As a still further example, the channels 130 may be located on an inner surface of the body 108, such as in the head 202 shown in FIGS. 7-8. Still other configurations may be used and may be recognizable to those skilled in the art in light of the present specification.

As mentioned above, the face 112 has increased stiffness relative to existing faces for golf club heads. The increased stiffness of the face 112 can be achieved through various different means and structures, including through the use of high-strength and high-modulus materials and/or through the use of stiffening structures in the face 112. As used herein, stiffness is calculated using the equation:

$$S=E\times I$$

where "S" refers to stiffness, "E" refers to Young's modulus of the material, and "I" refers to the cross-sectional moment of inertia of the face 112. Accordingly, stiffness depends not only on the modulus (flexibility) of the material, but also on the thickness and shape of the face 112. In one example, the face 112 can be made from a material having higher modulus and/or may also be made thicker than a normal face 112. In one embodiment, the face 112 may have a stiffness that is about 10 times greater than the stiffness of a typical titanium driver face (e.g. with a height of about 2.3 inches (57-58 mm) and a thickness of about 3 mm, and a modulus of 105 GPa), such as about 4,600-5,600 lb-in$^2$, or about 5,100 lb-in$^2$ (about 13.3-16.2 N–m$^2$, or about 14.7 N–m$^2$) in one example; or in other words, a stiffness of about 46,000-56,000 lb-in$^2$, or about 51,000 lb-in$^2$. These stiffness figures are measured at the geometric center and/or the hot zone of the face, which may be the cross-section plane of the face with the greatest height. Additionally, these stiffness figures are measured on the vertical axis, i.e. for bending across the thickness of the face 112 based on a force applied to the striking surface 110. Examples of materials having high modulus that may be used in the face include a variety of high-strength steel and titanium alloys, composites (including titanium-based composites and carbon fiber and other fiber-reinforced composites, and various other composites containing metals, polymers, ceramics, etc.), beryllium and beryllium alloys, molybdenum and molybdenum alloys, tungsten and tungsten alloys, other metallic materials (including alloys), high-strength polymers, ceramics, and other suitable materials. In one embodiment, the face 112 may utilize a material that has a modulus of at least 280 GPa. In another example, the face 112 may have stiffening structure that increases the stiffness of the face 112, such as through adding increased modulus and/or increasing the cross-sectional moment of inertia (I) of the face 112. Some examples of such stiffening means and structures are shown in FIGS. 13-21 and described below, including inserts and reinforcing structures. As a further example, any of the stiffening structures disclosed in U.S. Published Patent Application No. 2010/0130303, filed on Nov. 21, 2008, in the name of John T. Stites et al., or variations thereof, may be utilized to give increased stiffness to the face or localized areas thereof, which application is incorporated by reference herein and made part hereof. It is understood that a face 112 may include any combination of these stiffening techniques in some embodiments.

The face 112, or at least a portion of the face 112 including the CG and/or the geometric center of the face 112, may have a stiffness that is greater than the stiffness of at least a portion of the body 108. In one embodiment, a majority of the face 112 including the geometric center of the face 112 may include such increased stiffness. For example, in one embodiment, the face 112 may have a stiffness that is greater than the stiffness of any portion of the body 108. In another embodiment, the face 112 may have a stiffness that is at least greater than the stiffness of the channel(s) 130. The channel 130 may also have a lower stiffness than at least some other portions of the body 108, which may be accomplished through the use of structure and/or materials (e.g. as in FIGS. 9-10). Other embodiments described herein may utilize faces and body features having similar stiffness or relative stiffness, including other embodiments of channels 230, et seq.

Figure 11:
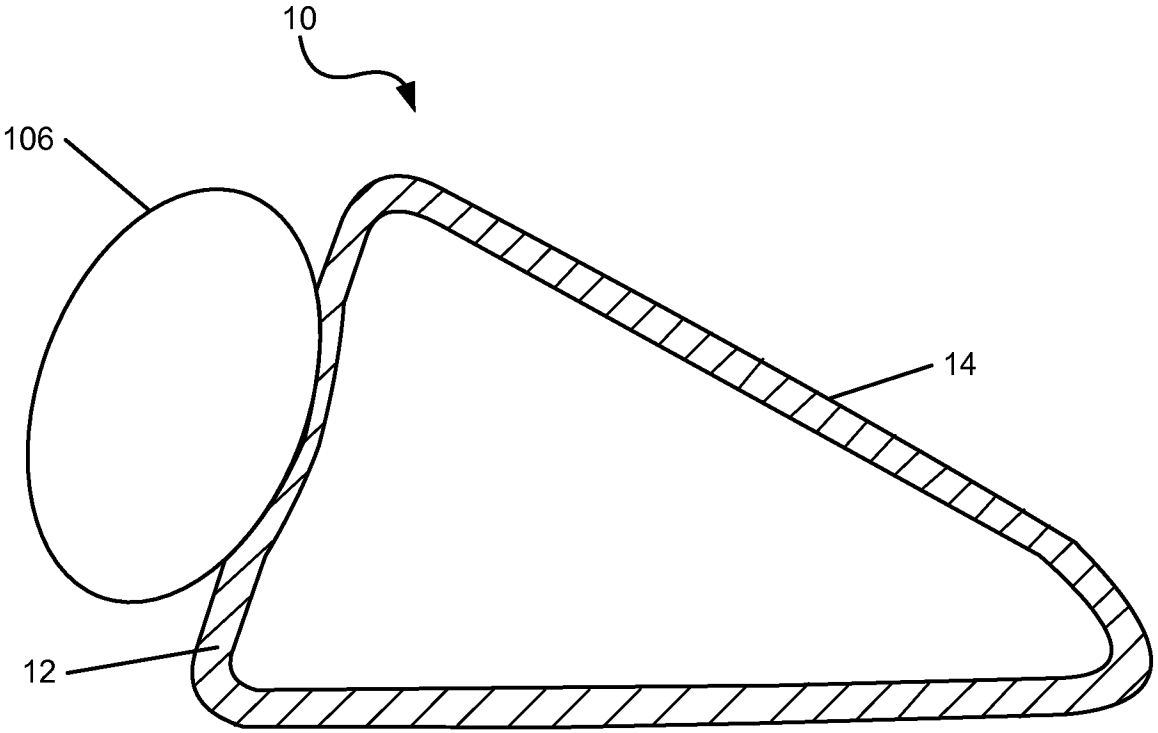
FIG. 11 PRIOR ART
FIG. 11 is a cross-sectional view of an example of an existing wood-type ball striking device, illustrated during impact with a ball.

FIGS. 5-6 illustrate an impact of a ball 106 on the face 112 of the head 102 as shown in FIGS. 2-6. As shown in FIG. 6, when the ball 106 impacts the ball striking surface 110, the stiffened face 112 has very little to no deformation, and the force of the impact is transferred to the channels 130 on the top 116 and bottom 118 of the head 102. The channels 130 deform due to the impact force, as shown in FIG. 6, and return to their original configurations, as shown in FIG. 5, producing a response force that is transferred through the face 112 to the ball 106, propelling the ball 106 forward. In contrast, FIG. 11 illustrates an existing driver head 10, having a face 12 and a body 14 connected to the face 12, during an impact with the ball 106. As illustrated in FIG. 11, most or all of the deformation of the head 10 on impact occurs in the face 12, and the face 12 creates most or all of the response force on the ball 106, in contrast to the head 102 described above. The configuration shown in FIGS. 1-6 can achieve increased energy and velocity transfer to the ball 106 and increased response (COR) for impacts that are away from the center or traditional "sweet spot" of the face 112, such as high or low impacts or heel or toe impacts. The face 112 does not depend solely on localized "trampoline" effect for response force, and the response-producing channels 130 extend toward the heel 120 and toe 122, and overlap the heel and toe edges 117, 119 of the face 112. Additionally, in some embodiments, the flexing of the channels 130 can create a more gradual impact with the ball 106 as compared to the traditional head 10 (FIG. 16), which results in a smaller degree of deformation of the ball 106 as compared to the traditional head 10. This smaller degree of deformation can result in greater impact efficiency and greater energy and velocity transfer to the ball 106 during impact. The more gradual impact created by the flexing can also create a longer impact time, which can result in greater energy and velocity transfer to the ball 106 during impact.

FIGS. 7-10 and 12 illustrate additional embodiments that include different impact-influencing features on the body.

Figure 7:
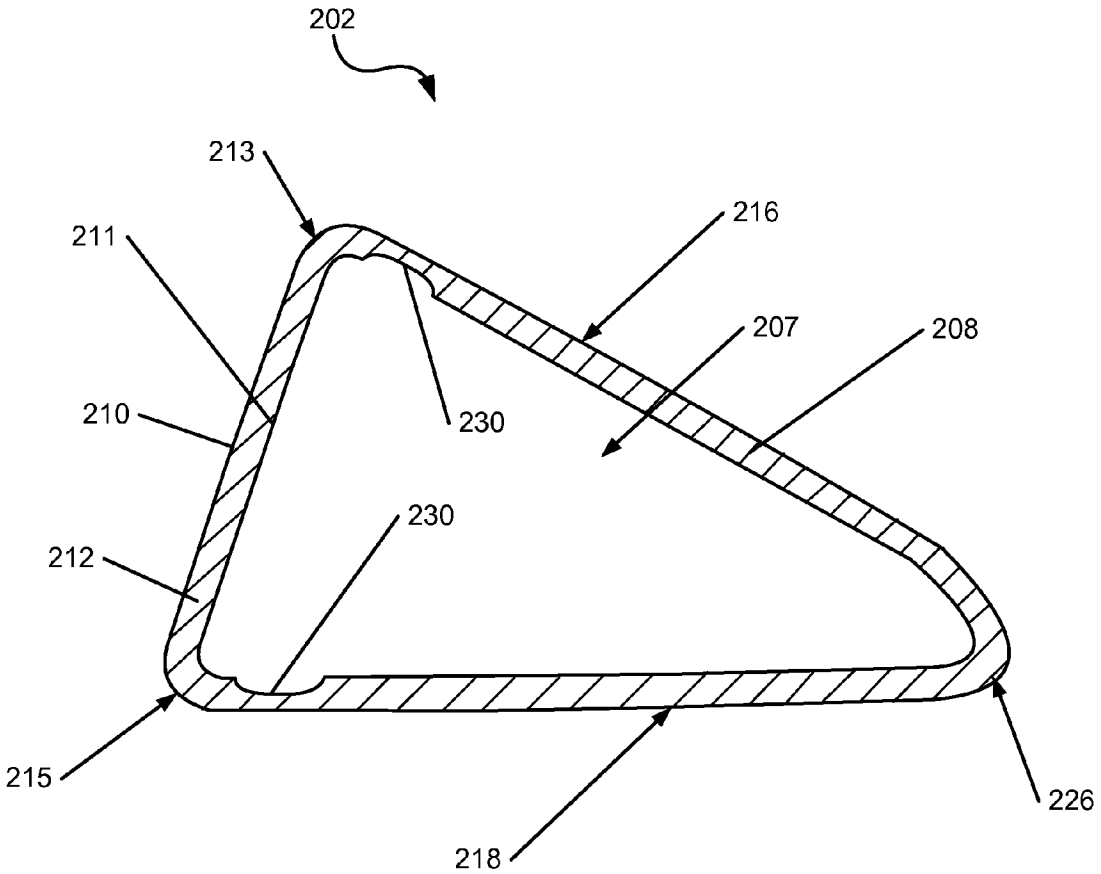
FIG. 7 is a cross-sectional view of another illustrative embodiment of a wood-type ball striking device according to aspects of the present invention.
Figure 8:
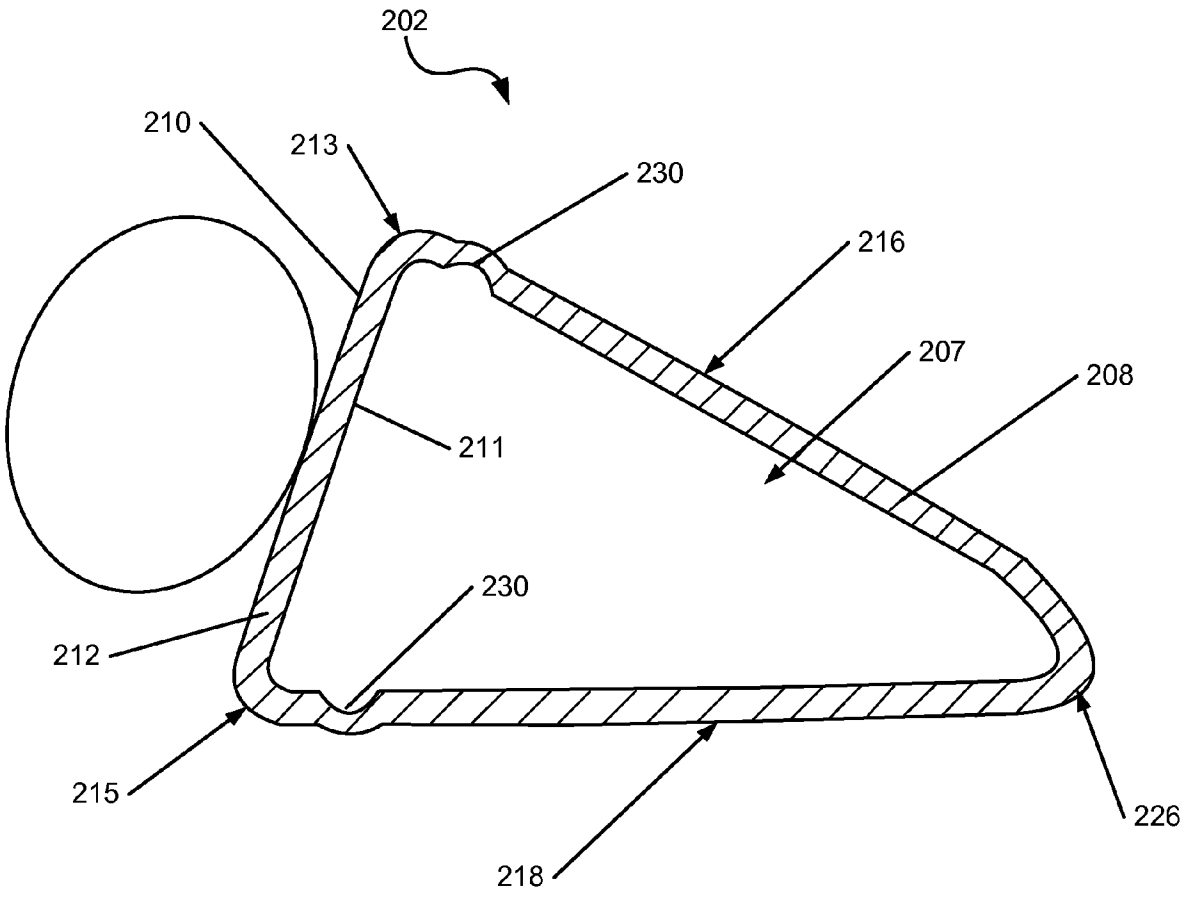
FIG. 8 is a cross-sectional view of the head as shown in FIG. 7, illustrated during impact with a ball.

FIGS. 7-8 illustrate another embodiment of a head 202 having impact-influencing features on the body 208. Many features of this embodiment are similar or comparable to features of the head 102 described above and shown in FIGS. 1-6, and such features are referred to using similar reference numerals under the "2xx" series of reference numerals, rather than "1xx" as used in the embodiment of FIGS. 1-6. Accordingly, certain features of the head 202 that were already described above with respect to the head 102 of FIGS. 1-6 may be described in lesser detail, or may not be described at all. The head 202 of FIGS. 7-8 has one or more channels 230 on the inner surfaces of the body 208, which act as impact-influencing features, similarly to the channels 130 described above. In this embodiment, the head 202 has a single channel 230 that extends around the entire inner periphery of the body 208 and is spaced rearwardly from the face 212. However, in other embodiments, the head 202 may have multiple channels 230, such as channels 230 that are arranged similarly to the channels 130 of FIGS. 2-6. The head 202 of FIGS. 7-8 may utilize a stiffened face 212, as described herein. FIG. 8 illustrates an impact of a ball 106 on the face 212 of the head 202. When the ball 106 impacts the ball striking surface 210, the stiffened face 212 has very little to no deformation, and the force of the impact is transferred to the channels 230 on the top 216 and bottom 218 of the head 202. The channels 230 deform due to the impact force, as shown in FIG. 8, and return to their original configurations, as shown in FIG. 7, producing a response force that is transferred through the face 212 to the ball 106, propelling the ball 106 forward. The head 202 of FIGS. 7-8 can produce similar results and advantages as the head 102 of FIGS. 2-6 described above.

Figure 9:
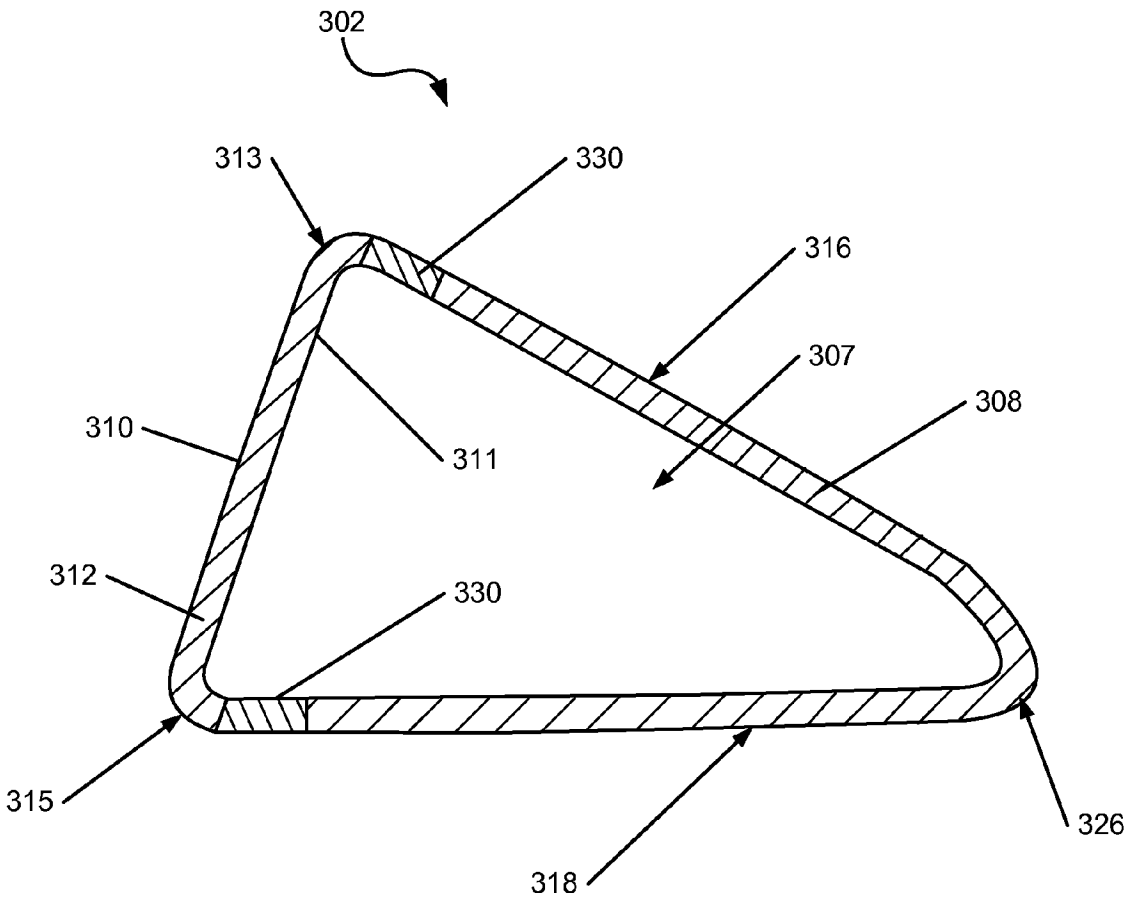
FIG. 9 is a cross-sectional view of another illustrative embodiment of a wood-type ball striking device according to aspects of the present invention.
Figure 10:
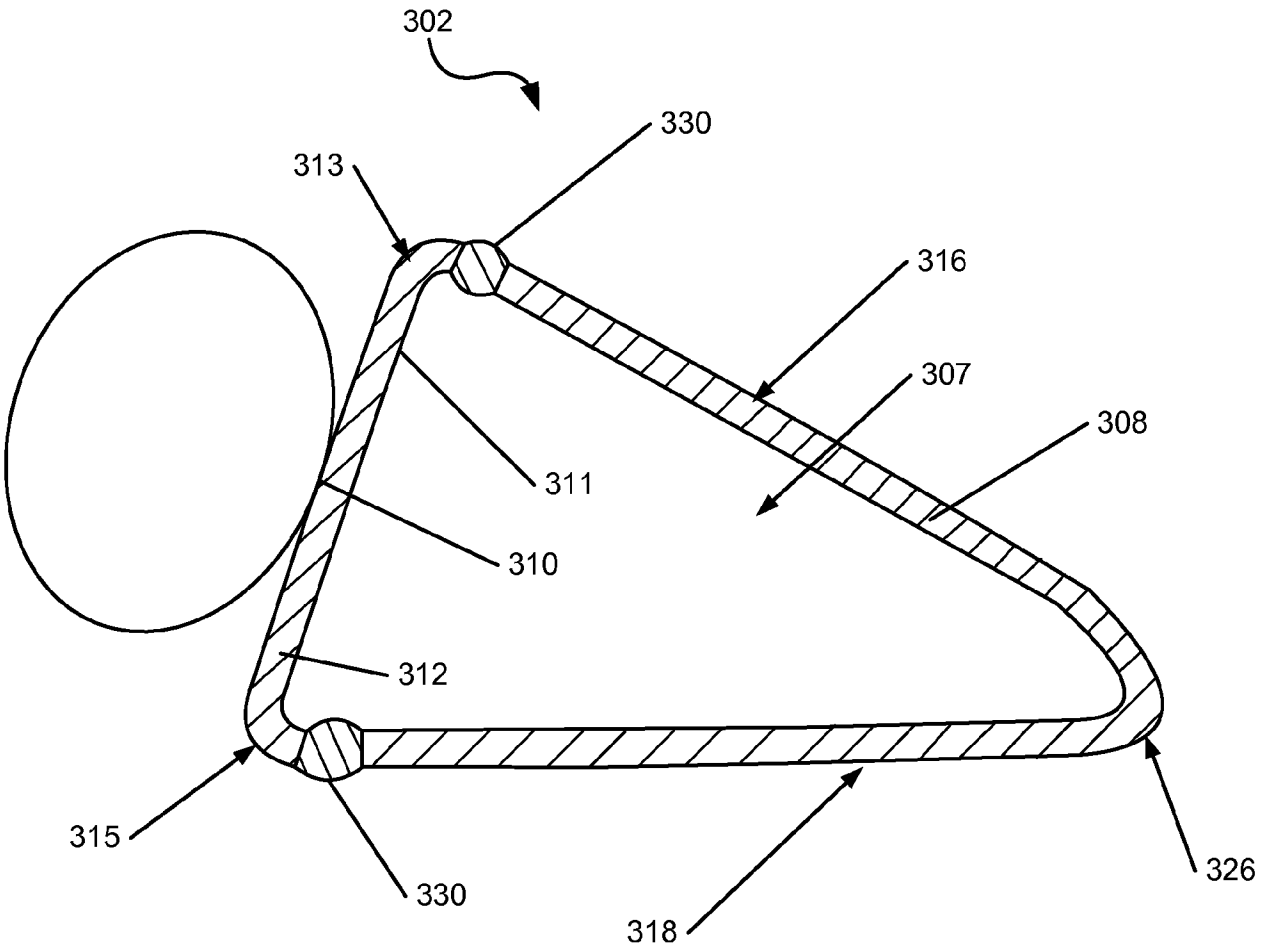
FIG. 10 is a cross-sectional view of the head as shown in FIG. 9, illustrated during impact with a ball.

FIGS. 9-10 illustrate another embodiment of a head 302 having impact-influencing features on the body 308. Many features of this embodiment are similar or comparable to features of the head 102 described above and shown in FIGS. 1-6, and such features are referred to using similar reference numerals under the "3xx" series of reference numerals, rather than "1xx" as used in the embodiment of FIGS. 1-6. Accordingly, certain features of the head 302 that were already described above with respect to the head 102 of FIGS. 1-6 may be described in lesser detail, or may not be described at all. The head 302 of FIGS. 9-10 has one or more areas or regions of flexible material 330, having higher flexibility relative to the material of the face 312 and/or the material of the adjacent areas of the body 308, which acts as an impact-influencing feature, similarly to the channels 130 described above. In this embodiment, the head 302 has a contiguous band of flexible material 330 that extends around the entire periphery of the body 308, across the top 316, bottom 318, heel, and toe of the head 302. The band of flexible material 330 is located immediately adjacent the peripheral edges 313, 315 of the face 312. The head 302 of FIGS. 9-10 may utilize a stiffened face 312, as described herein. The flexible material 330 may be connected to the face 312 and/or the body 308 by a variety of different techniques, including welding, brazing, bonding with an adhesive or other bonding material, fasteners and interlocking pieces, and/or a variety of joints and other mechanical connections, including lap joints, dovetail joints, press-fit arrangements, etc.

The flexible material 330 may be a different material than the face 312 and/or the body 308, or may be the same or a similar material that has characteristics increasing its flexibility. For example, the flexible material 330 may include materials such as a super elasto-plastic titanium alloys ("gum metal"), vitreous alloys, metallic glasses or other amorphous metallic materials, composite materials (carbon fiber and others), or other relatively flexible metals or metal alloys. In this embodiment, the flexible material 330 is more flexible than the material of the stiffened face 312, and is also more flexible than the material of the body 308, and extends approximately 1" behind the face 312. In other embodiments, the head 302 may have multiple, disconnected regions of the flexible material 330, and may have the flexible material 330 spaced rearwardly from the peripheral edges 313, 315 of the face 312, rather than immediately adjacent. In yet another embodiment, the entire body 308 may be made of the flexible material, such as the entire body 308 being made of a carbon fiber composite or other composite material. It is understood that the flexible material 330 may have a stiffness and/or a modulus that is lower than the stiffness and/or modulus of the face, and may also be lower than the stiffness and/or modulus of another portion of the body 308. For example, the flexible material 330 may have a modulus that is lower than the modulus of the material at least in the portions of the body 308 spacing the flexible material 330 from the face 312.

Figure 9A:
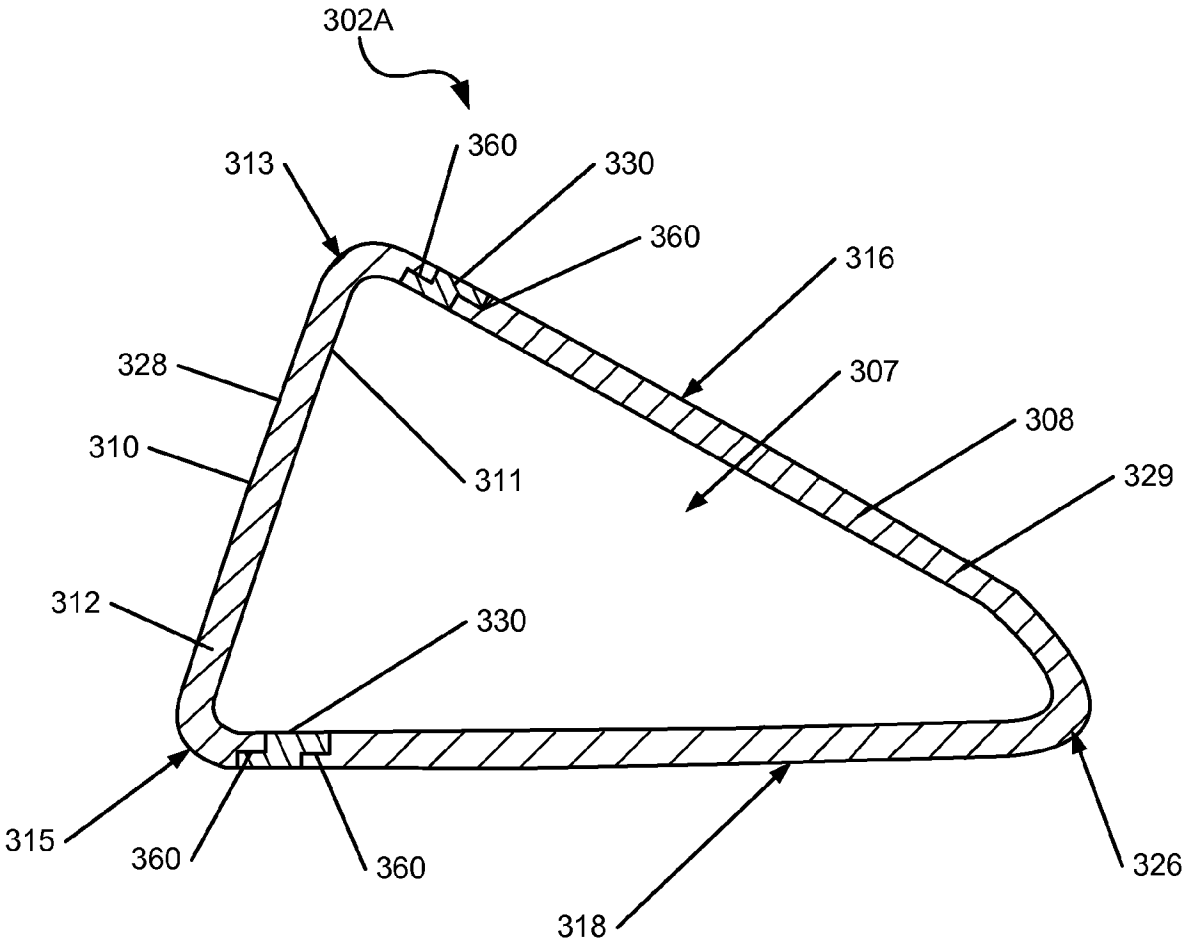
FIG. 9A is a cross-sectional view of an alternative embodiment of the head of FIG. 9.
Figure 9B:
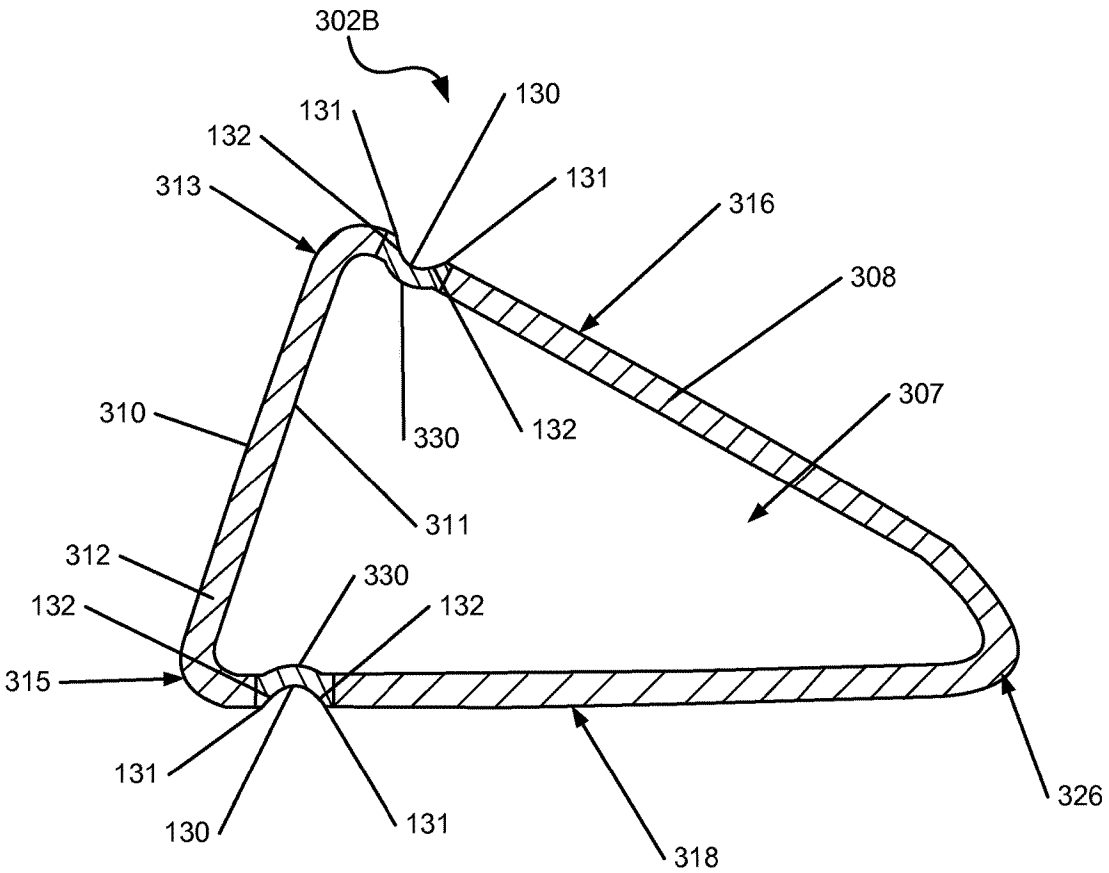
FIG. 9B is a cross-sectional view of another alternative embodiment of the head of FIG. 9.

FIG. 9A illustrates one embodiment of a head 302A configured similarly to the head 302 of FIGS. 9-10, where the flexible material 330 is connected to a face member 328 and a body member 329 using lap joint connections 360. It is understood that other techniques may be used to secure the lap joints 360, such as welding, brazing, bonding, press-fitting, etc. FIG. 9B illustrates another embodiment of a head 302B configured similarly to the head 302 of FIGS. 9-10, where the head 302B contains channels 130 as shown in FIG. 5 and described above with respect to the head 102 of FIGS. 1-5. In this embodiment, the channels 130 are formed of the flexible material 330, which can increase the flexibility and/or responsiveness of the channels 130. The flexible material 330 may be connected to the head 302B using any technique described herein.

FIG. 10 illustrates an impact of a ball 106 on the face 312 of the head 302. When the ball 106 impacts the ball striking surface 310, the stiffened face 312 has very little to no deformation, and the force of the impact is transferred to the flexible material 330 around the face 312. The flexible material 330 deforms due to the impact force, as shown in FIG. 10, and returns to its original configuration, as shown in FIG. 9, producing a response force that is transferred through the face 312 to the ball 106, propelling the ball 106 forward. The head 302 of FIGS. 9-10 can produce similar results and advantages as the head 102 of FIGS. 2-6 described above.

FIG. 12 illustrates another embodiment of a head 402 having impact-influencing features on the body 408. Many features of this embodiment are similar or comparable to features of the head 102 described above and shown in FIGS. 1-6, and such features are referred to using similar reference numerals under the "4xx" series of reference numerals, rather than "1xx" as used in the embodiment of FIGS. 1-6. Accordingly, certain features of the head 402 that were already described above with respect to the head 102 of FIGS. 1-6 may be described in lesser detail, or may not be described at all. The head 402 of FIG. 12 has a stiffened face 412 with a channel 430 extending around the entire periphery of the body 408, generally parallel to the peripheral edges 415 of the face 412 and spaced rearwardly from the face 412. The channel 430 has a trough-like cross-sectional shape, similar to the channel 130 described above. In this embodiment, the channel 430 has a width that is not tapered, and is fairly constant around the length of the channel 430, unlike the channel 130 described above. The channel 430 functions in a similar manner to the channel 130 shown in FIG. 6 on impact with a ball 106, and the head 402 of FIG. 12 can produce similar results and advantages as the head 102 of FIGS. 2-6 described above. Additionally, the head 402 of FIG. 12 has a squared rear peripheral shape and profile, in contrast to the rounded rear profile of the head 102 of FIGS. 1-6. Other features of the head 402 are similar to the head 102 of FIGS. 1-6.

FIGS. 13-21 illustrate different embodiments having stiffening structures for creating a stiffened face 112 or portion of the face 112. The embodiments of FIGS. 13-21 are illustrated as having a typical wood-type body, such as the body 14 shown in FIG. 11. However, it is understood that any of the embodiments of faces 512, 612, 712, 812 shown in FIGS. 13-21 and described below can be utilized in connection with bodies 108, 208, 308, 408 according to any of the embodiments described above, including any of the heads 102, 202, 302, 402 having impact-influencing features described above and shown in FIGS. 1-12. In further embodiments, other types of stiffening structures can be used, in addition or in place of the stiffening structures described herein, including stiffening structures as described in U.S. Published Patent Application No. 2010/0130303, referenced above.

Figure 13:
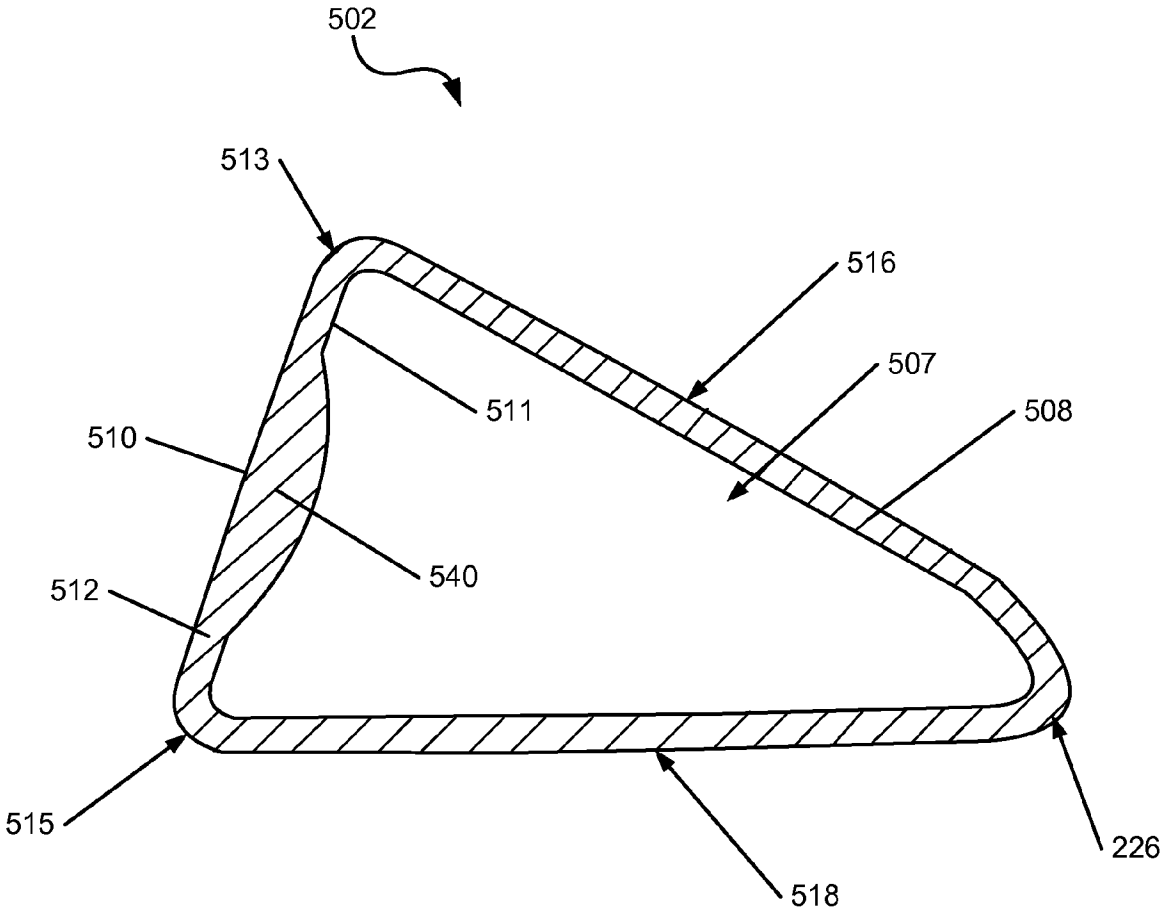
FIG. 13 is a cross-sectional view of another illustrative embodiment of a wood-type ball striking device according to aspects of the present invention.

FIG. 13 illustrates an embodiment of a head 502 having a stiffened face 512. Many features of this embodiment are similar or comparable to features of the head 102 described above and shown in FIGS. 1-6, and such features are referred to using similar reference numerals under the "5xx" series of reference numerals, rather than "1xx" as used in the embodiment of FIGS. 1-6. Accordingly, certain features of the head 502 that were already described above with respect to the head 102 of FIGS. 1-6 may be described in lesser detail, or may not be described at all. The face 512 of this embodiment includes stiffening structure in the form of a thickened portion 540 located around the area of highest response at the approximate center of the face 512. This thickened portion 540 increases the cross-sectional moment of inertia (I) of the face 512, and thus, can increase the stiffness (S) of the face 512. The thickened portion 540 may have a circular or slightly elliptical shape to correspond to the area at the center of the face 512 where impacts most frequently occur, although in other embodiments, the thickened portion 540 may have a different size, shape, and/or relative thickness. For example, the face 512 may have an area of variable thickness, which may be formed, for example, by a plurality of ridges, peaks, etc. on the inner surface 511 of the face 512. The body 508 of the head 502 of FIG. 13 may include impact-influencing features as described above.

FIGS. 14-17 illustrate embodiments of heads 602 having faces 612 that are stiffened through the use of face inserts 640A-D as stiffening structures. Many features of this embodiment are similar or comparable to features of the head 102 described above and shown in FIGS. 1-6, and such features are referred to using similar reference numerals under the "6xx" series of reference numerals, rather than "1xx" as used in the embodiment of FIGS. 1-6. Accordingly, certain features of the head 602 that were already described above with respect to the head 102 of FIGS. 1-6 may be described in lesser detail, or may not be described at all. The inserts 640A-D shown in FIGS. 14-17 are generally made of a material that has a higher modulus and/or hardness than the other portions of the face 612, increasing the stiffness of the face 612. For example, the inserts 640A-D can be made of any of the high-strength and/or high modulus materials described above, or another such material. Additionally, the inserts 640A-D illustrated in FIGS. 14-17 are all positioned at and around the center of the face 612, to provide added stiffness in the areas where the ball 106 contacts the face 612 most frequently. Further, the inserts 640A-D can increase stiffness both through the modulus of the material and by increasing the cross-sectional moment of inertia (I) of the face 612. The inserts 640A-D may be connected to the face 612 using many different joining techniques or combinations of such techniques, including welding or other integral joining techniques, adhesive substances, mechanical connectors, etc.

Figure 14:
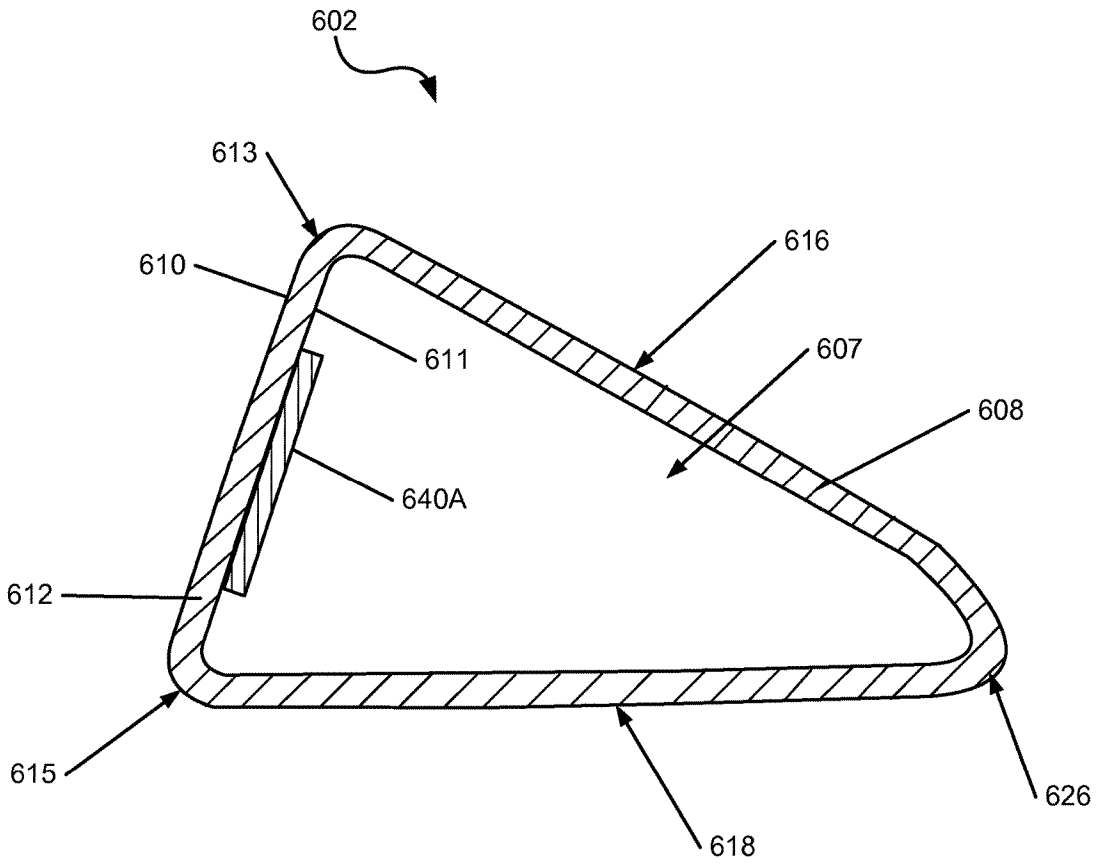
FIG. 14 is a cross-sectional view of another illustrative embodiment of a wood-type ball striking device according to aspects of the present invention.
Figure 15:
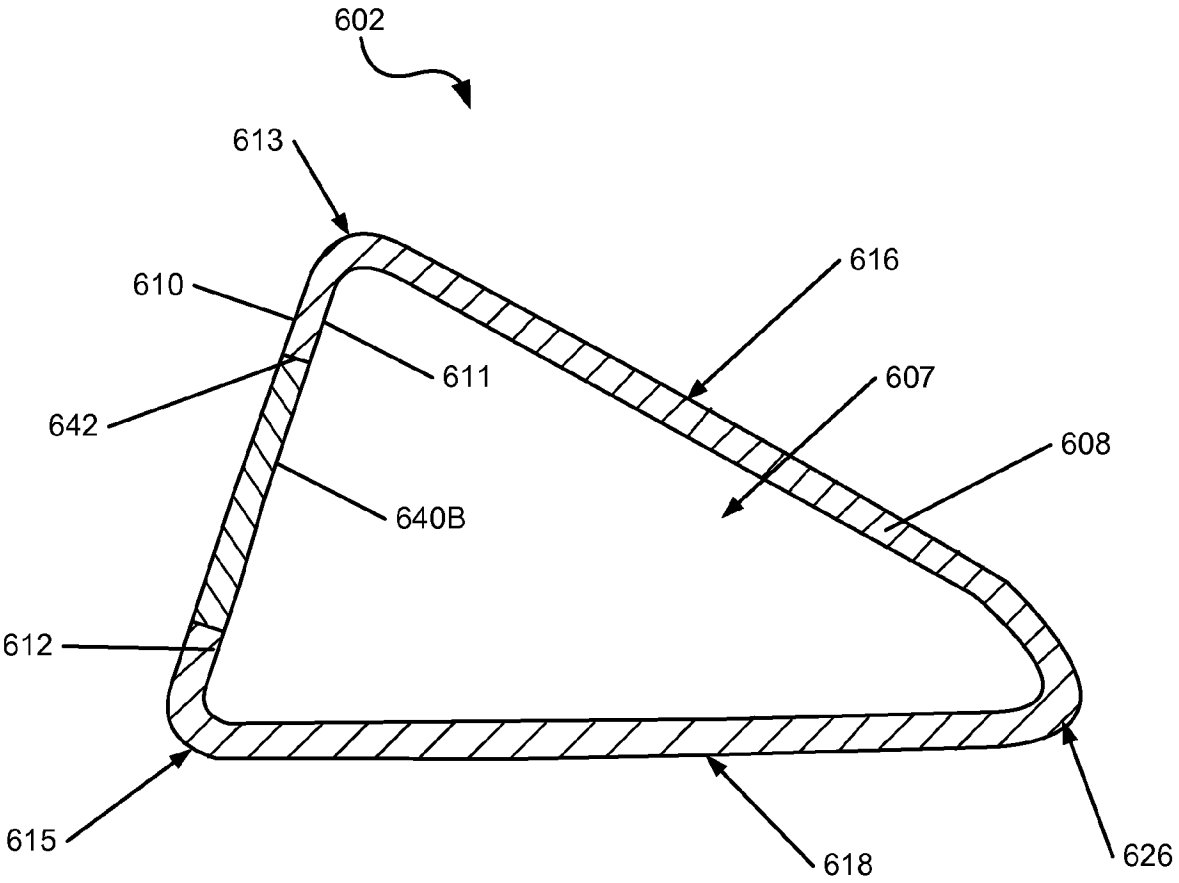
FIG. 15 is a cross-sectional view of another illustrative embodiment of a wood-type ball striking device according to aspects of the present invention.
Figure 16:
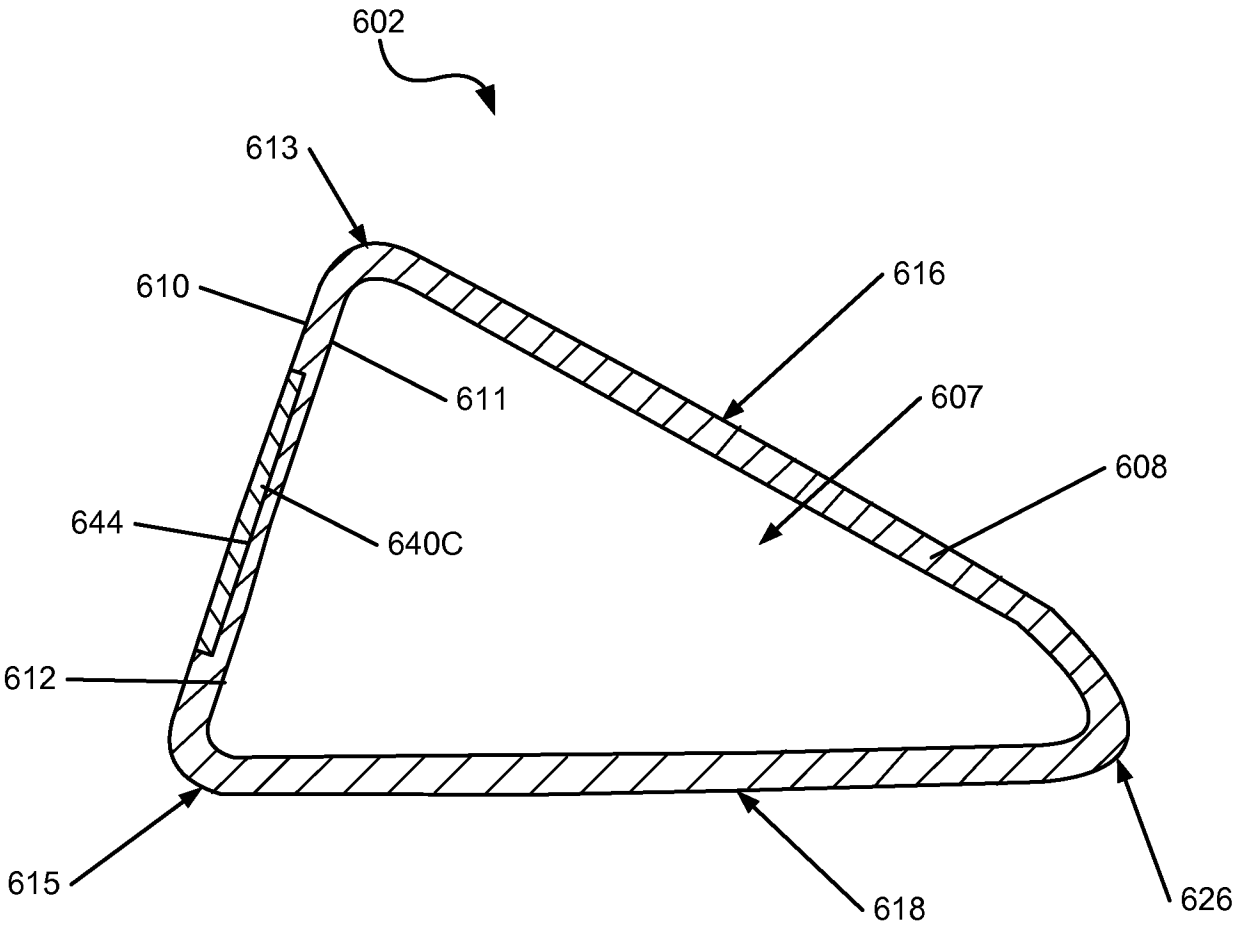
FIG. 16 is a cross-sectional view of another illustrative embodiment of a wood-type ball striking device according to aspects of the present invention.
Figure 17:
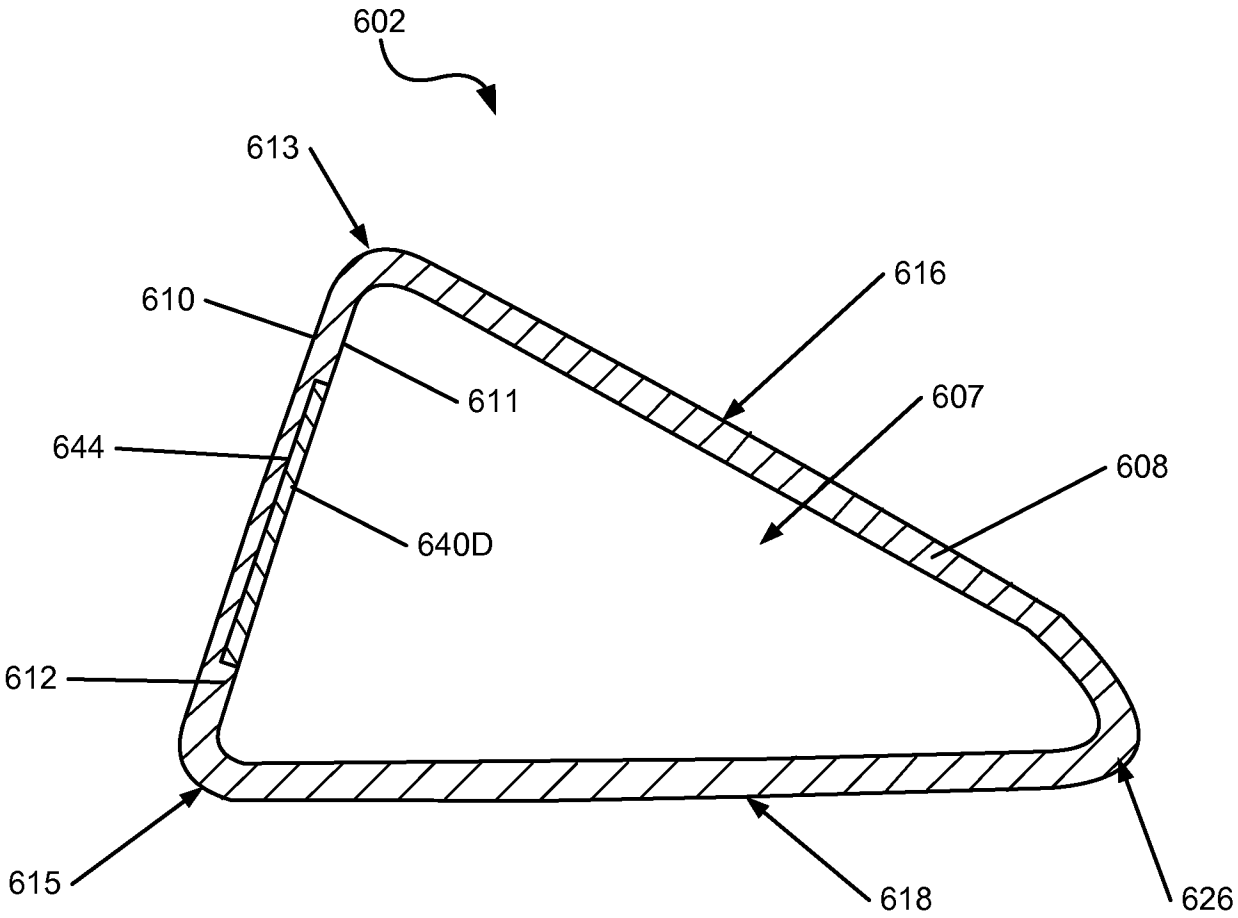
FIG. 17 is a cross-sectional view of another illustrative embodiment of a wood-type ball striking device according to aspects of the present invention.

The face 612 illustrated in FIG. 14 has a stiffening insert 640A positioned behind the face 612 and connected to the inner surface 611 of the face 612, to provide increased stiffness to the face 612. The face 612 illustrated in FIG. 15 has a stiffening insert 640B positioned in an opening 642 in the face 612 and extending completely through the face 612, from the inner surface 611 to the ball striking surface 610 of the face 612, to provide increased stiffness to the face 612. The face 612 illustrated in FIG. 16 has a stiffening insert 640C positioned within a recess 644 in the ball striking surface 610 of the face 612, to provide increased stiffness to the face 612. The face 612 illustrated in FIG. 17 has a stiffening insert 640D positioned within a recess 644 in the inner surface 611 of the face 612, behind the ball striking surface 610, to provide increased stiffness to the face 612. The body 608 of each of the heads 602 of FIGS. 14-17 may include impact-influencing features as described above, as well as other features described herein. In other embodiments, the head 602 may contain a different insert 640A-D, which may be differently shaped, sized, and/or configured. For example, the inserts 640A-D may take up a larger or smaller portion of the face 612, and may cover all or nearly all of the outer and/or inner surfaces 610, 611 of the face 612. In one example, the insert 640A in FIG. 14 can be an additional layer that is coated or otherwise adhered to the inner surface 611 of the face 612. Other examples and embodiments can be used as well.

Figure 18:
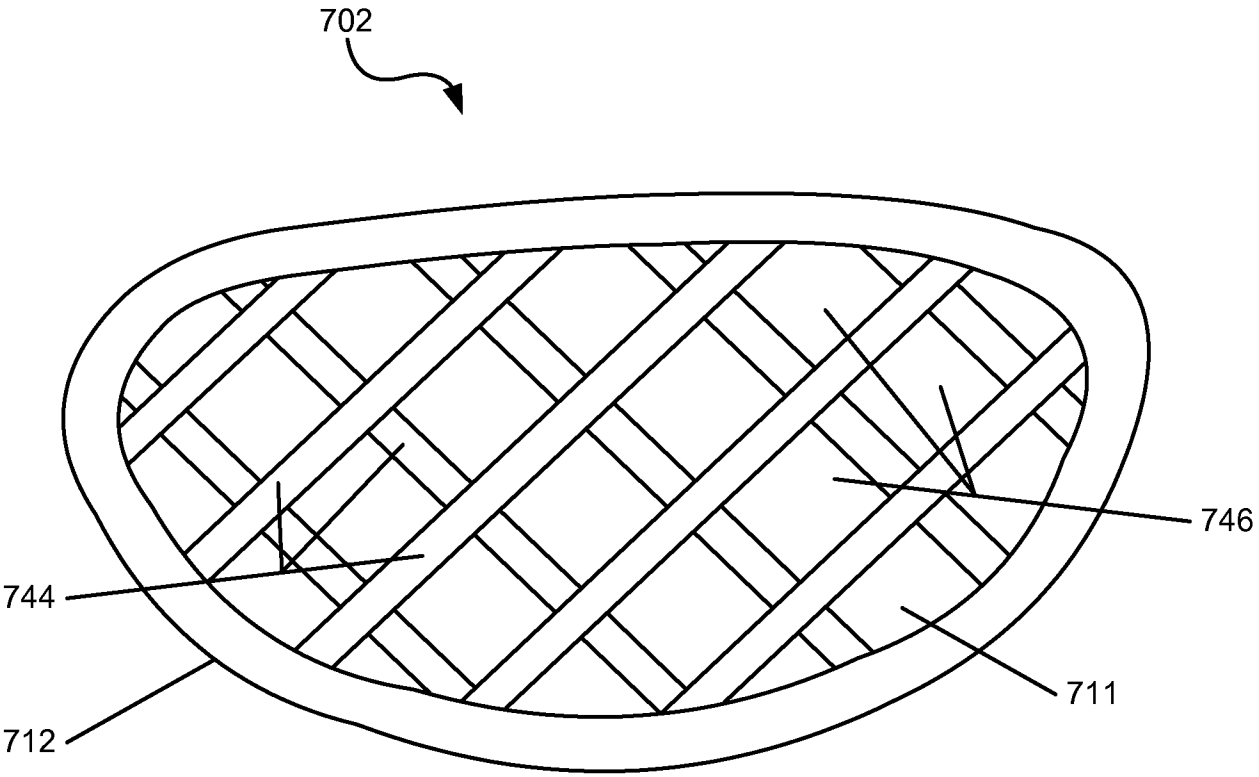
FIG. 18 is rear view of a face member of another illustrative embodiment of a wood-type ball striking device according to aspects of the present invention, illustrated with portions of the head removed to show detail on the rear of the face.

FIG. 18 illustrates an embodiment of a head 702 having a stiffened face 712. Many features of this embodiment are similar or comparable to features of the head 102 described above and shown in FIGS. 1-6, and such features are referred to using similar reference numerals under the "7xx" series of reference numerals, rather than "1xx" as used in the embodiment of FIGS. 1-6. Accordingly, certain features of the head 702 that were already described above with respect to the head 102 of FIGS. 1-6 may be described in lesser detail, or may not be described at all. The face 712 of this embodiment includes a stiffening structure on the inner surface 711 of the face 712. The stiffening structure in this embodiment is formed by a plurality of ribs 744 arranged in a crossing pattern on the inner surface 711 of the face 712. The ribs 744 in this embodiment extend inwardly from the inner surface 711 of the face 712, defining gaps 746 between the ribs 744. These ribs 744 provide strength and support to the face 712, and also increase the cross-sectional moment of inertia (I) in this embodiment, and accordingly, can increase the stiffness of the face 712. In other embodiments, the face 712 may have ribs 744 having a different size, shape, orientation, and/or configuration. It is understood that FIG. 18 depicts only the face 712 of the head 702, and does not depict any body or body member extending rearwardly from the face 712, although the face 712 may be used in connection with any of the heads 104, et seq., described above, including by connecting the face 712 to a body member 108, 208, 308, 408 as described above, having impact-influencing features.

Figure 19:
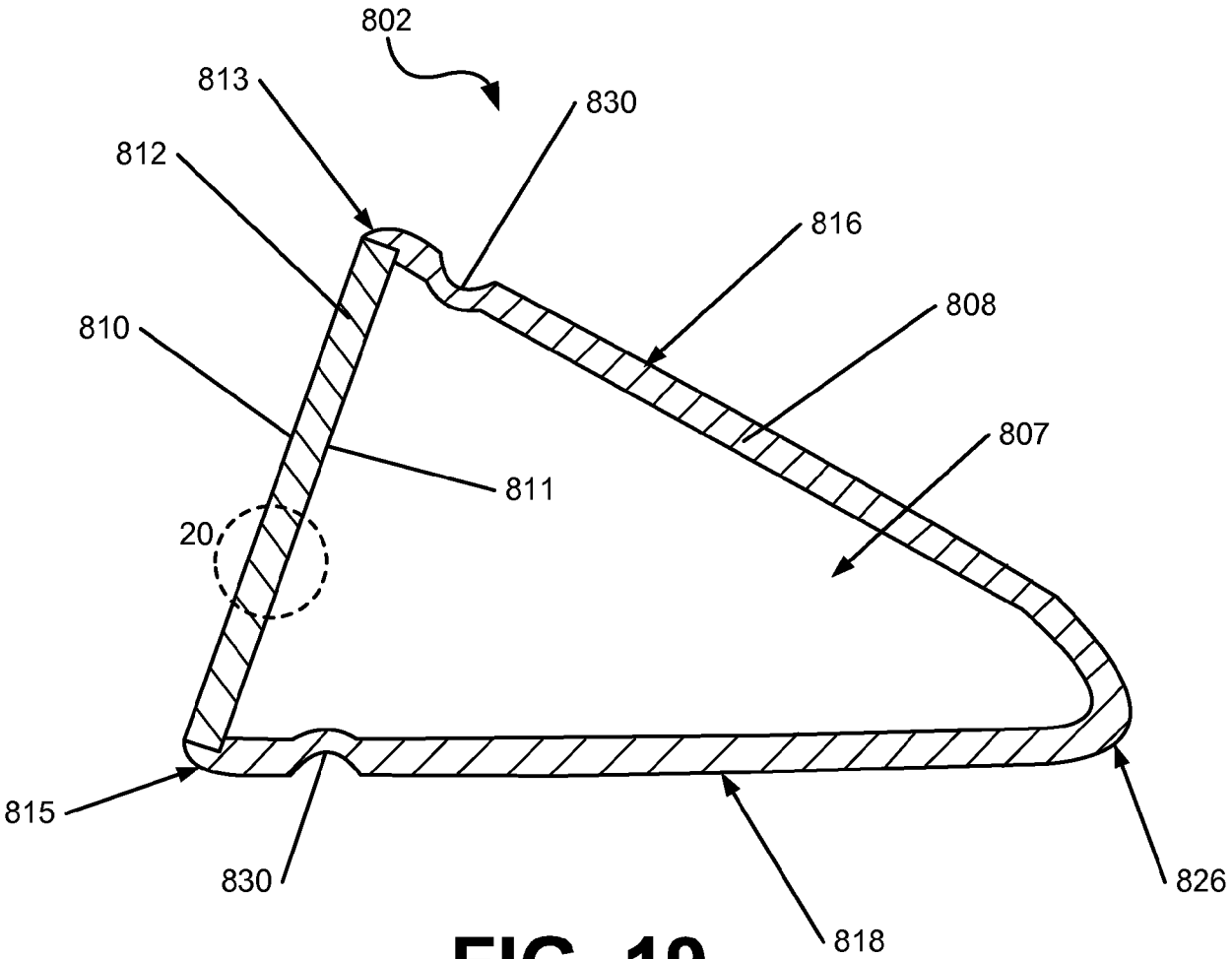
FIG. 19 is a cross-sectional view of another illustrative embodiment of a wood-type ball striking device according to aspects of the present invention.
Figure 20:
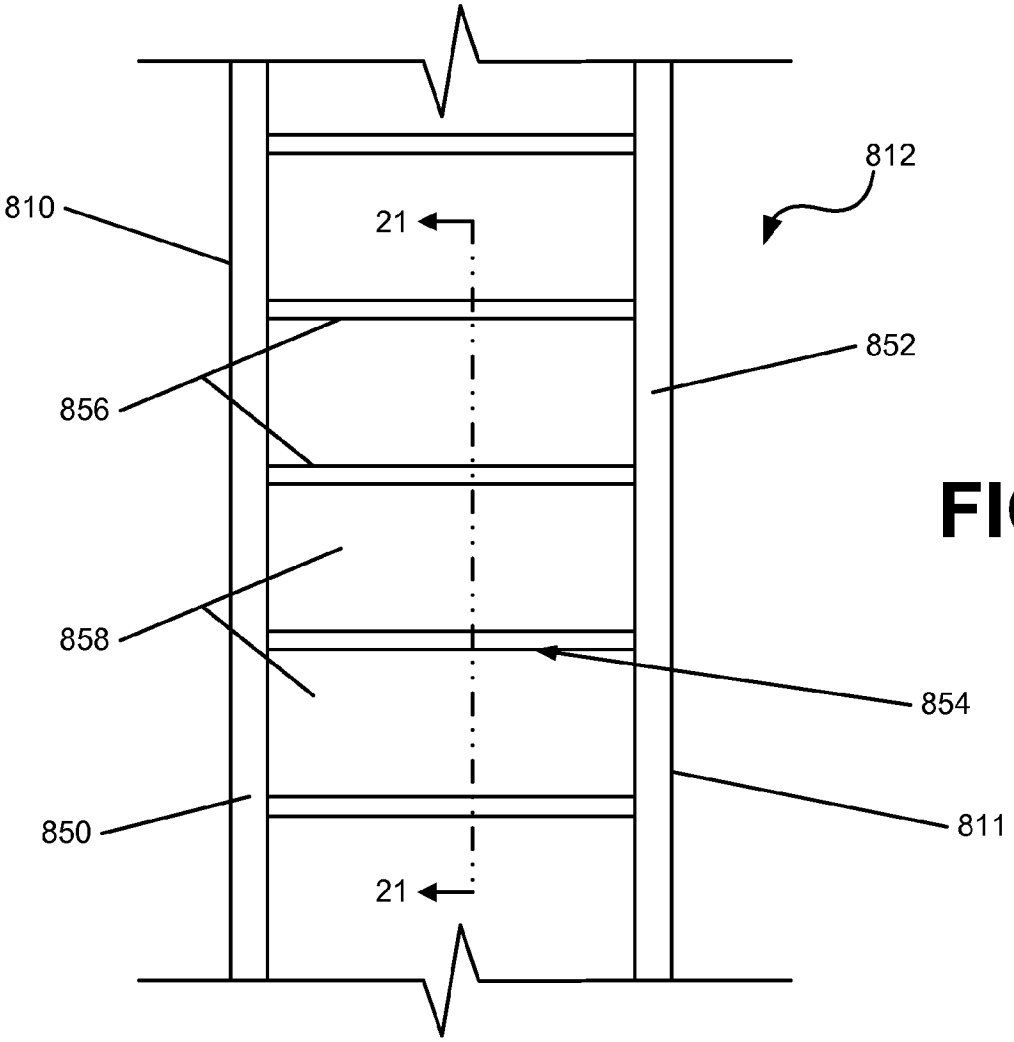
FIG. 20 is a magnified view of a portion of a face of the head of FIG. 19.
Figure 21:
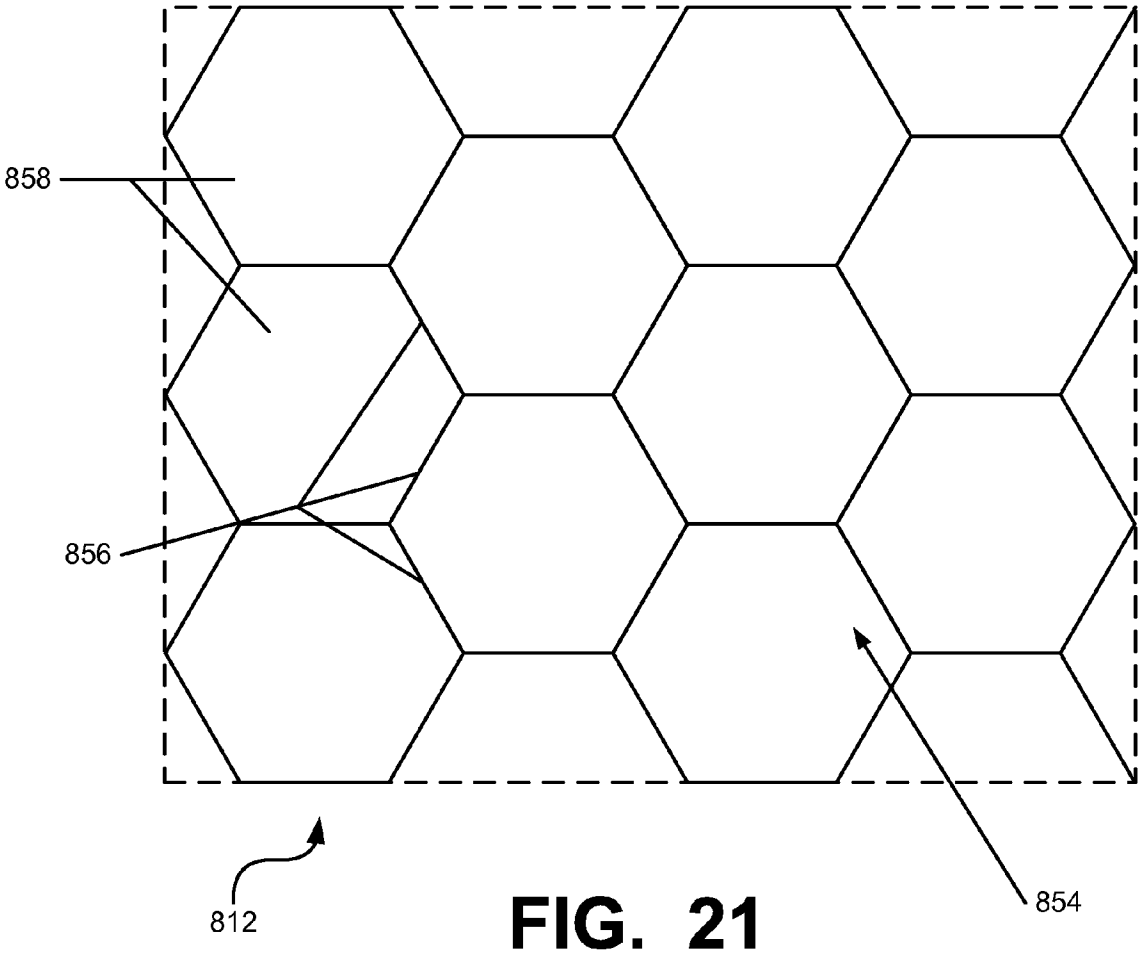
FIG. 21 is a cross-sectional view of a portion of the face of the head of FIG. 19, viewed along lines 21-21 of FIG. 20.

FIGS. 19-21 illustrate an embodiment of a head 802 having a stiffened face 812. Many features of this embodiment are similar or comparable to features of the head 102 described above and shown in FIGS. 1-6, and such features are referred to using similar reference numerals under the "8xx" series of reference numerals, rather than "1xx" as used in the embodiment of FIGS. 1-6. Accordingly, certain features of the head 802 that were already described above with respect to the head 102 of FIGS. 1-6 may be described in lesser detail, or may not be described at all. The face 812 of this embodiment includes a stiffening structure within the face 812. As shown in FIG. 20, the face 812 includes a thin, stiff face plate 850 and rear plate 852, with a porous stiffening structure 854 sandwiched between the face plate 850 and the rear plate 852. In this embodiment, the stiffening structure 854 is formed in a honeycomb pattern, including a plurality of internal walls 856 defining hexagonal-shaped chambers 858 in a honeycomb-like configuration. The stiffening structure 854 may be formed of the same material as the face plate 850 or a different material, and is connected to an inner surface 811 of the face plate 850. In one embodiment, the face plate 850 and the rear plate 852 are made from titanium, and the stiffening structure 854 is formed of a titanium composite material, such as a titanium/Nomex composite or a composite formed of titanium and another fiber material. Use of titanium in the stiffening structure can enhance weldability. In another embodiment, the stiffening structure 854 may be formed of titanium or titanium alloy or other metallic material, and may be connected to a metallic face plate 850 or rear plate 852 by welding, brazing, or other technique. In a further embodiment, the stiffening structure 854, the face plate 850, and/or the rear plate 852 may be formed of a polymer material or a polymer-fiber composite material. In embodiments where the stiffening structure 854 is made from a polymer material or polymer-fiber composite and the face plate 850 and/or the rear plate 854 is made from a metallic material, the stiffening structure 854 may be connected to the metallic components via adhesive or another bonding material. Further, in such embodiments, the face 812 may be connected to the body 808 using adhesive or another bonding material rather than welding, to ensure that welding temperatures do not affect the integrity of the polymer or the bonding material. As described elsewhere herein, the face 812 having the polymeric stiffening structure 854 (or other polymeric component) may be in various forms, including a plate or a cup face structure. In other embodiments, the face 812 may not include a rear plate 852.

The stiffening honeycomb structure 854 in this embodiment can increase stiffness of the face 812 through increasing the cross-sectional moment of inertia (I) of the face 812, with the internal walls 856 of the structure 854 acting as braces for the face 812. The honeycomb structure 854 in this embodiment can also have a high modulus, such as at least 280 GPa, in one example. In other embodiments, the face plate 850, the rear plate 852, and/or the stiffening structure 854 are made from different materials. The face plate 850, the rear plate 852, and the stiffening structure 854 may have varying thicknesses in different embodiments. For example, in one embodiment, the face 812 has a total thickness of 0.25 in., with the face plate 850 having a thickness of up to about 1/32 in. (or about 0.03 in.). In another embodiment, the face 812 may have a total thickness of up to about 0.25 in. Additionally, in one embodiment, the thicknesses of the internal walls 856 of the stiffening structure 854 are about 0.002-0.006 in. The rear plate 852, if present, may have a thickness comparable to that of the face plate 850 in each of these embodiments. As a further example, the chambers 858 may each have a width of from about 0.008 in. to 0.25 in. in one embodiment, or may have different widths in other embodiments. For example, in one embodiment, the chambers 858 may each have a width of 0.108 in., with a the internal walls 856 thickness of 0.004 in. In other embodiments, the structures may have different sizes and/or configurations. For example, in some embodiments, a different type of porous stiffening structure 854 may be used, such as having a different, non-honeycomb configuration. As another example, in some embodiments, the rear plate 852 may not be included, and the face 812 may contain only the face plate 850 and the stiffening structure 854.

The face 812 in FIGS. 19-21 is welded or otherwise integrally joined to a body member 828 to form the head 802, as shown in FIG. 19. In one embodiment, the face plate 850, the rear plate 852, and/or the honeycomb structure 854 may have varying thicknesses, which can influence the response of the face 812, and can also improve weldability. As shown in FIG. 19, the face 812 is joined to the body member 828 by welding at the ends of the face plate 812. However, in another embodiment, the face 812 may be welded only at the side (e.g., welding to the rear plate 852 only), rather than at the ends, and the body member 828 may contain additional supporting structure for the face 812. In a further embodiment, the face 812 may be formed as a cup-face structure adapted for connection to a body member 828 to form the head 802, as described above. In yet another embodiment, the face 812 may be joined to the body member 828 in another manner, such as by using fasteners or another mechanical joining technique, or by using adhesives.

A face 812 of this type illustrated in FIGS. 19-21 may have superior stiffness as compared to existing faces, but may have much less mass due to the porous structure, which permits weight savings in the face 812 to be added to a different part of the head 802 as desired. For example, a head 802 using the face 812 of FIGS. 19-21 may have a face 812 that has a thickness of 5-7 mm and a mass of 25 g in one embodiment, and 35 g in another embodiment. When impacted by the ball, all 25 g of the face will be involved in the impact, since the impact does not involve localized deformation or response on the face 812. In another embodiment, the face 812 may have a mass that is up to about 35 g, such as a face 812 with a mass of 20-35 g. In a further embodiment, the face 812 may have a mass that is between 25-30 g. In the embodiments described above, the remainder of the head 802 may have a weight of between 185-210 g, with the weight of the remainder of the head 802 in one embodiment being 200 g. This weight includes the hosel 809 and any adjustability structures associated with the hosel 809. The total weight of the portions of the head 802 behind the channel(s) 830 may be approximately 135-160 g, with approximately 27% of the weight of the head 802 being located from the channel(s) 830 forward and approximately 73% of the weight being located behind the channel(s) 830. In contrast, a typical face may have a thickness of about 3 mm and may have a mass of 45-50 g. When impacted by a ball 106, the mass of the face material that is involved in the impact (i.e. deforms and/or is located around the impact area) is around 5 g. Accordingly, the face 812 is lighter than existing faces, which permits the additional (e.g. 25 g) mass to be positioned on the body 808 while retaining the same total weight. Strategic positioning of this additional weight can be used to control the position of the center of gravity and/or the MOI of the head 802. The mass of the face 812 can be further lowered by using lighter materials. Likewise, the other embodiments of faces 112, et seq., described herein can have reduced mass through the use of lighter materials and/or porous or other lightweight structures.

In the embodiment illustrated in FIGS. 19-21, the head 802 has the face 812 connected to a body 808 similar to the body 108 described above and shown in FIGS. 2-6. The body 808 has one or more channels 830 extending around the body 808 generally parallel to the face 812 and spaced rearwardly from the face 812, as described above. The channel(s) 830 function in a similar manner to the channels 130 shown in FIG. 6 on impact with a ball 106, and the head 802 of FIGS. 19-21 can produce similar results and advantages as the head 102 of FIGS. 2-6 described above. In other embodiments, other features of heads 102, et seq., described herein may be incorporated into the head 802 of FIGS. 19-21, including any of the impact-influencing features described above and shown in FIGS. 7-10 and 12. Likewise, the features of the head 802 of FIGS. 19-21, including the stiffened face structure, can be incorporated into the other embodiments of heads 102, et seq., described herein.

Figure 22:
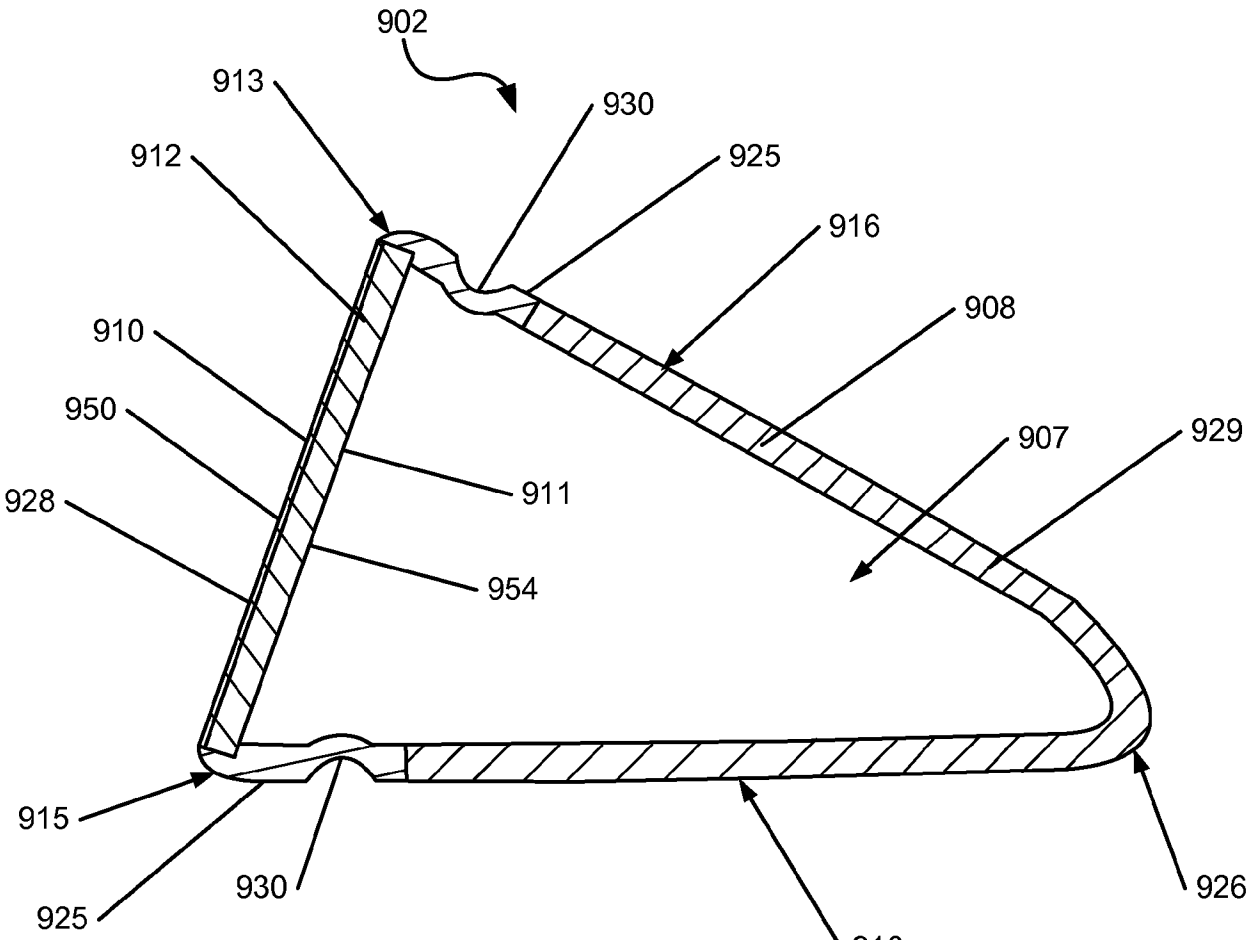
FIG. 22 is a cross-sectional view of another illustrative embodiment of a wood-type ball striking device according to aspects of the present invention.
Figure 23:
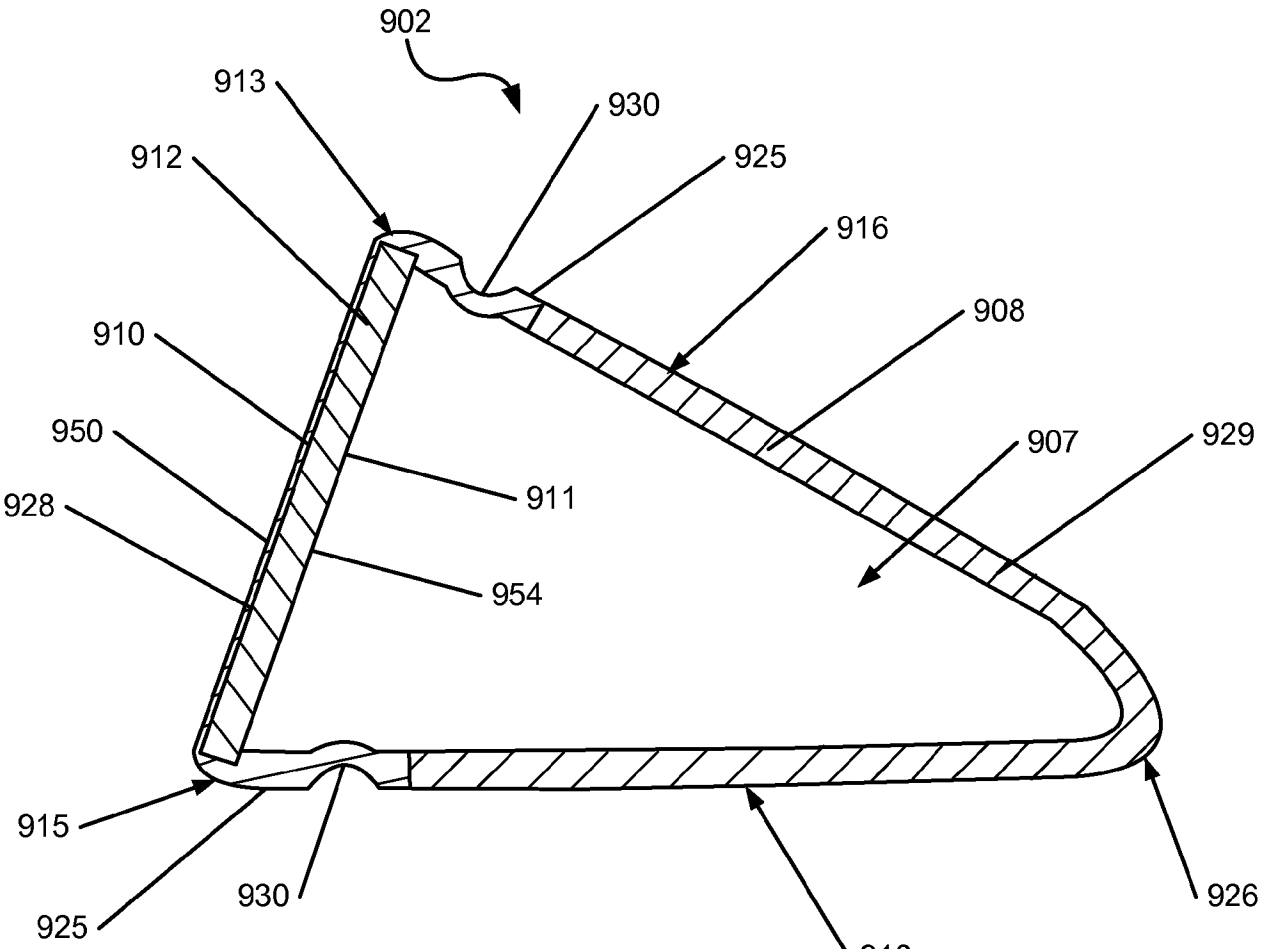
FIG. 23 is a cross-sectional view of another illustrative embodiment of a wood-type ball striking device according to aspects of the present invention.

FIGS. 22-23 illustrate embodiments of a head 902 having a stiffened face 912. Many features of this embodiment are similar or comparable to features of the head 102 described above and shown in FIGS. 1-6, and such features are referred to using similar reference numerals under the "9xx" series of reference numerals, rather than "1xx" as used in the embodiment of FIGS. 1-6. Accordingly, certain features of the head 902 that were already described above with respect to the head 102 of FIGS. 1-6 may be described in lesser detail, or may not be described at all. The face 912 of this embodiment includes a stiffening structure within the face 912 that is similar to the structure of the face 812 of FIGS. 19-21. In the head 902 of FIG. 22, the face 912 is connected as part of a face member 928 that includes the face plate 950, the stiffening structure 954, and walls 925 connected to the face 912 and extending rearward from the face 912. The walls 925 are joined to a body member 929 to form the head 902, such that the body member 929 and at least a portion of the walls 925 define the body 908. In this embodiment, the channel(s) 930 are formed in the walls 925 of the face member 928. However, in another embodiment, the channel(s) 930 may be formed in the body member 929, such as if the juncture between the face member 928 and the body member 929 is located in the portions of the body 908 spacing the channel(s) from the face 912. FIG. 22 illustrates the face 912, including the stiffening structure 954 and the face plate 950 as being a separate piece connected to the walls 925, such as by welding. The walls 925 may define a recess or cavity on the front and/or rear side to receive the face 912 in this configuration. However, in another embodiment, part or all of the face 912 may be integrally connected or formed with the walls 925. For example, in FIG. 23, the face plate 950 is integrally formed with the walls 925, and the stiffening structure 954 is connected to the back of the face plate 950. In further embodiments, the face 912 may be connected in a different manner. Additionally, the face member 928 may also include a rear plate (not shown) as described above. Other configurations are possible.

Several different embodiments have been described above, including the various embodiments of golf clubs 100 and heads 102, 202, 302, 402, 502, 602, 702, 802 (referred to herein as 102, et seq.) and portions thereof described herein. It is understood that any of the features of these various embodiments may be combined and/or interchanged. For example, as described above, various different combinations of club heads 102, et seq., with differently configured faces 112, et seq., may be used, including the configurations described herein, variations or combinations of such configurations, or other configurations. In one particular example, any of the club heads 102, et seq., described herein may include face stiffening features and/or impact-influencing body features as described above. In further embodiments, at least some of the features described herein can be used in connection with other configurations of iron-type clubs, wood-type clubs, other golf clubs, or other types of ball-striking devices.

Heads 102, et seq., incorporating the features disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head 102, et seq., according to features and embodiments described herein.

The ball striking devices and heads therefor as described herein provide many benefits and advantages over existing products. For example, as described above, the impact between the ball and the face can provide a high degree of response (COR), energy transfer, and ball velocity for impacts occurring away from the center of the face, such as high, low, heel, and toe impacts, as compared to existing club heads, because the face does not depend on localized "trampoline" effect for response force. Further, certain embodiments described herein can result in mass savings in the face, which allows for additional mass that can be strategically placed on the body to affect the center of gravity, weight distribution, and/or MOI of the club head. Still other benefits and advantages are readily recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A ball striking device comprising:

a face having a ball striking surface configured for striking a ball; and a body connected to the face and extending rearwardly from the face, the body having an impact-influencing structure positioned adjacent at least one peripheral edge of the face, wherein at least a portion of a force generated by impact with a ball is absorbed by the impact-influencing structure, and at least a portion of a response force generated by the device upon impact with the ball is generated by the impact-influencing structure, wherein the impact-influencing structure comprises at least one elongated, recessed channel extending at least partially around a periphery of the body along and adjacent to the at least one peripheral edge of the face, and wherein the face has a stiffness proximate a geometric center of the face that is from about 46,000 to 56,000 lb-in$^2$.

2. The ball striking device of claim 1, wherein the channel is located on an outer surface of the body.

3. The ball striking device of claim 1, wherein the channel is located on an interior surface of the body.

4. The ball striking device of claim 1, wherein the face has a stiffening structure increasing the stiffness of the face.

5. The ball striking device of claim 1, wherein the face comprises a face plate forming the ball striking surface and a porous stiffening structure connected to an inner side of the face plate.

6. The ball striking device of claim 5, wherein the porous stiffening structure comprises a plurality of interior walls forming a honeycomb structure having hexagonal chambers.

7. The ball striking device of claim 5, wherein the face further comprises a rear plate, wherein the porous stiffening structure is sandwiched between the face plate and the rear plate.

8. The ball striking device of claim 1, wherein a majority of the force generated by impact with the ball is absorbed by the impact-influencing structure, and a majority of the response force generated by the device upon impact with the ball is generated by the impact-influencing structure.

9. A golf club comprising the ball striking device of claim 1 and a shaft connected to the ball striking device.

10. A ball striking device comprising:

a face having a ball striking surface and being defined by a plurality of face edges, the face comprising a face plate having the ball striking surface thereon and a cellular stiffening structure engaged with an inner surface of the face plate, such that an entire front side of the cellular stiffening structure is engaged with a rear surface of the face plate;

a body connected to the face and extending rearward from the face edges to define an enclosed volume, wherein the body has a heel side, a toe side, a crown, and a sole; and a channel defined on the body by first and second boundary edges extending continuously around an entire circumference of the body and generally equidistant from the face edges, the channel being recessed from outer surfaces of the body between the first and second boundary edges, the channel including a crown channel portion extending at least partially across the crown, a sole channel portion extending at least partially across the sole, and additional channel portions extending around the heel and the toe sides to interconnect the crown channel portion and the sole channel portion to form the channel in a continuous shape, wherein the channel is spaced rearwardly from the face edges by a spacing portion, wherein the channel is configured such that at least some energy from an impact on the ball striking surface is transferred through the spacing portion and absorbed by the channel, causing the channel to deform and to exert a response force on the face, and wherein the face has a stiffness proximate a geometric center of the face that is from about 46,000 to 56,000 lb-in$^2$.

11. The ball striking device of claim 10, wherein the channel is configured such that a majority of the energy of the impact is absorbed by the channel, and a majority of a face response of the face during the impact is derived directly from the response force exerted by the channel on the face.

12. A golf club comprising the ball striking device of claim 10 and a shaft connected to the ball striking device, wherein the ball striking device is a golf club head.

13. A ball striking device comprising:

a face having a ball striking surface and being defined by a plurality of face edges, wherein the face has a stiffness proximate a geometric center of the face that is from about 46,000 to 56,000 lb-in$^2$;

a body connected to the face and extending rearward from the face edges to define an enclosed volume, wherein the body has a heel side, a toe side, a crown, and a sole;

a first channel defined on the body by first and second boundary edges extending between a first end proximate the heel side and a second end proximate the toe side, the first channel extending at least partially across the crown of the body, wherein the first channel is recessed inwardly from outer surfaces of the body between the first and second boundary edges; and a second channel defined on the body by third and fourth boundary edges extending between a third end proximate the heel side and a fourth end proximate the toe side, the second channel extending at least partially across the sole of the body, wherein the second channel is recessed inwardly from the outer surfaces of the body between the third and fourth boundary edges, wherein the first end is spaced from the third end, and the second end is spaced from the fourth end, such that the first channel and the second channel are completely separate, wherein the first and second channels are spaced rearwardly from the face edges by spacing portions, and wherein the first and second channels are configured such that at least some energy from an impact on the ball striking surface is transferred through the spacing portion and absorbed by at least one of the first and second channels, causing the at least one of the first and second channels to deform and to exert a response force on the face.

14. The ball striking device of claim 13, wherein at least a portion of the body including the first and second channels has a stiffness that is lower than a stiffness of the face.

15. The ball striking device of claim 13, wherein the first end and the second end are both located on one side of an outermost periphery of the body, and the third end and the fourth end are both located on an opposite side of the outermost periphery.

16. The ball striking device of claim 13, wherein a portion of the body, including at least the first and second channels, is formed of a flexible material having a modulus that is lower than a material of a second portion of the body.

17. The ball striking device of claim 16, wherein the second portion of the body includes the spacing portions.

18. The ball striking device of claim 13, wherein the face has a stiffening structure increasing the stiffness of the face.

19. The ball striking device of claim 13, wherein the face comprises a face plate forming the ball striking surface and a porous stiffening structure connected to an inner side of the face plate.

20. The ball striking device of claim 19, wherein the porous stiffening structure comprises a plurality of interior walls forming a honeycomb structure having hexagonal chambers.

21. The ball striking device of claim 19, wherein the face further comprises a rear plate, wherein the porous stiffening structure is sandwiched between the face plate and the rear plate.

22. The ball striking device of claim 13, wherein a majority of a force generated by the impact on the ball striking surface is absorbed by the first and second channels, and a majority of the response force generated by the device upon the impact on the ball striking surface is generated by the first and second channels.

23. The ball striking device of claim 13, wherein the first channel is recessed deeper proximate a center of the first channel than at the first and second ends and a depth of the first channel tapers deeper from the first and second ends to the center, and wherein the second channel is recessed deeper proximate a center of the second channel than at the third and fourth ends and a depth of the second channel tapers deeper from the third and fourth ends to the center.

24. The ball striking device of claim 13, wherein the face is formed as part of a face member and the device further comprises a body member connected to the face member and forming at least a portion of the body.

25. The ball striking device of claim 24, wherein the face member comprises the face and a wall extending rearwardly from the face, the wall combining with the body member to define the body, wherein the first channel and the second channel are located entirely within the wall.

26. A golf club comprising the ball striking device of claim 13 and a shaft connected to the ball striking device.

27. A ball striking device comprising:

a face member comprising a face having a ball striking surface and being defined by a plurality of face edges;

a rear member located rearwardly of the face member, wherein the face member and the rear member combine to define a body connected to the face and extending rearward from the face edges to define an enclosed volume, wherein the body has a heel side, a toe side, a crown, and a sole; and a band of flexible material extending around at least a portion of a circumference of the body and being generally equidistant from the face edges, the flexible material having a stiffness that is lower than a stiffness of the face and a modulus that is lower than a modulus of another portion of the body, wherein the band connects the face member and the rear member and completely separates the face member from the rear member, and wherein the band is spaced rearwardly from the face edges by a spacing portion on the face member, wherein a first channel is defined on the body by first and second boundary edges extending between a first end proximate the heel side and a second end proximate the toe side, wherein the first channel is recessed inwardly from outer surfaces of the body between the first and second boundary edges, wherein the first channel is spaced rearwardly from the face edges by the spacing portion, and wherein the first channel is positioned within the band, such that the flexible material forms the first channel, wherein the band is configured such that at least some energy from an impact on the ball striking surface is transferred through the spacing portion and absorbed by the band, such that the band is configured to be compressed between the face member and the rear member, causing the band to deform and to exert a response force on the face.

28. The ball striking device of claim 27, wherein the first channel extends at least partially across the crown of the body, further comprising a second channel defined on the body by third and fourth boundary edges extending between a third end proximate the heel side and a fourth end proximate the toe side, the second channel extending at least partially across the sole of the body, wherein the second channel is recessed inwardly from the outer surfaces of the body between the third and fourth boundary edges, wherein the second channel is positioned within the band, such that the flexible material forms the second channel, wherein the second channel is spaced rearwardly from the face edges by an additional spacing portion, and wherein the first end is spaced from the third end, and the second end is spaced from the fourth end, such that the first channel and the second channel are completely separate.

29. The ball striking device of claim 27, wherein the first and second boundary edges extending continuously around an entire circumference of the body and generally equidistant from the face edges, the first channel including a crown channel portion extending at least partially across the crown, a sole channel portion extending at least partially across the sole, and additional channel portions extending around the heel side and the toe side to interconnect the crown channel portion and the sole channel portion to form the first channel in a continuous circumferential shape.

30. The ball striking device of claim 27, wherein the face comprises a face plate forming the ball striking surface and a porous stiffening structure connected to an inner side of the face plate.

31. The ball striking device of claim 27, wherein band is joined to at least one of the face member and the rear member by a lap joint.

32. A golf club comprising the ball striking device of claim 27 and a shaft connected to the ball striking device.

33. A ball striking device comprising:

a face having a ball striking surface and being defined by a plurality of face edges;

a body connected to the face and extending rearward from the face edges to define an enclosed volume, wherein the body has a heel side, a toe side, a crown, and a sole; and a band of flexible material extending around at least a portion of a circumference of the body and being generally equidistant from the face edges, the flexible material having a stiffness that is lower than a stiffness of the face and a modulus that is lower than a modulus of another portion of the body, wherein the ball striking device is formed of a front portion that includes the face and a rear portion located rearwardly of the front portion, wherein the band is positioned between the front portion and the rear portion, such that the band forms an entire thickness of a wall of the ball striking device at a location of the band, and wherein the band is configured such that at least some energy from an impact on the ball striking surface is transferred through a spacing portion between the face and the band and absorbed by the band, such that the band is configured to be compressed between the front portion and the rear portion, causing the band to deform and to exert a response force on the face, and wherein a first channel is defined on the body by first and second boundary edges extending between a first end proximate the heel side and a second end proximate the toe side, wherein the first channel is recessed inwardly from outer surfaces of the body between the first and second boundary edges, wherein the first channel is spaced rearwardly from the face edges by the spacing portion, and wherein the first channel is positioned within the band, such that the flexible material forms the first channel.

34. A ball striking device comprising:

a face having a ball striking surface and being defined by a plurality of face edges;

a body connected to the face and extending rearward from the face edges to define an enclosed volume, wherein the body has a heel side, a toe side, a crown, and a sole;

a first channel defined on the body by first and second boundary edges extending between a first end proximate the heel side and a second end proximate the toe side, the first channel extending at least partially across the crown of the body, wherein the first channel is recessed inwardly from outer surfaces of the body between the first and second boundary edges; and a second channel defined on the body by third and fourth boundary edges extending between a third end proximate the heel side and a fourth end proximate the toe side, the second channel extending at least partially across the sole of the body, wherein the second channel is recessed inwardly from the outer surfaces of the body between the third and fourth boundary edges;

wherein the first end is spaced from the third end, and the second end is spaced from the fourth end, such that the first channel and the second channel are completely separate, wherein the first and second channels are spaced rearwardly from the face edges by spacing portions, wherein the first and second channels are configured such that at least some energy from an impact on the ball striking surface is transferred through the spacing portion and absorbed by at least one of the first and second channels, causing the at least one of the first and second channels to deform and to exert a response force on the face, and wherein the first channel is recessed deeper proximate a center of the first channel than at the first and second ends and a depth of the first channel tapers deeper from the first and second ends to the center, and wherein the second channel is recessed deeper proximate a center of the second channel than at the third and fourth ends and a depth of the second channel tapers deeper from the third and fourth ends to the center.

35. A ball striking device comprising:

a face having a ball striking surface and being defined by a plurality of face edges, wherein the face has a stiffness proximate a geometric center of the face that is from about 46,000 to 56,000 lb-in$^2$;

a body connected to the face and extending rearward from the face edges to define an enclosed volume, wherein the body has a heel side, a toe side, a crown, and a sole;

a first channel defined on the body by first and second boundary edges extending between a first end proximate the heel side and a second end proximate the toe side, the first channel extending at least partially across the crown of the body, wherein the first channel is recessed inwardly from outer surfaces of the body between the first and second boundary edges; and a second channel defined on the body by third and fourth boundary edges extending between a third end proximate the heel side and a fourth end proximate the toe side, the second channel extending at least partially across the sole of the body, wherein the second channel is recessed inwardly from the outer surfaces of the body between the third and fourth boundary edges, wherein the first end is spaced from the third end, and the second end is spaced from the fourth end, such that the first channel and the second channel are completely separate, wherein the first and second channels are spaced rearwardly from the face edges by spacing portions, wherein the first and second channels are configured such that at least some energy from an impact on the ball striking surface is transferred through the spacing portion and absorbed by at least one of the first and second channels, causing the at least one of the first and second channels to deform and to exert a response force on the face, wherein the face is formed as part of a face member and the device further comprises a body member connected to the face member and forming at least a portion of the body, and wherein the face member comprises the face and a wall extending rearwardly from the face, the wall combining with the body member to define the body, wherein the first channel and the second channel are located entirely within the wall.

* * * * *